United States Patent [19]

Maskasky

[11] Patent Number: 4,643,966

[45] Date of Patent: Feb. 17, 1987

[54] EMULSIONS AND PHOTOGRAPHIC ELEMENTS CONTAINING RUFFLED SILVER HALIDE GRAINS

[75] Inventor: Joe E. Maskasky, Rochester, N.Y.

[73] Assignee: Eastman Kodak Company, Rochester, N.Y.

[21] Appl. No.: 772,271

[22] Filed: Sep. 3, 1985

[51] Int. Cl.[4] ..... G03C 1/02

[52] U.S. Cl. ..... 430/567; 423/489; 423/491

[58] Field of Search ..... 430/567; 423/489, 491

[56] References Cited

U.S. PATENT DOCUMENTS

| | | | |
|---|---|---|---|
| 1,696,830 | 12/1928 | Wulff et al. | 430/614 |
| 3,206,313 | 9/1965 | Porter et al. | 430/138 |
| 3,317,322 | 5/1967 | Porter et al. | 430/567 |
| 3,367,778 | 2/1968 | Berriman | 430/411 |
| 3,519,426 | 7/1980 | Halwig | 430/569 |
| 3,761,276 | 9/1973 | Evans | 430/547 |
| 3,804,629 | 4/1974 | Hammerstein et al. | 430/569 |
| 3,817,756 | 6/1974 | Claes et al. . | |
| 3,885,970 | 5/1976 | Miyahara | 430/567 |
| 4,183,756 | 1/1980 | Locker | 430/569 |
| 4,225,666 | 9/1980 | Locker et al. | 430/569 |
| 4,386,156 | 5/1983 | Mignot | 430/567 |
| 4,399,215 | 8/1983 | Wey | 430/567 |
| 4,400,463 | 8/1983 | Maskasky | 430/434 |
| 4,414,304 | 11/1983 | Dickerson | 430/353 |
| 4,414,306 | 11/1983 | Wey et al. | 430/434 |
| 4,414,310 | 11/1983 | Daubendiek | 430/567 |
| 4,425,425 | 1/1984 | Abbott et al. | 430/502 |
| 4,425,426 | 1/1984 | Abbott et al. | 430/502 |
| 4,433,048 | 2/1984 | Solberg et al. | 430/434 |
| 4,434,226 | 2/1984 | Wilgus et al. | 430/567 |
| 4,435,501 | 3/1984 | Maskasky | 430/434 |
| 4,439,520 | 3/1984 | Kofron et al. | 430/434 |
| 4,478,929 | 10/1984 | Jones et al. | 430/217 |
| 4,504,570 | 3/1985 | Evans et al. | 430/217 |

FOREIGN PATENT DOCUMENTS 58-54333 3/1983 Japan .

OTHER PUBLICATIONS

James, *The Theory of the Photographic Process,* 4th Ed., Macmillan, New York, 1977, pp. 98 through 100.

Wyrsch, *Papers from the 1978 International Congress of Photographic Science,* Rochester, N.Y., 111–13, p. 122.

Berry, "Surface Structure and Reactivity of AgBr Dodecahedra", *Photographic Science and Engineering,* vol. 19, No. 3, May/Jun. 1975, pp. 171 and 172.

Klein et al, "Formation of Twins of AgBr and AgCl Crystals in Photographic Emulsions", *Photographische Korrespondenz,* vol. 99, No. 7, pp. 99–102 (1963).

Mignot *Research Disclosure,* vol. 232, Aug. 1983, Item 23212.

Berry and Skillman, "Surface Structures and Epitaxial Growth on AgBr Microcrystals", *Journal of Applied Physics,* vol. 35, No. 7, Jul. 1964, pp. 2165–2169.

A. P. H. Trivelli and S. E. Sheppard, *The Silver Bromide Grain of Photographic Emulsions,* Van Nostrand, Chapters VI and VIII, 1921.

W. Reinders, "Studies of Photohalide Crystals", *Kolloid-Zeitschrift,* vol. 9, pp. 10–14 (1911).

W. Reinders, "Study of Photohalides III Absorption of Dyes, Proteins and Other Organic Compounds in Crystalline Silver Chloride", *Zeitschrift fur Physikalische Chemie,* vol. 77, pp. 677–699 (1911).

Hirata et al, "Crystal Habit of Photographic Emulsion Grains", *J. Photog. Soc. of Japan,* vol. 36, pp. 359–363 (1973).

Oppenheimer et al, "Role of Cationic Surfactants in Recrystallization of Aqueous Silver Bromide Dispersions", in *Particle Growth and Suspension,* A. L. Smith ed., Academic Press, London, 1973, pp. 159–178.

*Primary Examiner*—John E. Kittle
*Assistant Examiner*—Mukund J. Shah
*Attorney, Agent, or Firm*—Carl O. Thomas

[57] ABSTRACT

Silver halide photographic emulsions comprised of radiation sensitive silver grains of a cubic crystal lattice structure having ruffled faces and photographic elements including these emulsions are disclosed.

26 Claims, 49 Drawing Figures

1 μm

1 μm

1 μm

1 μm

1 μm

1 μm

1μm

2 μm

1μm

1 μm

1 μm

1 μm

1 μm

1μm

1μm

1μm

1μm

1 μm

1μm

1μm

1μm

1μm

1μm

1 μm

1 μm

1μm

1 μm

1 μm

1μm

.5μm

.5μm

EMULSIONS AND PHOTOGRAPHIC ELEMENTS CONTAINING RUFFLED SILVER HALIDE GRAINS

FIELD OF THE INVENTION

This invention relates to photography. More specifically, this invention is directed to photographic emulsions containing silver halide grains and to photographic elements containing these emulsions.

BACKGROUND OF THE INVENTION

Silver halide photography has been practiced for more than a century. The radiation sensitive silver halide compositions initially employed for imaging were termed emulsions, since it was not originally appreciated that a solid phase was present. The term "photographic emulsion" has remained in use, although it has long been known that the radiation sensitive component is present in the form of dispersed microcrystals, typically referred to as grains.

Over the years silver halide grains have been the subject of intense investigation. Although high iodide silver halide grains, those containing at least 90 mole percent iodide, based on silver, are known and have been suggested for photographic applications, in practice photographic emulsions almost always contain silver halide grains comprised of bromide, chloride, or mixtures of chloride and bromide optionally containing minor amounts of iodide. Up to about 40 mole percent iodide, based on silver, can be accommodated in a silver bromide crystal structure without observation of a separate silver iodide phase. However, in practice silver halide emulsions rarely contain more than about 15 mole percent iodide, with iodide well below 10 mole percent being most common. All silver halide grains, except rarely employed high iodide silver halide grains, hereinafter excluded from consideration except as expressly noted, exhibit cubic crystal lattice structures.

It has been recognized for many years that the ratio of silver halide grain surface area to grain volume is not constant. Finer silver halide grains exhibit higher grain surface area in relation to grain volume, more commonly referred to indirectly in terms of coating coverages—e.g., grams of silver per square meter. An increased ratio of silver halide grain surface area to grain volume, hereinafter referred to as the grain surface area ratio, can be advantageous in improving photographic performance dependent on surface effects, such as interaction with processing agents as well as interactions with adsorbed addenda, such as spectral sensitizing dyes.

However, extremely fine grain emulsions, such as Lippmann emulsions, which have the highest surface area ratios, are not commonly employed for forming latent images in silver halide emulsions, since they exhibit low photographic speeds. Within the range of silver halide grain sizes normally encountered in photographic elements the maximum speed obtained at optimum sensitization increases linearly with increasing grain size. Thus, radiation sensitive emulsions have often represented a compromise between meeting photographic speed objectives dictating larger grain sizes and satisfying other performance criteria benefiting by increasing grain surface area ratios and therefore favoring finer silver halide grains.

A variety of regular and irregular grain shapes have been observed in silver halide photographic emulsions.

While grains can show corner and edge rounding attributable to a lower activation energy for silver halide solubilization at these locations, in general silver halide grains are polyhedral, being bounded by distinct crystal faces.

Silver halide favors the formation of crystallographic faces of either the cubic or octahedral form. Silver chloride strongly favors the formation of cubic crystal faces. Silver bromide also favors the formation of cubic crystal faces, but favors the formation of octahedral crystal faces in the presence of an excess of bromide ions. Iodide ions in the crystal structure tend to increase the grain preference for crystal faces of the octahedral form. A discussion of the factors which cause one crystallographic form to be favored over another is offered by James, *The Theory of the Photographic Process,* 4th Ed., Macmillan, New York, 1977, pp. 98 through 100.

Regular silver halide grains bounded by cubic crystal faces are cubic in appearance when examined by electron microscopy. A regular cubic grain 1 is shown in FIG. 1. The cubic grain is bounded by six identical crystal faces. In the photographic literature these crystal faces are usually referred to as {100} crystal faces, referring to the Miller index employed for designating crystal faces. While the {100} crystal face designation is most commonly employed in connection with silver halide grains, these same crystal faces are sometimes also referred to as {200} crystal faces, the difference in designation resulting from a difference in the definition of the basic unit of the crystal structure. Although the cubic crystal shape is readily visually identified in regular grains, in irregular grains cubic crystal faces are not always square. In grains of more complex shapes the presence of cubic crystal faces can be verified by a combination of visual inspection and the 90° angle of intersection formed by adjacent cubic crystal faces.

The practical importance of the cubic crystal faces is that they present a unique surface arrangement of silver and halide ions, which in turn influences the grain surface reactions and adsorptions typically encountered in photographic applications. This unique surface arrangement of ions as theoretically hypothesized is schematically illustrated by FIG. 2, wherein the smaller spheres 2 represent silver ions while the larger spheres 3 designate bromine ions. Although on an enlarged scale, the relative size and position of the silver and bromide ions is accurately represented. When chloride ions are substituted for bromide ions, the relative arrangement would remain the same, although the chloride ions are smaller than the bromide ions. It can be seen that a plurality of parallel rows, indicated by lines 4, are present, each formed by alternating silver and bromine ions. In FIG. 2 a portion of the next tier of ions lying below the surface tier is shown to illustrate their relationship to the surface tier of ions.

In another form regular silver halide grains when observed by electron microscopy are octahedral in appearance. A regular octahedral grain 5 is shown in FIG. 3. The octahedral grain is bounded by eight identical crystal faces. These crystal faces are referred to as octahedral or {111} crystal faces. Although the octahedral crystal shape is readily visually identified in regular grains, in grains of more complex shapes the presence of octahedral crystal faces can be verified by a combination of visual inspection and the 109.5° angle of intersection formed by adjacent octahedral crystal faces.

Ignoring possible ion adsorptions, octahedral crystal faces differ from cubic crystal faces in that the surface tier of ions can be theoretically hypothesized to consist entirely of silver ions or halide ions. FIG. 4 is a schematic illustration of a {111} crystal face, analogous to FIG. 2, wherein the smaller spheres 2 represent silver ions while the larger spheres 3 designate bromine ions. Although silver ions are shown at the surface in every available lattice position, it has been suggested that having silver ions in only every other available lattice position in the surface tier of atoms would be more compatible with surface charge neutrality. Instead of a surface tier of silver ions, the surface tier of ions could alternatively be bromide ions. The tier of ions immediately below the surface silver ions consists of bromide ions.

In comparing FIGS. 1 and 2 with FIGS. 3 and 4 it is important to bear in mind that both the cubic and octahedral grains have exactly the same cubic crystal lattice structure and thus exactly the same internal relationship of silver and halide ions. The two grains differ only in their surface crystal faces. Note that in the cubic crystal face of FIG. 2 each surface silver ion lies immediately adjacent five halide ions, whereas in FIG. 4 the silver ions at the octahedral crystal faces each lie immediately adjacent only three halide ions.

Five remaining achievable crystallographic forms for cubic crystal lattice materials are not favored by silver halide. In a few instances silver halide grains having faces of the rhombic dodecahedral form have been observed. Crystal faces of the rhombic dodecahedral form in silver chloride and silver chlorobromide emulsions are reported by Claes et al U.S. Pat. No. 3,817,756. Wyrsch, *Papers from the* 1978 *International Congress of Photographic Science,* Rochester, N.Y., II-13, p. 122, reported rhombic dodecahedral silver chloride emulsions prepared by a triple jet precipitation procedure in the presence of divalent cadmium ions and ammonia. Berry, "Surface Structure and Reactivity of AgBr Dodecahedra", *Photographic Science and Engineering,* Vol. 19, No. 3, May/June 1975, pp. 171 and 172, illustrates silver bromide grains having crystallographic faces of the rhombic dodecahedral crystallographic form.

A regular rhombic dodecahedral grain 7 is shown in FIG. 5. The rhombic dodecahedral grain is bounded by twelve identical crystal faces. These crystal faces are referred to as rhombic dodecahedral or {110} (or, less commonly in reference to silver halide grains, {220}) crystal faces. Although the rhombic dodecahedral crystal shape is readily visually identified in regular grains, in grains of more complex shapes the presence of rhombic dodecahedral crystal faces can be verified by a combination of visual inspection and measurement of the angle of intersection of adjacent rhombic dodecahedral crystal faces.

Rhombic dodecahedral crystal faces can be theoretically hypothesized to consist of alternate rows of silver ions and halide ions. FIG. 6 is a schematic illustration analogous to FIGS. 2 and 4, wherein it can be seen that the surface tier of ions is formed by repeating pairs of silver and bromide ion parallel rows, indicated by lines 8*a* and 8*b*, respectively. In FIG. 6 a portion of the next tier of ions lying below the surface tier is shown to illustrate their relationship to the surface tier of ions. Note that each surface silver ion lies immediately adjacent four halide ions.

There are four additional crystallographic forms which can be exhibited by cubic crystal lattice structures, but which have never been reported previously for silver halide. These are the hexoctahedral, tetrahexahedral, trisoctahedral, and icositetrahedral crystal forms. Silver halide grains having faces of these crystal forms are the subject of concurrently filed, commonly assigned U.S. Ser. Nos. 771,861, 772,228, 772,229, and EMULSIONS WITH NOVEL GRAIN FACES (1), (2), (3), or (4), respectively.

The seven possible crystallographic forms for cubic crystal lattice structure materials are named for the polyhedrons that are produced by a regular crystal structure bounded entirely by faces of a single crystallographic form. For example, regular silver halide grains bounded entirely by crystallographic faces of the cubic form are cubes; bounded entirely by crystallographic faces of the octahedral form are octahedra; etc.

In addition to regular grains of a polyhedral shape produced by being bounded entirely by crystal faces of the same crystallographic form, it is not uncommon to observe regular silver halide grains bounded by both cubic and octahedral crystal faces. Such grains are referred to as being cubo-octahedral. This is illustrated in FIG. 7, wherein cubo-octahedral grains 9 and 10 are shown along with cubic grain 1 and octahedral grain 5. The cubo-octahedral grains have fourteen crystal faces, six cubic crystal faces and eight octahedral crystal faces, and for that reason they are sometimes alternatively referred to as tetradecahedral grains. Analogous combinations of cubic and/or octahedral crystal faces and rhombic dodecahedral crystal faces are possible, a rare example of grains having cubic, octahedral, and rhombic dodecahedral crystal faces being provided by Berry, cited above in connection with rhombic dodecahedral grains.

Further diversity in silver halide grain shape can be attributed to irregularities in the grains, such as twin planes or screw dislocations. Irregular grains of distinctive shapes, often observed in minor proportions, such as tabular silver bromide grains having octahedral crystal faces, have been the subject of many silver halide crystallographic studies. Klein et al, "Formation of Twins of AgBr and AgCl Crystals in Photographic Emulsions", *Photographische Korrespondenz,* Vol. 99, No. 7, pp. 99–102 (1963) describes a variety of singly and doubly twinned silver halide crystals having cubic and octahedral crystal faces. Klein et al is of interest in illustrating the variety of shapes which twinned silver halide grains can assume while still exhibiting only cubic or octahedral crystal faces.

Recently dramatic photographic improvements have been obtained with thin as well as high aspect ratio tabular grain emulsions, as illustrated by Wilgus et al U.S. Pat. No. 4,434,226; Kofron et al U.S. Pat. No. 4,439,520; Daubendiek et al U.S. Pat. No. 4,414,310; Abbott et al U.S. Pat. Nos. 4,425,425 and '426; Wey U.S. Pat. No. 4,399,215; Solberg et al U.S. Pat. No. 4,433,048; Dickerson U.S. Pat. No. 4,414,304; Mignot U.S. Pat. No. 4,386,156, Mignot *Research Disclosure,* Vol. 232, August 1983, Item 23210; Jones et al U.S. Pat. No. 4,478,929; Maskasky U.S. Pat. No. 4,400,463; and Wey et al U.S. Pat. No. 4,414,306. *Research Disclosure* is published by Kenneth Mason Publications, Ltd., Emsworth, Hampshire P010 7DD, England. While thin and high aspect ratio tabular grain emulsions exhibit high surface area ratios, their major faces are of the same cubic or octahedral crystallographic forms exhibited by silver halide grains of other shapes.

There has been some investigation of silver halide grains of composite shapes produced by depositing silver halide either of the same or a different composition onto a host silver halide grain.

Core-shell silver halide emulsions constitute the most common examples of silver halide grains of a composite structure. Core-shell emulsions are illustrated by Porter et al U.S. Pat. Nos. 3,206,313 and 3,317,322, Berriman U.S. Pat. No. 3,367,778, and Evans U.S. Pat. No. 3,761,276, and, in tabular form, by Evans et al U.S. Pat. No. 4,504,570.

Turning to composite silver halide grains in which the additionally deposited silver halide does not form a shell around the host silver halide grains, Koitabashi et al U.S. Pat. No. 4,349,622 discloses epitaxially depositing on silver halide grains containing from 15 to 40 mole percent iodide silver halide which contains less than 10 mole percent iodide.

Hammerstein et al U.S. Pat. No. 3,804,629 discloses that the stability of silver halide emulsion layers against the deleterious effect of dust, particularly metal dust, is improved by adding to physically ripened and washed emulsion before chemical ripening a silver chloride emulsion or by precipitating silver chloride onto the physically ripened and washed silver halide emulsion. Hammerstein et al discloses that silver chloride so deposited will form hillocks on previously formed silver bromide grains.

Berry and Skillman, "Surface Structures and Epitaxial Growth on AgBr Microcrystals", *Journal of Applied Physics,* Vol. 35, No. 7, July 1964, pp. 2165–2169, discloses the growth of silver chloride on silver bromide. Octahedra of silver bromide form growths all over their surface and are more reactive than cubes. Cubes react primarily at the corners and along the edges. Twinned tabular crystals form growths randomly distributed over their major crystal faces, with some preference for growths near their edges being observed. In addition, linear arrangements of growths can be produced after the emulsion coatings have been bent, indicating the influence of slip bands.

Maskasky U.S. Pat. No. 4,435,501 teaches high aspect ratio tabular grain emulsions having one or more silver salts deposited at selected surface sites. Maskasky U.S. Pat. No. 4,463,087 is essentially cumulative, but additionally discloses deposition at the edges and corners of nontabular silver halide host grains. Each patent teaches the use of adsorbed site directors to locate silver salts at selected sites on the host grains.

A. P. H. Trivelli and S. E. Sheppard, *The Silver Bromide Grain of Photographic Emulsions,* Van Nostrand, Chapters VI and VIII, 1921, is cited for historical interest. Magnifications of 2500X and lower temper the value of these observations. Much higher resolutions of grain features are obtainable with modern electron microscopy.

W. Reinders, "Studies of Photohalide Crystals", Kolloid-Zeitschrift, Vol. 9, pp. 10–14 (1911); W. Reinders, "Study of Photohalides III Absorption of Dyes, Proteins and Other Organic Compounds in Crystalline Silver Chloride", *Zeitschrift fur Physikalische Chemie,* Vol. 77, pp. 677–699 (1911); Hirata et al, "Crystal Habit of Photographic Emulsion Grains", *J. Photog. Soc. of Japan,* Vol. 36, pp. 359–363 (1973); Locker U.S. Pat. No. 4,183,756; and Locker et al U.S. Pat. No. 4,225,666 illustrate teachings of modifying silver halide grain shapes through the presence of various materials present during silver halide grain formation.

Wulff et al U.S. Pat. No. 1,696,830 and Heki et al Japanese Kokai No. 58[1983]-54333 describe the precipitation of silver halide in the presence of benzimidazole compounds.

Halwig U.S. Pat. No. 3,519,426 and Oppenheimer et al, "Role of Cationic Surfactants in Recrystallization of Aqueous Silver Bromide Dispersions", Smith *Particle Growth and Suspension,* Academic Press, London, 1973, pp. 159–178, disclose additions of 4-hydroxy-6-methyl-1,3,3a,7-tetraazaindene to silver chloride and silver bromide emulsions, respectively.

F. C. Phillips, *An Introduction to Crystallography,* 4th Ed., John Wiley & Sons, 1971, is relied upon as authority for the basic precepts and terminology of crystallography herein presented.

SUMMARY OF THE INVENTION

In one aspect this invention is directed to a radiation sensitive emulsion comprised of silver halide grains of a cubic crystal lattice structure having faces ruffled by protrusions which are silver halide crystal lattice extensions from a base plane of a first crystallographic form. Silver halide adjacent the base plane, that is, beneath the base plane and in the protrusions, favor the formation of surfaces of the first crystallographic form, and the protrusions present surfaces of a second crystallographic form.

In another aspect this invention is directed to a photographic element containing at least one emulsion of the type previously described.

The invention makes available to the art silver halide grains presenting surfaces that are increased in area and which are of a crystallographic form differing from that favored by the silver halide forming the grain surfaces. Each of these surface features offers its distinct advantages.

First, a high grain surface area ratio is realized. Whereas the art has resorted to making grains finer in order to increase their surface area ratio, this invention allows the grain surface area ratio to be increased independently of grain size. Further, the surface area ratio can be increased independently of overall grain shape. Specifically, an increase in grain surface area ratio by ruffled major crystal faces as contemplated by this invention is equally applicable to otherwise regular or irregular cubic or octahedral grains.

Still further, the novel ruffling approach of this invention and other known approaches for increasing grain surface area ratios, specifically reducing grain size or providing irregular grain shapes, are compatible and can be used in combination to produce additive increases in grain surface area ratios.

Thin or high aspect ratio tabular grain emulsions can be increased in their grain surface area ratios by providing ruffled major grain faces as contemplated by this invention. This results in emulsions of higher grain surface area ratios than have heretofore been realized for corresponding grain sizes.

At the same time, the invention permits increased grain surface area ratios without resorting to a tabular grain shape. The invention offers particular advantages when applied to regular and other non-tabular grain shapes.

The second distinctive silver halide grain surface feature of the invention is that the ruffled grain faces render accessible varied and new choices of crystallographic forms at grain faces for modifying photographic characteristics. As an example, whereas silver chloride strongly favors the cubic crystal form, this invention permits silver chloride grain faces to be achieved of other crystallographic forms compatible with a cubic crystal lattice structure. As a second example, whereas thin and high aspect ratio tabular grain emulsions are most easily generated with octahedral crystal faces, this invention allows tabular grain faces to be realized of other crystallographic forms compatible with a cubic crystal lattice structure.

The invention offers the advantage of allowing both high grain surface area ratios and grain faces of differing crystallographic forms to be concurrently realized. This combination permits emulsions of unique and diverse photographic properties to be realized.

These and other features and advantages of the invention can be better appreciated by consideration of the description of the preferred embodiments and the drawings.

DESCRIPTION OF PREFERRED EMBODIMENTS

Figure 1:
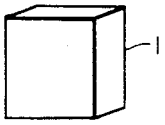
FIG. 1 is an isometric view of a regular cubic silver halide grain.

The present invention relates to silver halide photographic emulsions comprised of radiation sensitive silver grains of a cubic crystal lattice structure having ruffled faces and to photographic elements including these emulsions.

By reason of being ruffled these grain faces present a larger surface area than a corresponding planar grain face. Considering a regular polyhedron bounded by planar faces, such as the cube 1 in FIG. 1 or the octahedron 5 in FIG. 3, it is apparent that the planar faces each present the minimum surface area consistent with the size of the polyhedron.

It has been discovered quite unexpectedly that the grain surface area ratio of silver halide grains of a cubic crystal lattice structure can be greatly increased without significantly altering the overall shape or size of the grains. This is achieved merely by ruffling the surfaces presented by the grains. The degree to which the grain surface area ratio is increased is a matter of choice that can be varied from slight increases to increases that more than double the grain surface area ratio. The grain faces employed in the practice of this invention are preferably ruffled to an extent sufficient to provide a 50 percent increase in the grains surface area ratio. This is well above the incidental increases in grain surface area heretofore realized by random non-uniformities of crystal faces and unsought increases in grain surface area ratios realized by producing composite silver halide grains. The silver halide emulsions of this invention most preferably exhibit ruffled grain faces which increase grain surface area ratios by at least 100 percent and optimally at least 200 percent as compared to grains of like size and shape, but lacking ruffled faces.

The silver halide grains having ruffled faces are formed starting with any conventional emulsion containing silver halide grains of a cubic crystal lattice structure presenting faces of a crystallographic form favored by the silver halide. For silver halide grains which are predominantly silver chloride (greater than 50 mole percent chloride, based on silver) and especially grains which are at least 90 mole percent chloride the favored crystallographic form is cubic, and the grain faces to be ruffled are therefore cubic (i.e., {100}) crystal faces. For other silver halides, silver bromide, silver bromoiodide, silver chlorobromide, and silver chlorobromoiodides, the favored crystallographic form and therefore the grain faces can be either cubic or, when formed in the presence of an excess of bromide ions, octahedral (i.e., {111}).

The grain faces of the favored crystallographic form for the silver halide employed present planar surfaces and serve as deposition sites for additional silver halide forming the ruffles. It is therefore apparent that the planar surfaces of the crystallographic form favored by the silver halide of the host grains form a base plane for the ruffles. The ruffles take the form of protrusions from the base plane which are extensions of the silver halide cubic crystal lattice structure of the underlying host grain. The silver halide within the ruffles adjacent the base plane is of a composition that favors the same crystallographic form as the silver halide of the host grains forming the base plane.

The silver halide adjacent the base plane in the host grain and in the protrusions can be identical in composition or different, the choice of silver halide in each location being circumscribed only by the requirement of forming a cubic crystal lattice structure and the requirement that silver halide in each location favor a common crystallographic form corresponding to that of the base plane. Thus, the protrusions adjacent the base plane can be formed, for example, of silver halide which is predominantly silver chloride, as defined above, deposited on a predominantly silver chloride base plane; silver bromide deposited on a silver bromide or bromoiodide base plane; silver bromoiodide deposited on a silver bromide or bromoiodide base plane; or silver chlorobromide optionally containing iodide deposited on a silver chlorobromide base plane optionally also containing iodide. Predominantly silver chloride can be deposited on a {100} silver bromide or bromoiodide base plane. However, protrusions which are predominantly silver chloride deposited on a {111} silver bromide or bromoiodide base plane have no applicability to this invention for reasons presented below. The portion of the protrusions which does not lie adjacent the base plane—e.g., the surfaces of the protrusions can be of any known photographically useful silver halide composition independently of the silver halide composition of the host grain adjacent the base plane, since once the protrusions are formed their surface modification in any desired manner is a matter of choice.

The protrusions have been observed to take in most instances the form of pyramids and, occasionally, the form of ridges. For convenience the discussion which follows is directed specifically to the protrusions in their pyramidal form, but extension to protrusions in the form of ridges is apparent. Aside from incidental rounding that can occur at edges and corners of silver halide grains, each protrusion is a pyramid having its base in common with the base plane presented by the underlying host grain.

Each pyramid presents a number of surface faces (all faces other than the base) which are of a crystallographic form differing from that of the base plane. The number of surface faces that a pyramid presents is determined by the crystallographic form of the base plane and the crystallographic form of the pyramidal surface faces. The combinations are set forth below in Table I.

TABLE I

| | Pyramidal Surface Faces | |
|---|---|---|
| | Favored Host Grain Faces | |
| Pyramidal Faces | {100} | {111} |
| {100} | — | 3 |
| {111} | 4 | — |
| {110} | 4 | 3 |
| {hhl} | 8 | 3 |
| {hk0} | 4 | 6 |
| {hll} | 4 | 3 |
| {hkl} | 8 | 6 |

Figure 8:
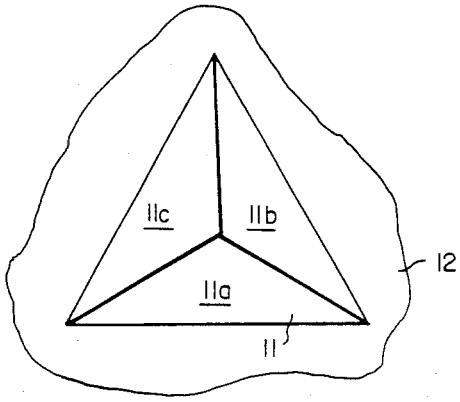
FIGS. 8 and 9 are plan views of pyramidal protrusions from a base plane.

Looking at FIG. 1 it can be seen that corners of the cube 1 are each formed by three {100} crystal faces. The pyramids of {100} crystal faces formed on a {111} base plane are similar in shape to the corners of the cube. This is schematically shown in FIG. 8, which is a plan view of a pyramid 11 having three {100} crystal faces 11*a*, 11*b*, and 11*c* on a {111} base plane 12.

Figure 3:
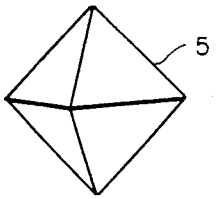
FIG. 3 is an isometric view of a regular octahedral silver halide grain.
Figure 9:
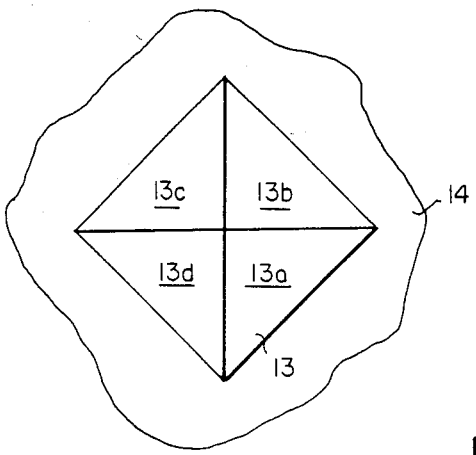

Similarly, looking at FIG. 3 it can be seen that corners of the octahedron 5 are each formed by four {111} crystal faces. The pyramids of {111} crystal faces formed on a {100} base plane are similar in shape to the corners of the octahedron. This is schematically shown in FIG. 9, which is a plan view of a pyramid 13 having four {111} crystal faces 13*a*, 13*b*, 13*c*, and 13*d* on a {100} base plane 14.

Figure 5:
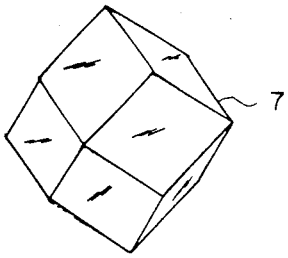
FIG. 5 is an isometric view of a regular rhombic dodecahedron.

Turning to pyramids with rhombic dodecahedral faces, it can been seen in FIG. 5 that the regular rhombic dodecahedron 7 has eight corners each formed by the intersection of three crystal faces and six corners formed by the intersection of four crystal faces. When a pyramid presenting rhombic dodecahedral or {110} crystal faces is located on a {100} base plane, it presents four surface faces, thus appearing in plan similarly as shown in FIG. 9; but when a {111} base plane is presented, a pyramid with {110} crystal faces presents three surface faces, thus appearing in plan similarly as shown in FIG. 8.

It should be pointed out that although three surface face pyramids formed by {100} crystal faces on a {111} base plane and three surface face pyramids formed by {110} crystal faces on a {111} base plane appear similar in plan view, they are distinguishable. Similarly four surface face pyramids formed by {111} crystal faces on a {100} base plane and four surface face pyramids formed by {110} crystal faces on a {100} base plane are distinguishable. One way of identifying the crystallographic form of the surface faces of the pyramids is to measure the angle of intersection of a surface face with the base plane of the host grain. Another basis for distinguishing the crystal faces of the pyramids is by noting the angles of intersections of the pyramid surface faces. A comparison of either of these measured angles of intersection with the theoretically possible intersection angles and a further knowledge of the crystallographic form of the base planes presented by the host grains and the number of surface faces presented by the pyramids, allows positive identification of the crystallographic form of the pyramidal surface faces.

In crystallography measurement of relative angles of adjacent crystal faces is employed for crystal face identification. Such techniques are described, for example, by Phillips, cited above. These techniques can be combined with techniques for the microscopic examination of silver halide grains to identify positively either or both pyramidal and host grain base plane crystal faces. Techniques for preparing electron, micrographs of silver halide grains are generally well known in the art, as illustrated by B. M. Spinell and C. F. Oster, "Photographic Materials", *The Encyclopedia of Microscopy and Microtechnique*, P. Gray, ed., Van Nostrand, N.Y., 1973, pp. 427–434, note particularly the section dealing with carbon replica electron microscopy at pages 429 and 430. Employing techniques well known in electron microscopy, carbon replicas of silver halide grains are first prepared. The carbon replicas reproduce the grain shape while avoiding shape altering silver print-out that is known to result from employing the silver halide grains without carbon shells. Electrons rather than light are employed for imaging to permit higher ranges of magnification to be realized than when light is employed. By tilting the sample being viewed relative to the electron beam a selected grain can be oriented so that the line of sight is substantially parallel to both of two adjacent crystal faces, seen as edges. When the grain faces are parallel to the imaging electron beam, the two corresponding edges of the grain which they define will appear sharper than when the faces are merely close to being parallel. Once the desired grain orientation with two intersecting crystal faces each presenting a parallel edge to the electron beam is obtained, the angle of intersection can be measured from an electron micrograph of the oriented grain. In this way the relative angle presented by any two intersecting crystal faces can be measured. By narrowing the range of possibilities through visual clues, such as host grain shape, angles of intersection for possible crystal forms can be calculated and compared to measured intersection angle values. In many, if not most, instances visual inspection of host grains by electron microscopy allows positive identification of the base planes so that further investigation can be limited to the pyramidal surface faces.

Referring to the mutually perpendicular x, y, and z axes of a cubic crystal lattice, it is well recognized in the art that cubic crystal faces are parallel to two of the axes and intersect the third, thus the {100} Miller index assignment; octahedral crystal faces intersect each of the three axes at an equal interval, thus the {111} Miller index assignment; and rhombic dodecahedral crystal faces intersect two of the three axes at an equal interval and are parallel to the third axis, thus the {110} Miller index assignment. For a given definition of the basic crystal unit, there is one and only one Miller index assignment for each of cubic, octahedral, and rhombic dodecahedral crystal faces.

Trisoctahedral, tetrahexahedral, icositetrahedral, and hexoctahedral crystal faces can have differing Miller index values and are therefore identified in Table I generically as {hhl}, {hkO}, {hll}, and {hkl} crystal faces, respectively, where h, k, and l are independently in each occurrence unlike integers greater than zero, h is greater than l, and k, when present, is less than h and greater than l. Although there is no theoretical limit on the maximum values of the integer h, crystal faces having a value of h of 5 or less are more easily generated. Subsequent discussion is for convenience directed to faces in which h is 5 or less. Relationships for faces in which h is greater than 5 are entirely analogous.

Figure 10:
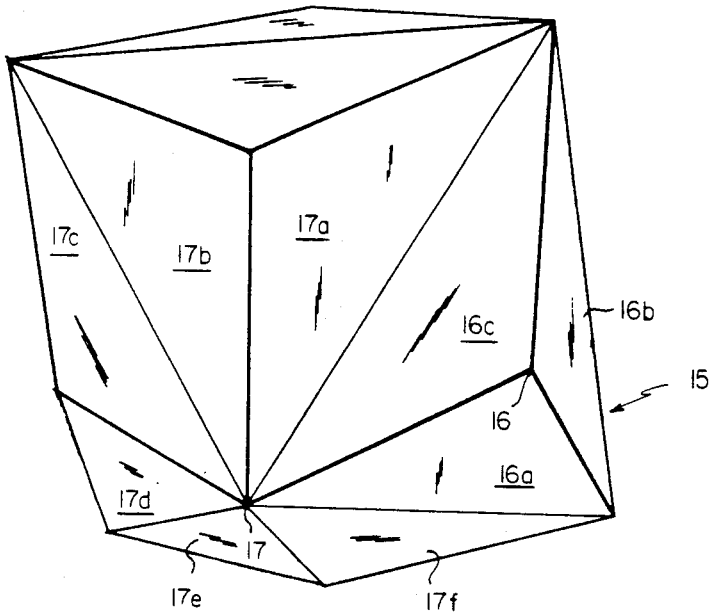
FIG. 10 is an isometric view of a regular {331} trisoctahedral silver halide grain.

Considering values of h up to 5, trisoctahedral crystal faces can have any one of the following Miller indices: {221}, {331}, {441}, {551}, {332}, {552}, {443}, {553}, or {554}. FIG. 10 is an isometric view of a trisoctahedron 15 bounded by faces of the {331} crystallographic form. The point or coign 16 is formed by three intersecting crystal faces 16*a*, 16*b*, and 16*c* and is one of eight identical coigns. The point or coign 17 is formed by eight intersecting crystal faces 16*a*, 16*c*, 17*a*, 17*b*, 17*c*, 17*d*, 17*e*, and 17*f* and is one of six identical coigns. Referring to Table I, it is apparent that a pyramid having eight surface faces such as those defining coign 17 is present when the surface faces of the pyramid are trisoctahedral or {hhl} crystal faces on a cubic or {100} base plane presented by the host grain. If, on the other hand, the host grain presents an octahedral or {111} base plane, a pyramid having three surface faces such as those defining coign 16 is present when the surface faces of the pyramid are trisoctahedral. For trisoctahedral crystal faces of differing Miller indices the geometrical relationships are the same, but the angles of surface face intersections, with each other and with the base plane, differ.

Figure 2:
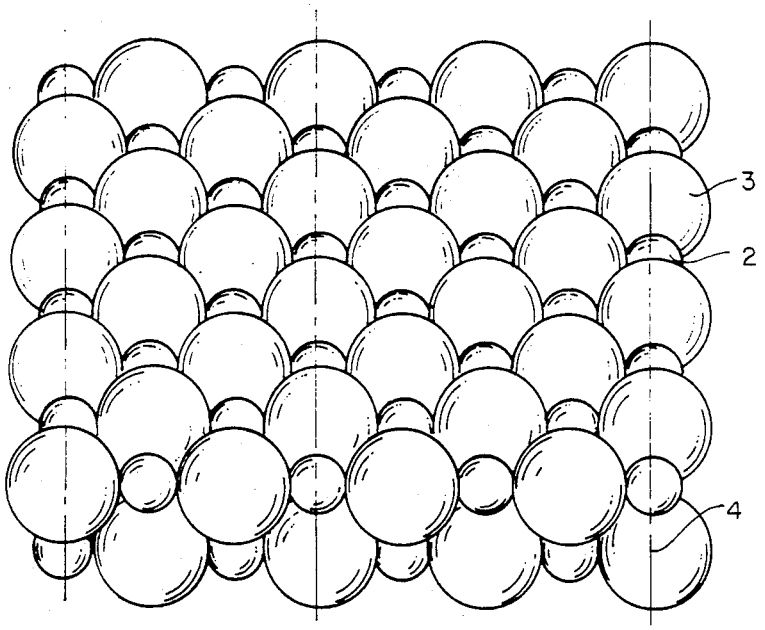
FIG. 2 is a schematic diagram of the atomic arrangement at a silver bromide cubic crystal face.
Figure 4:
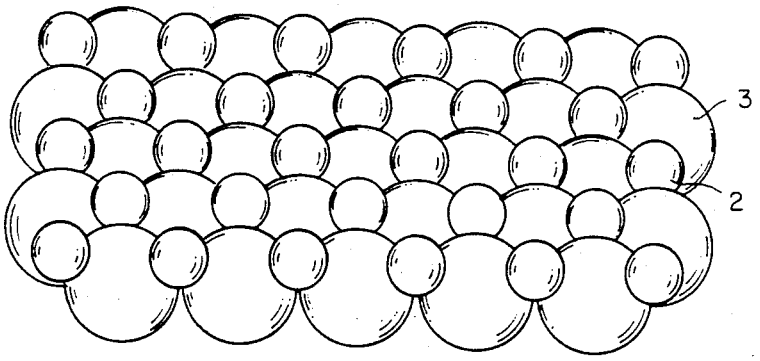
FIG. 4 is a schematic diagram of the atomic arrangement at a silver bromide octahedral crystal face.
Figure 6:
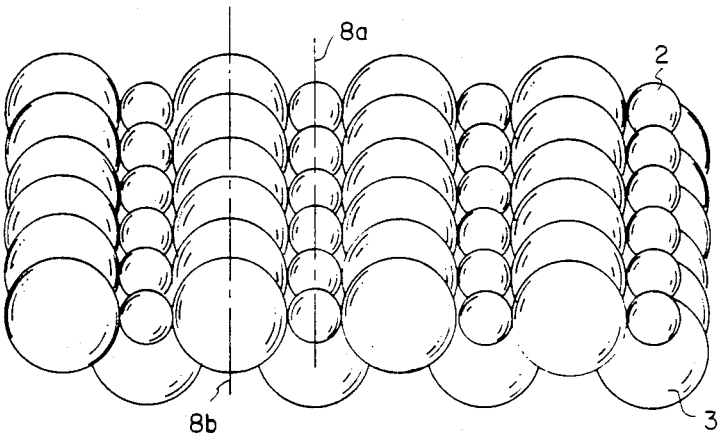
FIG. 6 is a schematic diagram of the atomic arrangement at a silver bromide rhombic dodecahedral crystal face.
Figure 11:
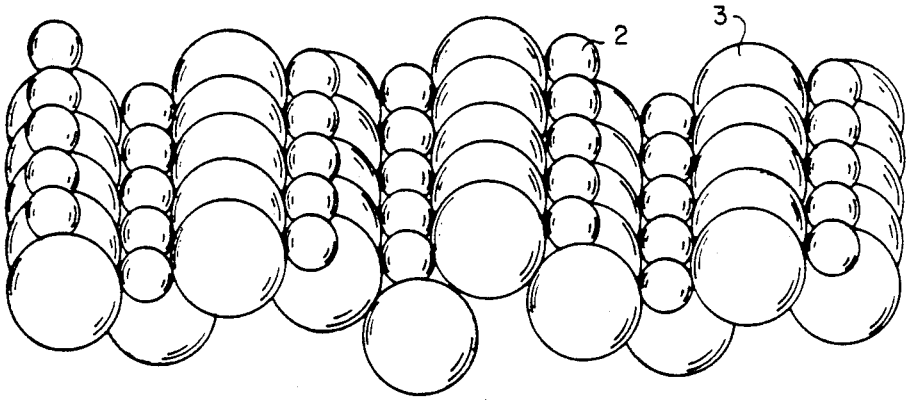
FIG. 11 is a schematic diagram of the atomic arrangement at a {331} silver bromide trisoctahedral crystal face.

The {331} trisoctahedral crystal faces present a unique arrangement of surface silver and halide ions that differs from that presented by all other possible crystal faces for cubic crystal lattice structure silver halides. This unique surface arrangement of ions as theoretically hypothesized is schematically illustrated by FIG. 11, wherein a {331} trisoctahedral crystal face is shown formed by silver ions 2 and bromide ions 3. Comparing FIG. 11 with FIGS. 2, 4, and 6, it is apparent that the surface positioning of silver and bromide ions in each figure is distinctive. The {133} trisoctahedral crystal face presents an ordered, but more varied arrangement of surface silver and bromide ions than is presented at the cubic, octahedral, or rhombic dodecahedral silver bromide crystal faces. This is a result of the tiering that occurs at the {331} trisoctahedral crystal face. Trisoctahedral crystal faces with differing Miller indices also exhibit tiering. The differing Miller indices result in analogous, but nevertheless unique surface arrangements of silver and halide ions.

Figure 12:
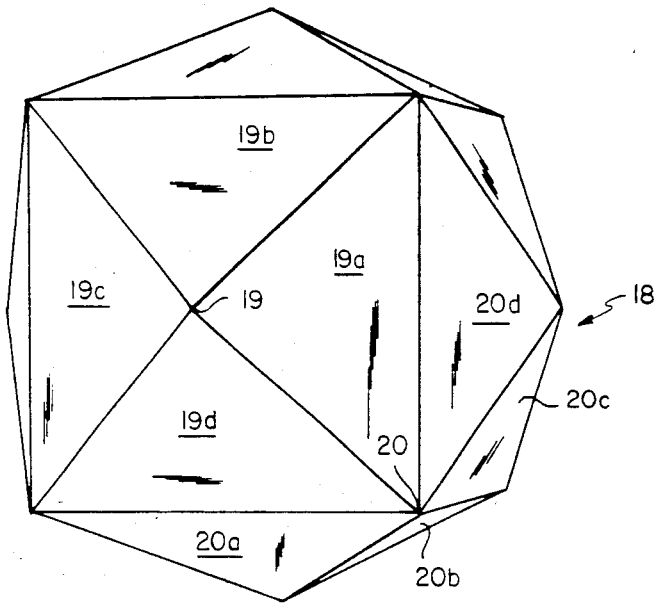
FIG. 12 is an isometric view of a regular {210} tetrahexahedral silver halide grain.

Considering values of h up to 5, tetrahexahedral crystal faces can have any one of the following Miller indices: {210}, {310}, {320}, {410}, {430}, {510}, {520}, {530}, or {540}. FIG. 12 is an isometric view of a tetrahexahedron 15 bounded by faces of the {210} crystallographic form. The point or coign 19 is formed by four intersecting crystal faces 19*a*, 19*b*, 19*c*, and 19*d* and is one of six identical coigns. The coign 20 is formed by six intersecting crystal faces 19*a*, 19*e*, 20*a*, 20*b*, 20*c*, and 20*d* and is one of eight identical coigns. Referring to Table I, it is apparent that a pyramid having four surface faces such as those defining coign 19 is present when the surface faces of the pyramid are tetrahexahedral or {hk0} crystal faces on a cubic or {100} base plane presented by the host grain. If, on the other hand, the host grain presents an octahedral or {111} base plane, a pyramid having six surface faces such as those defining coign 20 is present when the surface faces of the pyramid are tetrahexahedral. For tetrahexahedral crystal faces of differing Miller indices the geometrical relationships are the same, but the angles of surface face intersections, with each other and with the base plane, differ.

Figure 13:
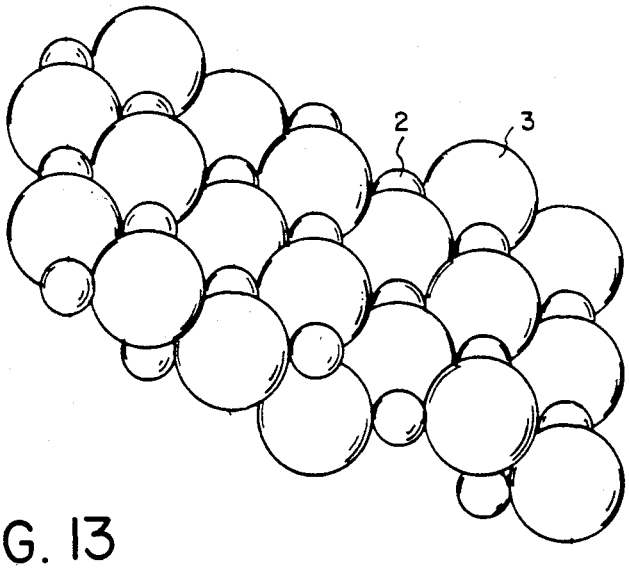
FIG. 13 is a schematic diagram of the atomic arrangement at a silver bromide {210} tetrahexahedral crystal face.

The {210} tetrahexahedral crystal faces present a unique arrangement of surface silver and halide ions that differs from that presented by all other possible crystal faces for cubic crystal lattice structure silver halides. This unique surface arrangement of ions as theoretically hypothesized is schematically illustrated by FIG. 13, wherein a {210} tetrahexahedral crystal face is shown formed by silver ions 2 and bromide ions 3. Comparing FIG. 13 with FIGS. 2, 4, 6, and 11, it is apparent that the surface positioning of silver and bromide ions in each figure is distinctive. The {210} tetrahexahedral crystal face presents an ordered, but more varied arrangement of surface silver and bromide ions than is presented at the cubic, octahedral, or rhombic dodecahedral silver bromide crystal faces. This is a result of the tiering that occurs at the {210} tetrahexahedral crystal face. Tetrahexahedral crystal faces with differing Miller indices also exhibit tiering. The differing Miller indices result in analogous, but nevertheless unique surface arrangements of silver and halide ions.

Figure 14:
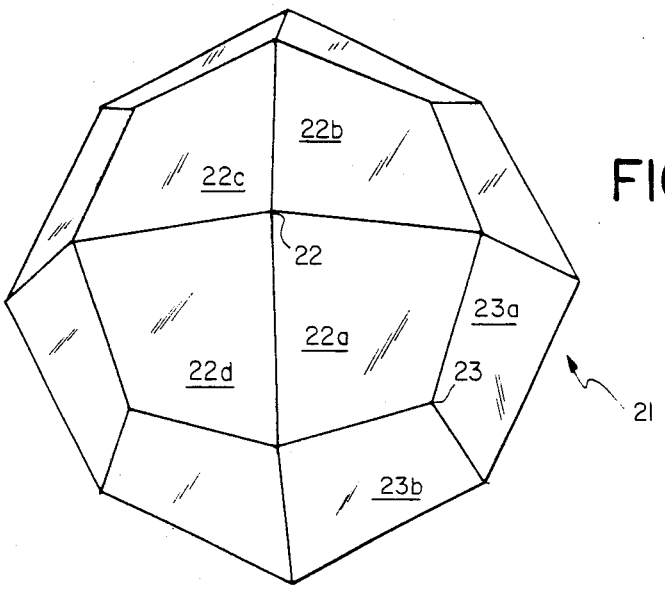
FIG. 14 is an isometric view of a regular {211} icositetrahedral silver halide grain.

Considering values of h up to 5, icositetrahedral crystal faces can have any one of the following Miller indices: {211}, {311}, {322}, {411}, {433}, {511}, {522}, {533}, or {544}. FIG. 14 is an isometric view of a icositetrahedron 21 bounded by faces of the {211} crystallographic form. The point or coign 22 is formed by four intersecting crystal faces 22*a*, 22*b*, 22*c*, and 22*d* and is one of six identical coigns. The coign 23 is formed by three intersecting crystal faces 22*a*, 23*a*, and 23*b* and is one of eight identical coigns. Referring to Table I, it is apparent that a pyramid having four surface faces such as those defining coign 22 is present when the surface faces of the pyramid are icositetrahedral or {hk0} crystal faces on a cubic or {100} base plane presented by the host grain. If, on the other hand, the host grain presents an octahedral or {111} base plane, a pyramid having three surface faces such as those defining coign 23 is present when the surface faces of the pyramid are icositetrahedral. For icositetrahedral crystal faces of differing Miller indices the geometrical relationships are the same, but the angles of surface face intersections, with each other and with the base plane, differ.

Figure 15:
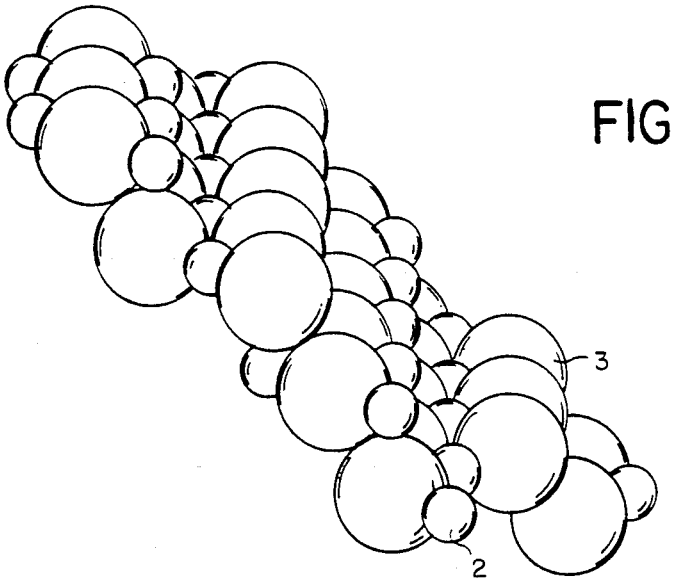
FIG. 15 is a schematic diagram of the atomic arrangement at a silver bromide {211} icositetrahedral crystal face.

The {211} icositetrahedral crystal faces present a unique arrangement of surface silver and halide ions that differs from that presented by all other possible crystal faces for cubic crystal lattice structure silver halides. This unique surface arrangement of ions as theoretically hypothesized is schematically illustrated by FIG. 15, wherein a {211} icositetrahedral crystal face is shown formed by silver ions 2 and bromide ions 3. Comparing FIG. 15 with FIGS. 2, 4, 6, 11, and 13, it is apparent that the surface positioning of silver and bromide ions in each figure is distinctive. The {211} icositetrahedral crystal face presents an ordered, but more varied arrangement of surface silver and bromide ions than is presented at the cubic, octahedral, or rhombic dodecahedral silver bromide crystal faces. This is a result of the tiering that occurs at the {211} icositetrahedral crystal face. Icositetrahedral crystal faces with differing Miller indices also exhibit tiering. The differing Miller indices result in analogous, but nevertheless unique surface arrangements of silver and halide ions.

Figure 16:
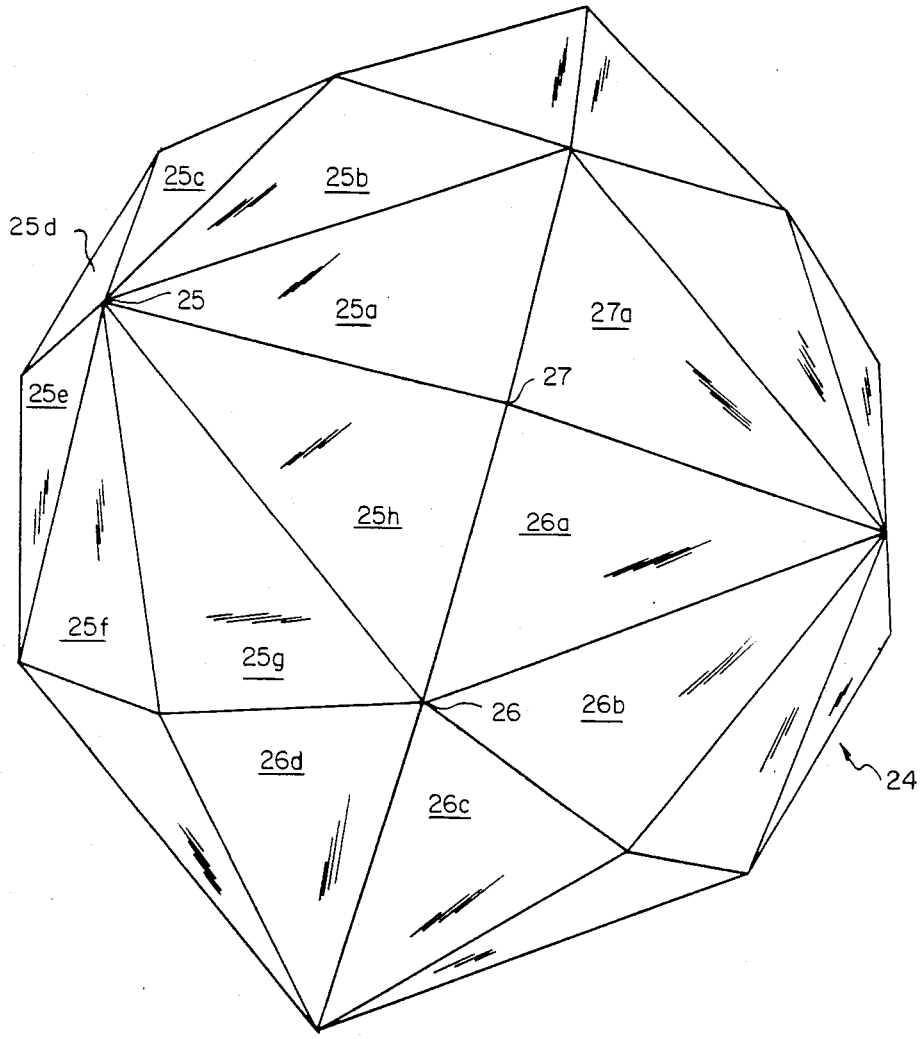
FIG. 16 is an isometric view of a regular {321} hexoctahedral silver halide grain.

Considering values of h up to 5, hexoctahedral crystal faces can have any one of the following Miller indices: {321}, {421}, {431}, {432}, {521}, {531}, {532}, {541}, {542}, or {543}. FIG. 16 is an isometric view of a hexoctahedron 24 bounded by faces of the {321} crystallographic form. The coign 25 is formed by eight intersecting crystal faces 25*a*, 25*b*, 25*c*, 25*d*, 25*e*, 25*f*, 25*g*, and 25*h* and is one of six identical coigns. The point or coign 26 is formed by six intersecting crystal faces 25*g*, 25*h*, 26*a*, 26*b*, 26*c*, and 26*d* and is one of six identical coigns. The coign 27 is formed by four intersecting crystal faces 25*a*, 25*h*, 26*a*, and 27*a*. Referring to Table I it is apparent that a pyramid having eight surface faces such as those defining coign 25 is present when the surface faces of the pyramid are hexoctahedral or {hkl} crystal faces on a cubic or {100} base plane presented by the host grain. If, on the other hand, the host grain presents an octahedral or {111} base plane, a pyramid having six surface faces such as those defining coign 26 is present when the surface faces of the pyramid are hexoctahedral. Although excluded from the present invention because of their rarity and therefore lack of practical importance, if the base plane were of a rhombic dodecahedral or {110} crystallographic form, the pyramids thereon would have surface faces corresponding to those forming coign 27. For hexoctahedral crystal faces of differing Miller indices the geometrical relationships are the same, but the angles of surface face intersections, with each other and with the base plane, differ.

Figure 17:
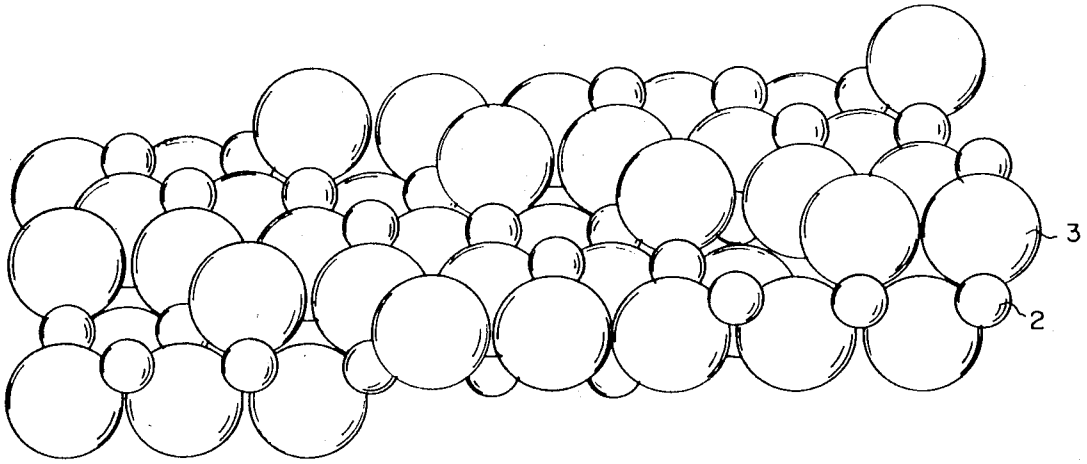
FIG. 17 is a schematic diagram of the atomic arrangement at a silver bromide {321} hexoctahedral crystal face.

The {321} hexoctahedral crystal faces present a unique arrangement of surface silver and halide ions that differs from that presented by all other possible crystal faces for cubic crystal lattice structure silver halides. This unique surface arrangement of ions as theoretically hypothesized is schematically illustrated by FIG. 17, wherein a {321} hexoctahedral crystal face is shown formed by silver ions 2 and bromide ions 3. Comparing FIG. 17 with FIGS. 2, 4, 6, 11, 13, and 15, it is apparent that the surface positioning of silver and bromide ions in each figure is distinctive. The {321} hexoctahedral crystal face presents an ordered, but more varied arrangement of surface silver and bromide ions than is presented at the cubic, octahedral, or rhombic dodecahedral silver bromide crystal faces. This is a result of the oblique tiering that occurs at the {321} hexoctahedral crystal face. Icositetrahedral crystal faces with differing Miller indices also exhibit oblique tiering. The differing Miller indices result in analogous, but nevertheless unique surface arrangements of silver and halide ions.

An interesting point to note is that it is the collective base areas occupied rather than the size or number of pyramids of any particular form that controls the surface area they present. The reason for this is that surface face area is in a fixed ratio to the base area for all pyramids of the same form. For example, a population of a hundred pyramids of a given form and a second population of a thousand smaller pyramids of the same form exhibit the same ratio of collective base area to collective surface area—i.e., if the collective base areas for the two pyramid populations are equal, their collective surface areas are also equal. Hence, the degree to which ruffling can increase the surface area of the host grains is a function of the pyramidal coverage of the base planes and the form of the pyramids as opposed to their size or number. Thus, the invention is not restricted to ruffled grains having any particular size or number of pyramids.

Having made this observation, however, it is also pointed out that the surface area ratio (as opposed to the surface area) presented by ruffled silver halide grains is directly influenced by the size of the pyramids. A hundred pyramids providing the same surface area as a thousand smaller pyramids of the same form nevertheless have a much larger collective volume and therefore require more silver halide to form. This is one reason to favor smaller pyramids over larger pyramids. It is accordingly preferred to employ pyramids having average base areas less than $10^{-2}$ and most preferably less than $10^{-3}$ times the average areas of the base planes on which they are located.

When it is desired to maximize the surface area ratio provided by the pyramids, it is, of course, obvious to select pyramids which themselves exhibit a maximum surface area ratio, although the amount of silver halide contained in relatively small pyramids is virtually negligible. A second factor to consider is whether the pyramidal base defines a polygonal figure that can be close packed. All pyramids of the same form on a given base plane are identically oriented. Looking at FIG. 9 it can be seen that the base plane 14 can in theory be entirely covered with pyramids of the form of pyramid 13, whether or not the pyramids are of the same or different sizes. On the other hand, given the restraint that all pyramids of like form on the same base plane must be identically oriented, it is clear from FIG. 8 that the base plane 12 cannot be entirely covered by pyramids identical in form to pyramid 11, although the vacancies between adjacent pyramids can be reduced where pyramids of different sizes are present.

The presence of ruffles formed by pyramidal crystal faces differing in their crystallographic form from that of the base planes presented by the host grains has been confirmed by observations and measurements, as described in the Examples below. Since the base plane represents the favored crystallographic form for the silver halide being deposited thereon, the formation of crystal faces of a differing crystallographic form is a departure from what normally would be obtained. In addition, the formation of pyramidal crystal faces is highly unexpected, and, beyond this, obtaining pyramidal crystal faces of crystallographic forms which have rarely or never before been observed for silver halide is an exceptional departure from the past knowledge of the art.

While it is not intended to limit the invention by any particular theory, a discussion of possible mechanisms for crystal face formation is offered. Considering an emulsion containing host grains bounded by faces of a favored crystallographic form for the silver halide adjacent the grain surface, depositing additional silver halide which favors the same crystallographic form results in substantially uniform shelling of the grains with the resulting shelled grain, though larger in size, still exhibiting crystal faces of the same crystallographic form as the host grains.

Figure 7:
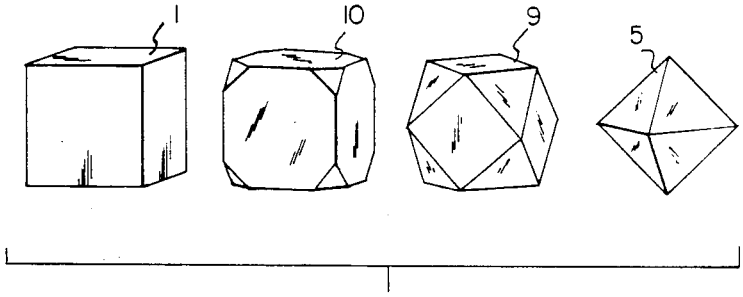
FIG. 7 is an isometric view of a regular cubic silver halide grain, a regular octahedral silver halide grain, and intermediate cubo-octahedral silver halide grains.

Turning to FIG. 7, it is known in emulsion precipitation that grains of octahedral crystal faces can be changed in shape to cubic crystal faces and vice versa by changing precipitation conditions as the grains are being grown. Thus, the octahedral grain 5 bounded by {111} crystal faces can be grown to form successively the tetradecahedron 9, the tetradecahedron 10, and the cube 1 merely by changing the precipitation conditions to favor the formation of {100} crystal faces. (In practice the cube and tetradecahedra are usually somewhat larger in relation to the octahedron than shown.) By comparing tetradecahedra 9 and 10 it can be readily appreciated that the cubic crystal faces are becoming larger because silver halide is more rapidly depositing on what remains of the octahedral crystal faces. From this the observation follows that the major crystal faces of silver halide grains are those of a crystallographic form onto which silver and halide ions precipitate most slowly. Once only faces of this less reactive crystallographic form remain, in the instance above the {100} faces of cubic grain 1, silver and halide ions deposit isotropically on these surfaces.

The successful formation of crystal faces of a differing crystallographic form from that favored by the silver halide being deposited depends on identifying grain growth conditions that retard the rate of silver and halide ion deposition onto faces of the desired differing crystallographic form. Many examples can be found in the art of growing host grains presenting cubic or octahedral faces to form grains in which some or all of the faces are of the other crystallographic form—i.e., octahedral or cubic. Although rhombic dodecahedral silver halide grains are rare, similar growth conversions in grain shape are equally applicable to this crystallographic form.

In the concurrently filed, commonly assigned patent applications cited above, procedures are disclosed for growing either cubic or octahedral host grains under conditions that result in the formation of trisoctahedral, tetrahexahedral, iscositetrahedral, or hexoctahedral grains. By observing samples taken at intermediate stages of grain growth it has been confirmed that growth patterns analogous to the conversion of an octahedral grain to a cubic grain, described above by reference to FIG. 7, can and do occur.

Surprisingly, however, there is another growth pattern possible, and it is this latter growth pattern that gives rise to the present invention. Referring again to FIG. 7, it can be seen that in growing the octahedral grain 5 to form the cubic grain 1, the {100} crystal faces originate at the coigns of the octahedron and increase progressively in area until the cubic form is complete. Comparing FIG. 7 with FIGS. 8 and 9, it is immediately apparent that formation of pyramidal surfaces does not occur selectively at the coigns or even edges of the host grains, but occurs on the faces of the grains.

Berry and Skillman, discussed above, grew silver chloride as discrete deposits on the {111} major surfaces of tabular silver bromide grains. The failure of the silver chloride to simply shell the silver bromide grains can be explained by the fact that silver chloride strongly favors surfaces of a {100} crystallographic form and was therefore incompatible with continuing {111} crystal face growth under the conditions of precipitation employed. Unlike Berry and Skillman the present invention employs silver halide to ruffle the host crystal faces that favors a crystallographic form corresponding to that of the crystal faces presented by the host grains.

It is believed that this is made possible by creating conditions which slow the rate of silver and halide ion deposition for at least one other crystallographic form below the rate of silver and halide ion deposition for the crystallographic form exhibited by the host grain. Deposition of silver halide onto the host grain crystal faces under these created conditions causes to be formed over the faces of the host grains pyramids bounded by surface faces of the slower growing crystallographic form. Maximum ruffling is achieved when substantially all of the host grain surfaces are just covered by the pyramidal protrusions. If deposition is continued thereafter, the grains revert eventually to an unruffled form, but are bounded by faces of a crystallographic form corresponding to that of the interim pyramidal surface faces.

Failure of the art to observe ruffled grain faces or any grain faces of the trisoctahedral, tetrahexahedral, icositetrahedral, or hexoctahedral crystallographic forms and rarely for the art to observe grain faces of the rhombic dodecahedral crystallographic form over decades of silver halide crystallographic studies suggests that there is not an extensive range of conditions that favor the ruffling of the normally observed {100} and {111} grain faces. It has been discovered that growth modifiers can be employed to produce ruffled grain faces. The growth modifiers which have been identified are organic compounds. They are believed to be effective by reason of showing an adsorption preference for the pyramidal crystal face formed by reason of its unique arrangement of silver and halide ions. The growth modifier thereby slows the rate of halide and silver ion deposition onto the pyramidal crystal face relative to the rate of silver and halide ion deposition onto the original host grain crystal faces. Thus crystal faces of the crystallographic form presented by the pyramid surface faces persist and predominate while differing crystal faces originally presented by the host grains are quickly diminished or obliterated by further silver halide deposition. Growth modifiers that have been empirically proven to be effective in producing ruffled grain faces as well as the combinations of host grain and pyramidal crystal faces which they have produced are described in the examples, below.

These growth modifiers are effective under the conditions of their use in the examples. From empirical screening of a variety of candidate growth modifiers under differing conditions of silver halide precipitation it has been concluded that multiple parameters must be satisfied to achieve ruffled grain faces, including not only the proper choice of a growth modifier, but also proper choice of other precipitation parameters identified in the examples. Failures to achieve ruffled grain faces with compounds shown to be effective as growth modifiers for producing ruffled grain faces have been observed when accompanying conditions for silver halide precipitation have been varied. However, it is appreciated that having demonstrated success in the preparations of silver halide emulsions containing grains with ruffled grain faces, routine empirical studies systematically varying parameters are likely to lead to additional useful preparation techniques.

Once silver halide grain growth conditions are satisfied that selectively retard silver halide deposition at pyramidal crystal faces, continued grain growth usually results in ruffling of all the grains present in the silver halide precipitation reaction vessel. It does not follow, however, that all of the radiation sensitive silver halide grains in the emulsions of the present invention must have ruffled faces. For example, silver halide grains having ruffled faces can be blended with any other conventional silver halide grain population to produce the final emulsion. While silver halide emulsions containing any identifiable ruffled grain surface are considered within the scope of this invention, in most applications the grains having at least one identifiable ruffled face account for at least 10 percent of the total grain population and usually these grains will account for greater than 50 percent of the total grain population.

The host grain emulsions presenting cubic and/or octahedral crystal faces from which the emulsions of this invention are produced and any emulsions lacking ruffled grain faces blended into ruffled grain emulsion according to this invention can be chosen from among a variety of conventional emulsions. Generally the techniques for producing surface latent image forming grains, internal latent image forming grains, internally fogged grains, surface fogged grains, and blends of differing grains described in *Research Disclosure,* Vol. 176, December 1978, Item 17643, Section I, can be applied to the preparation of emulsions according to this invention.

It is specifically contemplated to employ thin and high aspect ratio tabular grain silver halide emulsions as host grain emulsions. Such emulsions are illustrated by Wilgus et al U.S. Pat. No. 4,434,226; Kofron et al U.S. Pat. No. 4,439,520; Daubendiek et al U.S. Pat. No. 4,414,310; Abbott et al U.S. Pat. Nos. 4,425,425 and '426; Wey U.S. Pat. No. 4,399,215; Solberg et al U.S. Pat. No. 4,433,048; Dickerson U.S. Pat. No. 4,414,304; Mignot U.S. Pat. No. 4,386,156, Mignot *Research Disclosure,* Vol. 232, August 1983, Item 23210; Jones et al U.S. Pat. No. 4,478,929; Evans et al U.S. Pat. No. 3,761,276; Maskasky U.S. Pat. No. 4,400,463; Wey et al U.S. Pat. No. 4,414,306; and Maskasky 4,435,501, cited above and here incorporated by reference.

As herein defined high aspect ratio tabular grain emulsions are those comprised of a dispersing medium and silver halide grains, wherein at least 50 percent of the total projected area of the silver halide grains is provided by tabular silver halide grains having a thickness of less than 0.3 μm, a diameter of at least 0.6 μm, and an average aspect ratio of greater than 8:1. In some applications, such as in recording radiation within a portion of the spectrum that the silver halide is capable of absorbing, at least 50 percent of the total projected area of the total projected area of the silver halide grains is provided by tabular silver halide grains having a thickness of less than 0.5 μm, a diameter of at least 0.6 μm, and an average aspect ratio of greater than 8:1. Preferred high aspect ratio tabular grain emulsions are those in which the average aspect ratio is at least 12:1 and optimally at least 20:1. It is also preferred to increase the projected area referred to above from 50 percent to 70 percent and optimally to 90 percent. Silver bromiodide emulsions are generally preferred for camera speed imaging applications while silver bromide and silver bromoiodide emulsions are preferred for radiographic imaging.

As herein defined thin tabular grain emulsions are those comprised of a dispersing medium and silver halide grains, wherein at least 50 percent of the total projected area of the silver halide grains is provided by tabular silver halide grains having a thickness of less than 0.2 μm and an average aspect ratio of greater than 5:1. The preferences noted above for high aspect ratio emulsions apply also to thin tabular grain emulsions. Emulsions which satisfy both definitions are preferred for most photographic applications.

Apart from the novel grain structures identified above, the radiation sensitive silver halide emulsions and the photographic elements in which they are incorporated of this invention can take any convenient conventional form. The emulsions can be washed as described in *Research Disclosure,* Item 17643, cited above, Section II.

The radiation sensitive silver halide grains of the emulsions can be surface chemically sensitized. Noble metal (e.g., gold), middle chalcogen (e.g., sulfur, selenium, or tellurium), and reduction sensitizers, employed individually or in combination are specifically contemplated. Typical chemical sensitizers are listed in *Research Disclosure,* Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Research Disclosure,* Item 17643, cited above, Section IV.

The silver halide emulsions as well as other layers of the photographic elements of this invention can contain as vehicles hydrophilic colloids, employed alone or in combination with other polymeric materials (e.g., latices). Suitable hydrophilic materials include both naturally occurring substances such as proteins, protein derivatives, cellulose derivatives—e.g., cellulose esters, gelatin—e.g., alkali treated gelatin (cattle, bone, or hide gelatin) or acid treated gelatin (pigskin gelatin), gelatin derivatives—e.g., acetylated gelatin, phthalated gelatin, and the like, polysaccharides such as dextran, gum arabic, zein, casein, pectin, collagen derivatives, collodion, agar-agar, arrowroot, and albumin. The vehicles can be hardened by conventional procedures. Further details of the vehicles and hardeners are provided in *Research Disclosure,* Item 17643, cited above, Sections IX and X.

The silver halide photographic elements of this invention can contain other addenda conventional in the photographic art. Useful addenda are described, for example, in *Research Dislosure,* Item 17643, cited above. Other conventional useful addenda include antifoggants and stabilizers, couplers (such as dye forming couplers, masking couplers and DIR couplers) DIR compounds, anti-stain agents, image dye stabilizers, absorbing materials such as filter dyes and UV absorbers, light scattering materials, antistatic agents, coating aids, and plasticizers and lubricants.

The photographic elements of the present invention can be simple black-and-white or monochrome elements comprising a support bearing a layer of the silver halide emulsion, or they can be multilayer and/or multicolor elements. The photographic elements produce images ranging from low contrast to very high contrast, such as those employed for producing half tone images in graphic arts. They can be designed for processing with separate solutions or for in-camera processing. In the latter instance the photographic elements can include conventional image transfer features, such as those illustrated by *Research Disclosure,* Item 17643, cited above, Section XXIII. Multicolor elements contain dye image forming units sensitive to each of the three primary regions of the spectrum. Each unit can be comprised of a single emulsion layer or of multiple emulsion layers sensitive to a given region of the spectrum. The layers of the element, including the layers of the image forming units, can be arranged in various orders as known in the art. In an alternative format, the emulsion or emulsions can be disposed as one or more segmented layers, e.g., as by the use of microvessels or microcells, as described in Whitmore U.S. Pat. No. 4,387,154.

A preferred multicolor photographic element according to this invention containing incorporated dye image providing materials comprises a support bearing at least one blue sensitive silver halide emulsion layer having associated therewith a yellow dye forming coupler, at least one green sensitive silver halide emulsion layer having associated therewith a magenta dye forming coupler, and at least one red sensitive silver halide emulsion layer having associated therewith a cyan dye forming coupler, at least one of the silver halide emulsion layers containing grains having ruffled faces as previously described.

The elements of the present invention can contain additional layers conventional in photographic elements, such as overcoat layers, spacer layers, filter layers, antihalation layers, and scavenger layers. The support can be any suitable support used with photographic elements. Typical supports include polymeric films, paper (including polymer-coated paper), glass, and metal supports. Details regarding supports and other layers of the photographic elements of this invention are contained in *Research Disclosure,* Item 17643, cited above, Section XVII.

The photographic elements can be imagewise exposed with various forms of energy, which encompass the ultraviolet, visible, and infrared regions of the electromagnetic spectrum as well as electron beam and beta radiation, gamma ray, X ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements, such as those illustrated by *Research Disclosure,* Vol. 184, August 1979, Item 18431.

Processing of the imagewise exposed photographic elements can be accomplished in any convenient conventional manner. Processing procedures, developing agents, and development modifiers are illustrated by *Research Disclosure,* Item 17643, cited above, Sections XIX, XX, and XXI, respectively.

The emulsions of this invention can be substituted for conventional emulsions to satisfy known photographic applications. In addition, the emulsions of this invention can lead to further photographic advantages. In general the further photographic advantages can be attributed one or a combination of (a) the increased surface area ratios which the ruffled grains make possible, (b) the varied crystal faces presented by the ruffled grains, and (c) the high affinity between the ruffled grain faces and adsorbed compounds.

For example, the present invention allows increases in photographic speed to be realized. In considering a photographic application in which the emulsions are exposed imagewise to light in the minus blue portion of the spectrum (i.e., the green and/or red portion of the spectrum) and thereby require spectral sensitization, it is generally accepted in the art that it is the amount of spectral sensitizing dye which can be adsorbed to the surfaces of grains of a chosen size which limits the maximum minus blue speed that can be realized. Note that decreasing average grain size to increase the surface area ratio of the grains and therefore the amount of sensitizing dye per unit volume of silver halide is ineffective to increase speed. It instead lowers photographic speed. The present invention by increasing the surface area ratio of the grains without reducing average grain size allows an increase in photographic speed to be realized.

In considering the minus blue speed gain the angle which the light strikes the spectral sensitizing dye adsorbed to the grain crystal faces is an important consideration. Photon capture is most efficient when the transition moment dipole (see Zbinden, *Infrared Spectroscopy of High Polymers,* Academic Press, New York, 1964, p. 215) of the spectral sensitizing dye absorbed to the crystal face presented by the silver halide grains is substantially normal to the direction of exposing radiation. When the grains are randomly oriented in the emulsion, as is typical for emulsions containing predominantly nontabular grains (e.g., regular cubic or octahedral grains) or tabular grains of low aspect ratios (e.g., less than 5:1), ruffling of the grain faces does not change the average angle of incidence of exposing radiation with the transition moment dipole of the adsorbed spectral sensitizing dye. In this instance speed increases realizable should be approximate in proportion to the increase in the surface area ratio.

In conventional thin and high aspect ratio tabular grain emulsions the grains are typically oriented with their major faces normal to the direction of unscattered exposing radiation. For most spectral sensitizing dyes the transition moment dipole is parallel to the crystal face to which it is absorbed; therefore, a normal orientation of the silver halide crystal faces with respect to the direction of exposing radiation also normally orients the transition moment dipole of the spectral sensitizing dye. Thus, the grain faces are already oriented optimally for dye absorption of unscattered light. In this instance increasing the grain surface area by ruffling increases the amount of spectral sensitizing dye which can be adsorbed to the grain surfaces before encountering desensitization, but the speed gain which flows from this increase in grain surface area is diminished by the less efficient orientation of the transition moment dipole of the adsorbed spectral sensitizing dye. Where, however, the exposing radiation has undergone significant scattering prior to reaching a spectrally sensitized ruffled thin or high aspect ratio tabular grain emulsion layer, the angular orientation of the dye transition moment dipoles is reduced if not eliminated in significance.

Thus, an optimum location for a spectrally sensitized ruffled thin or high aspect ratio tabular grain emulsion in a photographic element is nearer the support and beneath overlying light scattering layers. For example, in a multicolor photographic element such an emulsion is most efficient as the slower green and/or red recording layers normally located nearest the photographic support.

If desired, the photographic speed of these recording layers can be increased by employing reflective materials, either in the emulsion layer or layers or in underlying layers. The reflective materials in the silver halide emulsion layers can include pigments of high refractive index, as illustrated by Marriage U.K. Pat. No. 504,283 and Yutzy et al U.K. Pat. No. 760,775 or reflecting undercoat layers containing silver halide, as illustrated by Russell U.S. Pat. No. 3,140,179.

Although the above discussion is directed specifically to the use of minus blue absorbing spectral sensitizing dyes, it can be appreciated that similar considerations apply to adsorbed spectral sensitizers, regardless of the region of the spectrum in which they absorb. The combination of emulsions having randomly oriented ruffled grains of a silver halide composition capable of absorbing blue light (e.g., silver bromide and silver bromoiodide) and a blue absorbing spectral sensitizing dye is specifically recognized as being a photographically advantageous form of the present invention.

In the foregoing discussion only the increase in the grain surface area ratio is necessary to account the photographic advantage. However, photographic advantages can also be attributed to improved interactions of adsorbed addenda and the ruffled silver halide grains surfaces. For example, when a growth modifier is present adsorbed to the ruffled faces of the grains and has a known photographic utility that is enhanced by adsorption to a grain surface, either because of the more intimate association with the grain surface or because of the reduced mobility of the growth modifier, improved photographic performance can be expected. The reason for this is that for the growth modifier to produce a pyramidal crystal face it must exhibit an adsorption preference for that crystallographic form that is greater than that exhibited for any other possible silver halide crystallographic form.

This can be appreciated, for example, by considering growth in the presence of an adsorbed growth modifier of a silver halide grain having both cubic and hexoctahedral crystal faces. If the growth modifier shows an adsorption preference for the hexoctahedral crystal faces over the cubic crystal faces, deposition of silver and halide ions onto the hexoctahedral crystal faces is retarded to a greater extent than along the cubic crystal faces, and grain growth results in the elimination of the cubic crystal faces in favor of hexoctahedral crystal faces. From the foregoing it is apparent that growth modifiers which produce hexoctahedral crystal faces are more tightly adsorbed to these grain surfaces than to other silver halide grain surfaces during grain growth, and this enhanced adsorption carries over to the completed emulsion.

To provide an exemplary photographic application, Locker U.S. Pat. No. 3,989,527 describes improving the speed of a photographic element by employing an emulsion containing radiation sensitive silver halide grains having a spectral sensitizing dye adsorbed to the grain surfaces in combination with silver halide grains free of spectral sensitizing dye having an average diameter chosen to maximize light scattering, typically in the 0.15 to 0.8 μm range. Upon imagewise exposure radiation striking the undyed grains is scattered rather than being absorbed. This results in an increased amount of exposing radiation striking the radiation sensitive imaging grains having a spectral sensitizing dye adsorbed to their surfaces.

A disadvantage encountered with this approach has been that spectral sensitizing dyes can migrate in the emulsion, so that to some extent the initially undyed grains adsorb spectral sensitizing dye which has migrated from the initially spectrally sensitized grains. To the extent that the initially spectrally sensitized grains were optimally sensitized, dye migration away from their surfaces reduces sensitization. At the same time, adsorption of dye on the grains intended to scatter imaging radiation reduces their scattering efficiency.

In the examples below it is to be noted that spectral sensitizing dyes have been identified as a growth modifiers useful in forming ruffled silver halide grains. When radiation sensitive silver halide grains having ruffled faces and a growth modifier spectral sensitizing dye adsorbed to the ruffled faces are substituted for the spectrally sensitized silver halide grains employed by Locker, the disadvantageous migration of dye from the ruffled grain faces to the silver halide grains intended to scatter light is reduced or eliminated. Thus, an improvement in photographic efficiency can be realized.

To illustrate another advantageous photographic application, the layer structure of a multicolor photographic element which introduces dye image providing materials, such as couplers, during processing can be simplified. An emulsion intended to record green exposures can be prepared using a growth modifier that is a green spectral sensitizing dye while an emulsion intended to record red exposures can be prepared using a growth modifier that is a red spectral sensitizing dye. Since the growth modifiers are tightly adsorbed to the grains and non-wandering, instead of coating the green and red emulsions in separate color forming layer units, as is conventional practice, the two emulsions can be blended and coated as a single color forming layer unit. The blue recording layer can take any conventional form, and a conventional yellow filter layer can be employed to protect the blended green and red recording emulsions from blue light exposure. Except for blending the green and red recording emulsions in a single layer or group of layers differing in speed in a single color forming layer unit, the structure and processing of the photographic element is unaltered. If silver chloride emulsions are employed, the approach described above can be extended to blending in a single color forming layer unit blue, green, and red recording emulsions, and the yellow filter layer can be eliminated. The advantage in either case is a reduction in the number of emulsion layers required as compared to a corresponding conventional multicolor photographic element.

In more general applications, the substitution of an emulsion according to the invention containing a growth modifier spectral sensitizing dye should produce a more invariant emulsion in terms of spectral properties than a corresponding emulsion containing silver halide grains lacking ruffled faces. Where the growth modifier is capable of inhibiting fog, such as 2-mercaptoimidazole or any of the tetraazaindenes shown to be effective growth modifiers in the examples, more effective fog inhibition at lower concentrations may be expected.

It is recognized that a variety of photographic effects, such as photographic sensitivity, minimum background density levels, latent image stability, nucleation, developability, image tone, absorption, and reflectivity, are influenced by grain surface interactions with other components. By employing components, such as peptizers, silver halide solvents, sensitizers or desensitizers, supersensitizers, halogen acceptors, dyes, antifoggants, stabilizers, latent image keeping agents, nucleating agents, tone modifiers, development accelerators or inhibitors, development restrainers, developing agents, and other addenda that are uniquely matched to the ruffled grain faces, distinct advantages in photographic performance over that which can be realized with silver halide grains of differing crystal faces are possible.

EXAMPLES

The invention can be better appreciated by reference to the following specific examples. In each of the examples all solutions, unless otherwise indicated, are aqueous solutions. Dilute nitric acid or dilute sodium hydroxide was employed for pH adjustment, as required.

EXAMPLE 1

Emulsion Example 1 illustrates the preparation of a ruffled tabular grain silver bromoiodide emulsion using as growth modifier Compound I, 5-carbethoxy-4-hydroxy-1,3,3a,7-tetraazaindene, which is known to be useful as an antifoggant and stabilizer.

To a reaction vessel supplied with a stirrer was added 0.05 mole of a thin and high aspect ratio tabular grain silver bromoiodide emulsion (6 mole % I) of mean grain size 5.3 μm, thickness 0.07 μm, and containing about 40 g/Ag mole gelatin, hereinafter designated Host Grain Emulsion 1. Water was added to make the total weight 50 g. To the emulsion at 40° C. was added 6.0 millimole/initial Ag mole of Compound I dissolved in 1 mL of methanol, 1 mL of water, and 3 drops of triethylamine. The emulsion was then held for 15 min. at 40° C. The pH was adjusted to 6.0 at 40° C. The temperature was raised to 60° C., and the pAg adjusted to 8.5 at 60° C. with KBr and maintained at that value during the precipitation. A 2.0M solution of $AgNO_3$ was introduced at a constant rate over a period of 38 min while a solution that was 1.88M in KBr and 0.12M in KI was added as needed to hold the pAg constant. A total of 0.015 mole Ag was added.

Figure 18:
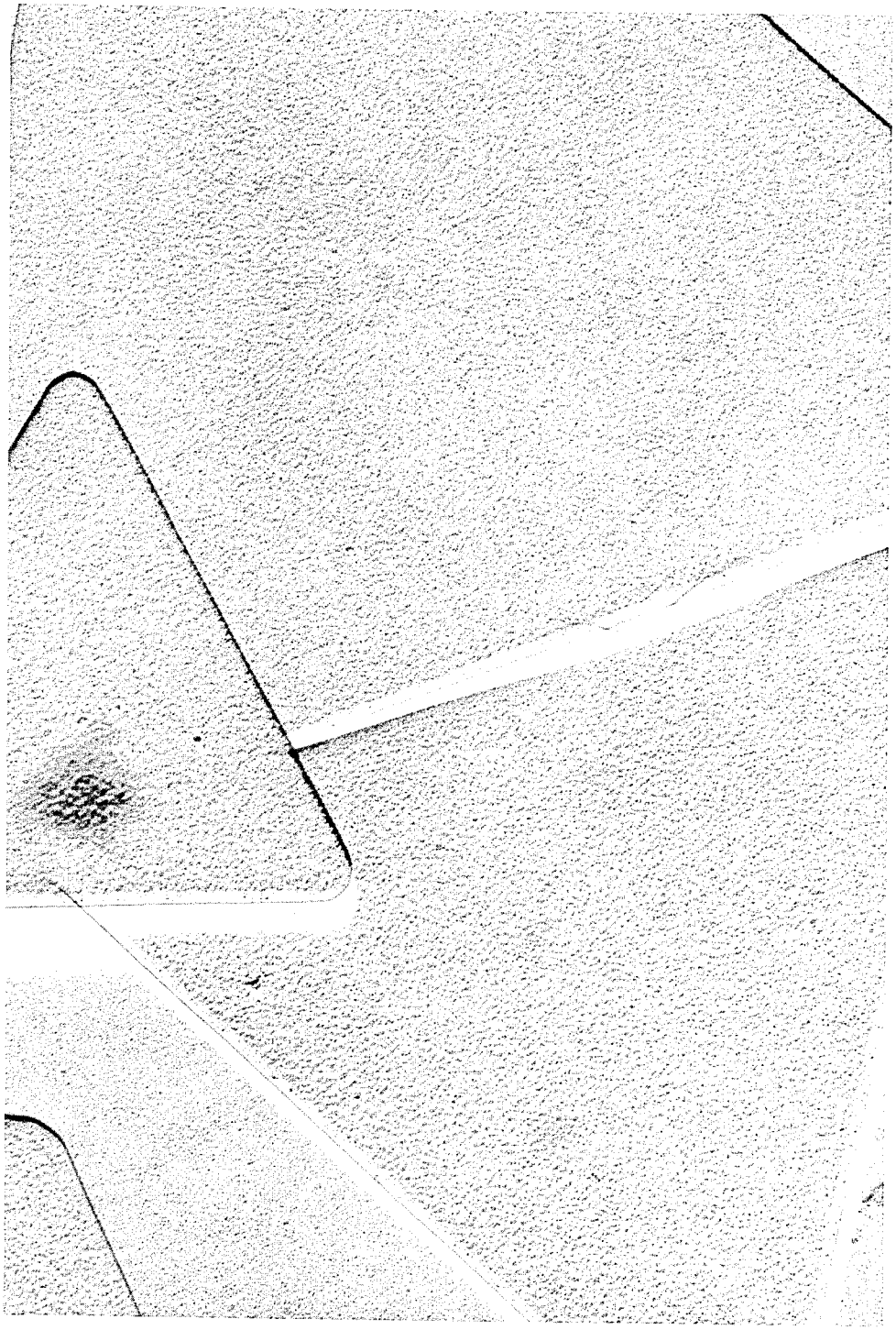
FIGS. 18, 19, 20, 21A, 21B, 21C, 21D, 22, 23A, 23B, 23C, 24A, 24B, 24C, 24D, 25, 26A, 26B, 26C, 26D, 26E, 27, 28, 29A, 29B, 30A, 30B, 31A, 31B, 32, 33A, and 33B, are electron micrographs of silver halide emulsion grains.

A carbon replica electron micrograph of the resulting emulsion grains is shown in FIG. 18. The ruffles were small, closely positioned, and uniformly distributed over the faces of the tabular grains.

EXAMPLE 2

Emulsion Example 2 illustrates the preparation of a ruffled tabular-grain silver bromoiodide emulsion using as a growth modifier, Compound II, which is known to be useful as a blue spectral sensitizing dye.

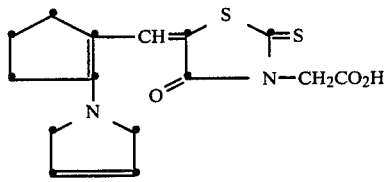

Compound II

Emulsion Example 2 was prepared as described for Example 1, except that the growth modifier was 6.0 millimole/Ag mole of Compound II, dissolved in 3 mL methanol, 2 mL water, and 2 drops of triethylamine. The precipitation was carried out for 37.0 min, consuming 0.015 mole Ag.

Figure 19:
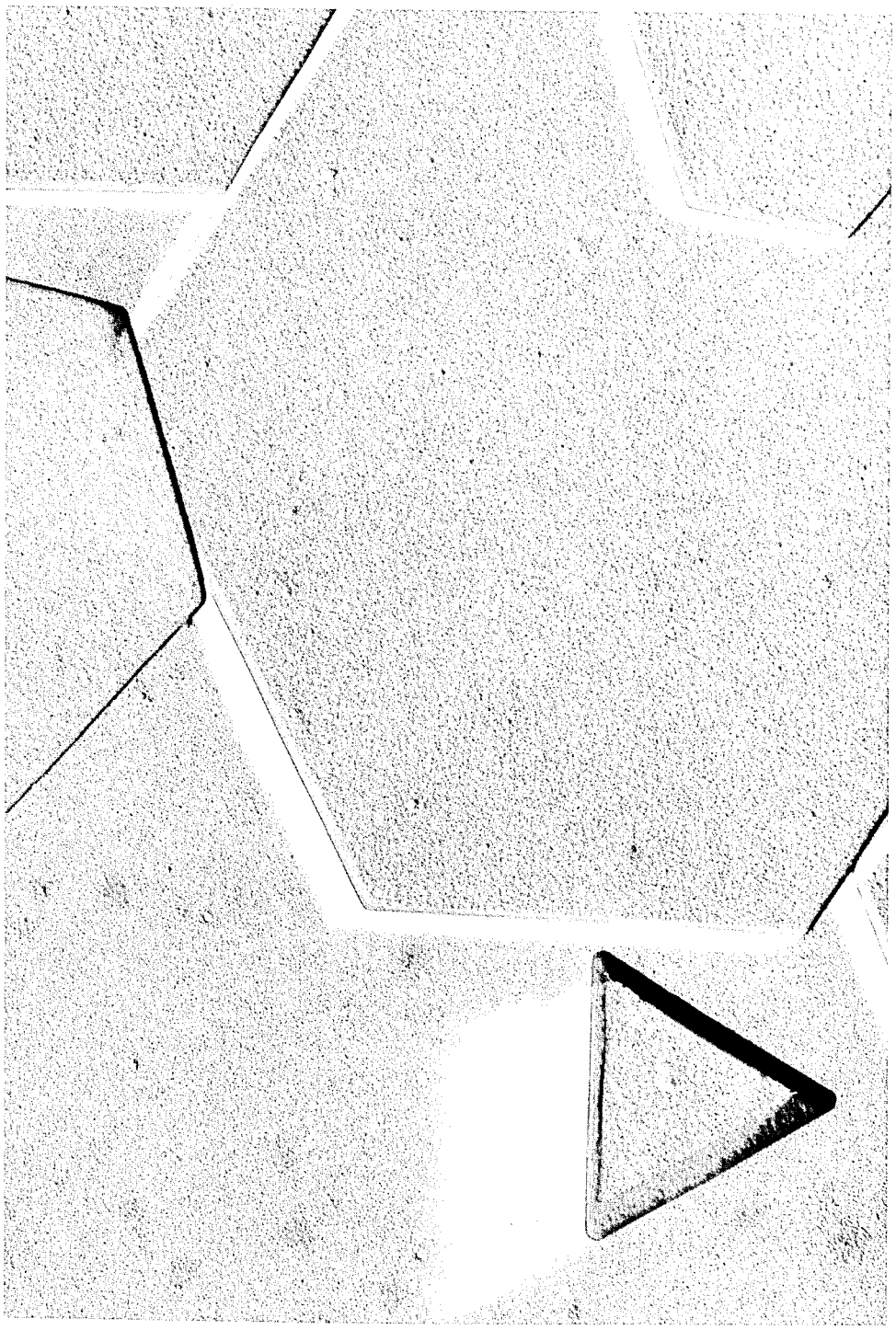

An electron micrograph of the resulting emulsion is shown in FIG. 19. Using the above preparation conditions, but substituting an AgBr regular octahedral grain host emulsion for tabular grain host emulsion, Compound II was determined to be a growth modifier which produces pyramidal crystal faces of the {211} icositetrahedral form. The ruffles were similar to those of Example 1.

EXAMPLE 3

Emulsion Example 3 illustrates the preparation of a ruffled tabular grain pure bromide emulsion using as a growth modifier Compound III, anhydro-5-chloro-9-ethyl-5'-phenyl-3,3'-di-(3-sulfopropyl)oxacarbocyanine hydroxide, triethylamine salt, which is known to be useful as a green spectral sensitizing dye.

To a reaction vessel supplied with a stirrer was added 0.05 mole of a thin and high aspect ratio tabular grain AgBr emulsion of mean grain size 5.6 μm and thickness 0.10 μm containing about 20 g/Ag mole gelatin, hereinafter designated Host Grain Emulsion 2. Water was added to make the total weight 50 g. To the emulsion at 40° C. was added 5.0 millimole/initial Ag mole of Compound III dissolved in 2 mL methanol. The emulsion was then held for 15 min at 40° C. The pH was adjusted to 6.0 at 40° C. The temperature was lowered to 30° C., and the pAg adjusted to 7.6 at 30° C. with KBr and maintained at that level during the precipitation. A 2.0M solution of $AgNO_3$ was introduced at a constant rate over a period of 10 min while a 2.0M solution of KBr was added as needed to hold the pAg constant. A total of 0.020 mole Ag was added.

Figure 20:
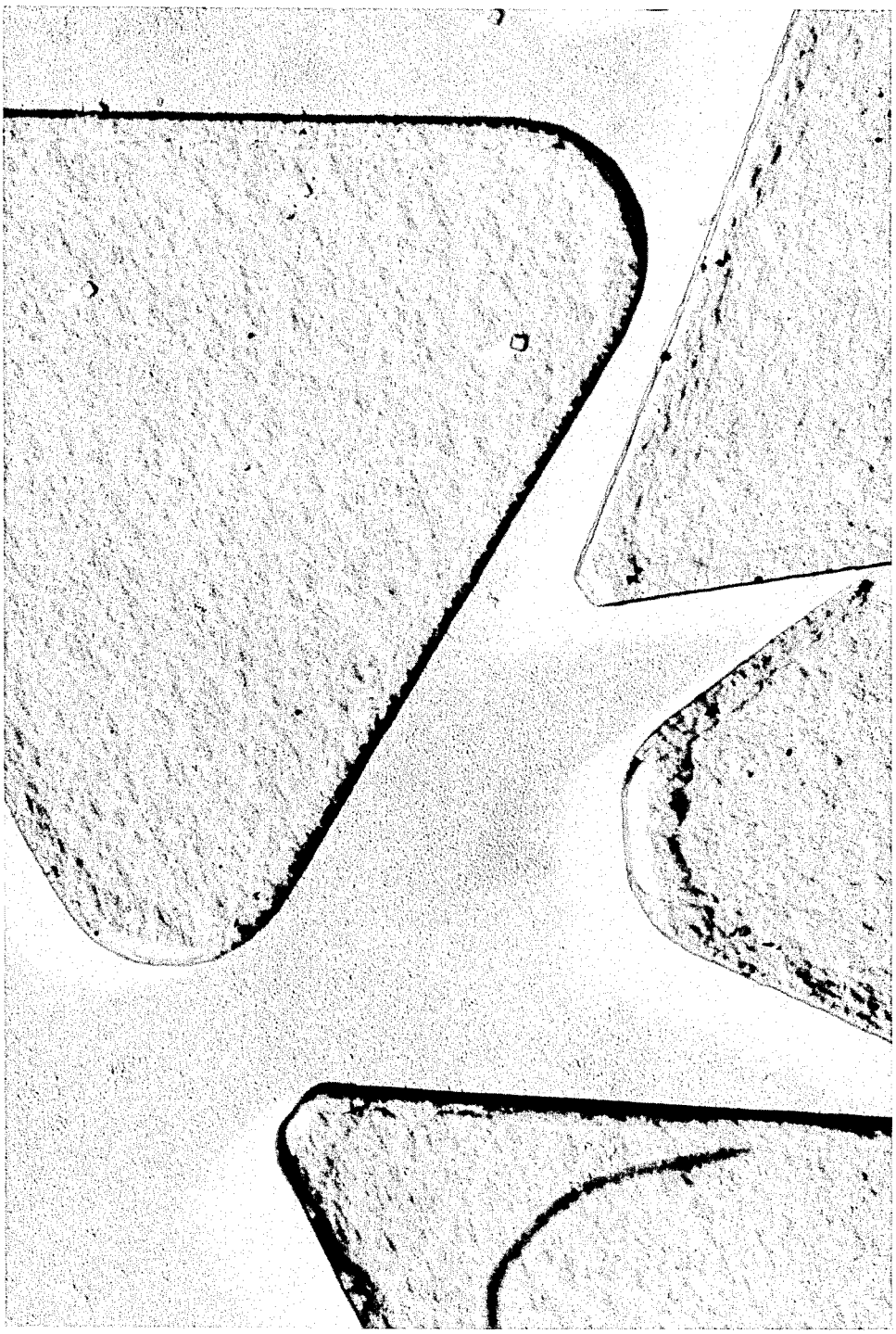

An electron micrograph of the resulting emulsion grains is shown in FIG. 20. The ruffles were larger than in the previous examples, closely arranged, and uniformly distributed over the faces of the tabular grains. Using similar conditions, but on an AgBr regular octahedral host grains, Compound III was determined to be a {100} growth modifier.

EXAMPLE 4

The four parts of Example 4 show the effects of varying the pAg and temperature of precipitation on the properties of the resulting ruffles. The host was a tabular grain AgBr emulsion, and the growth modifier Compound IV, anhydro-9-ethyl-5,5'-diphenyl-3,3'-di(3-sulfobutyl)oxacarbocyanine hydroxide, monosodium salt, which is known to be useful as a green spectral sensitizing dye.

To a reaction vessel supplied with a stirrer was added 0.05 mole of Host Grain Emulsion 2. Water was added to make the total weight 50 g. To the emulsion at 40° C.

was added 5.0 millimole/initial Ag mole of Compound IV dissolved in 9 mL methanol. The emulsion was then held for 15 min at 40° C. The pH was adjusted to 6.0 at 40° C. Under the pAg and temperature conditions shown in Table II, 0.02 mole of a 2.0M $AgNO_3$ solution was introduced at a constant rate over a period of 10 minutes while a 2.0M solution of KBr was added as needed to hold the pAg constant.

TABLE II

| Example 4 Precipitation Conditions | | | |
|---|---|---|---|
| Example | FIG. No | pAg | T(°C.) |
| 4A | 21A | 7.6 | 60 |
| 4B | 21B | 7.6 | 40 |
| 4C | 21C | 7.6 | 30 |
| 4D | 21D | 5.2 | 40 |

Figure 21A:
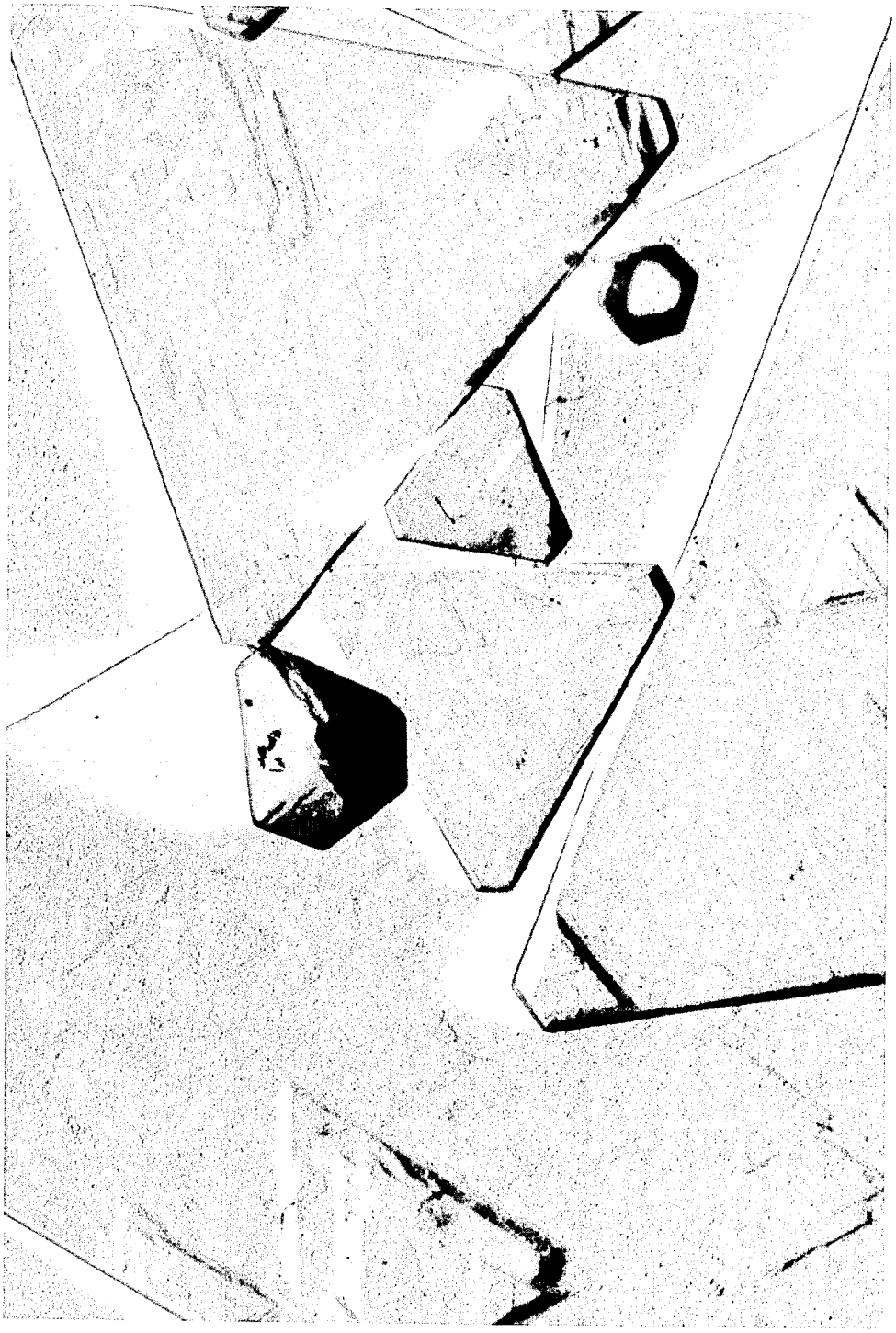
Figure 21B:
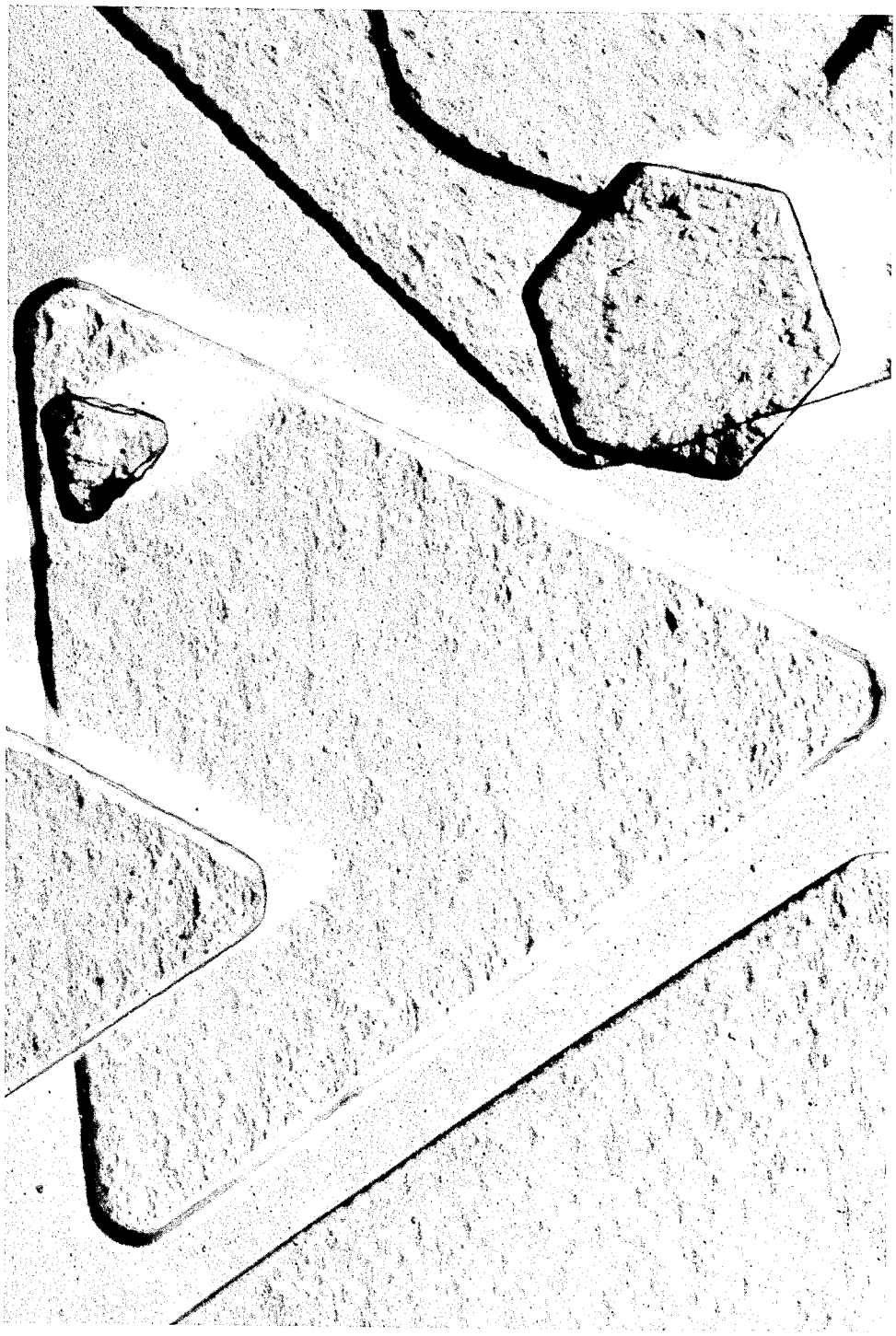
Figure 21C:
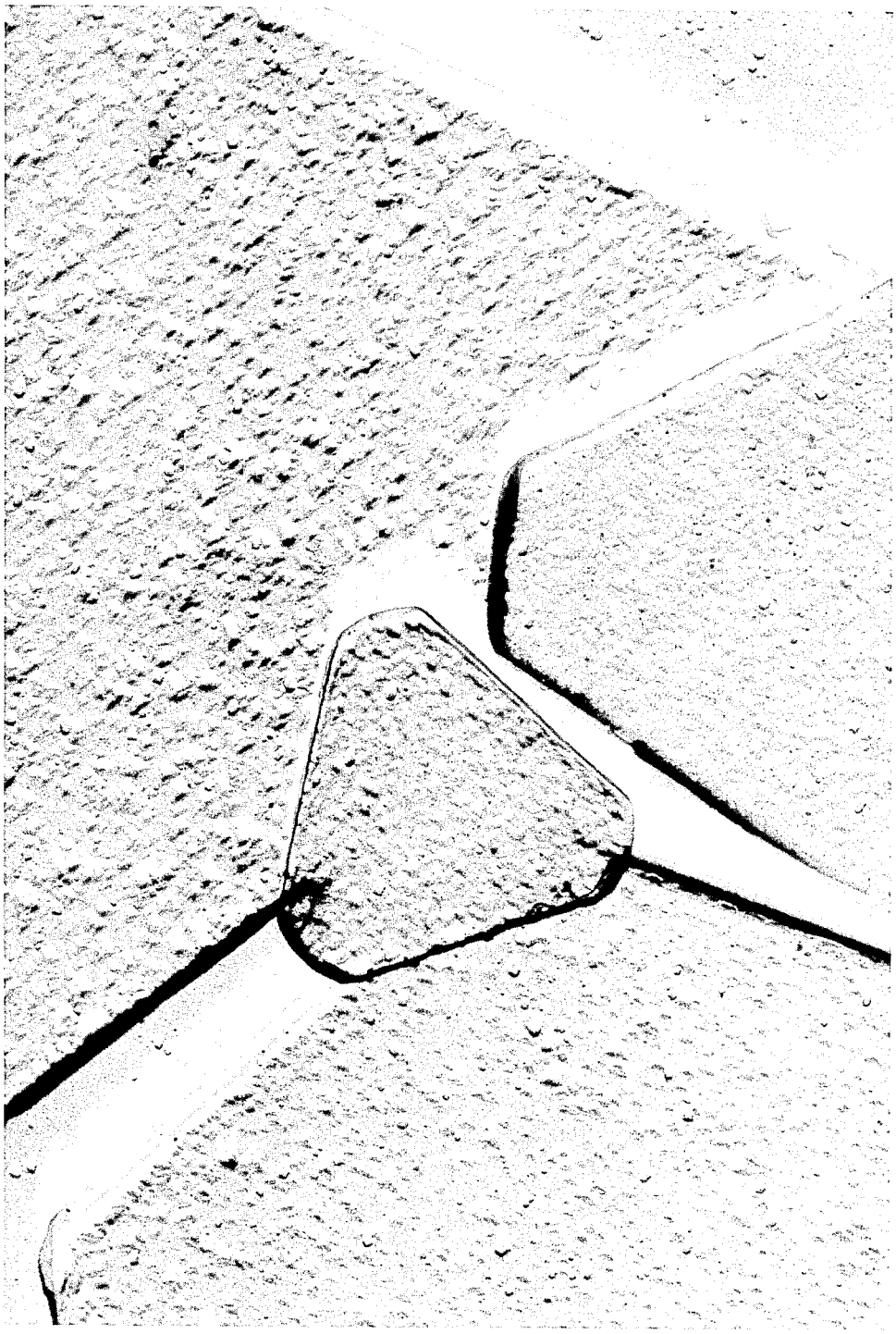
Figure 21D:
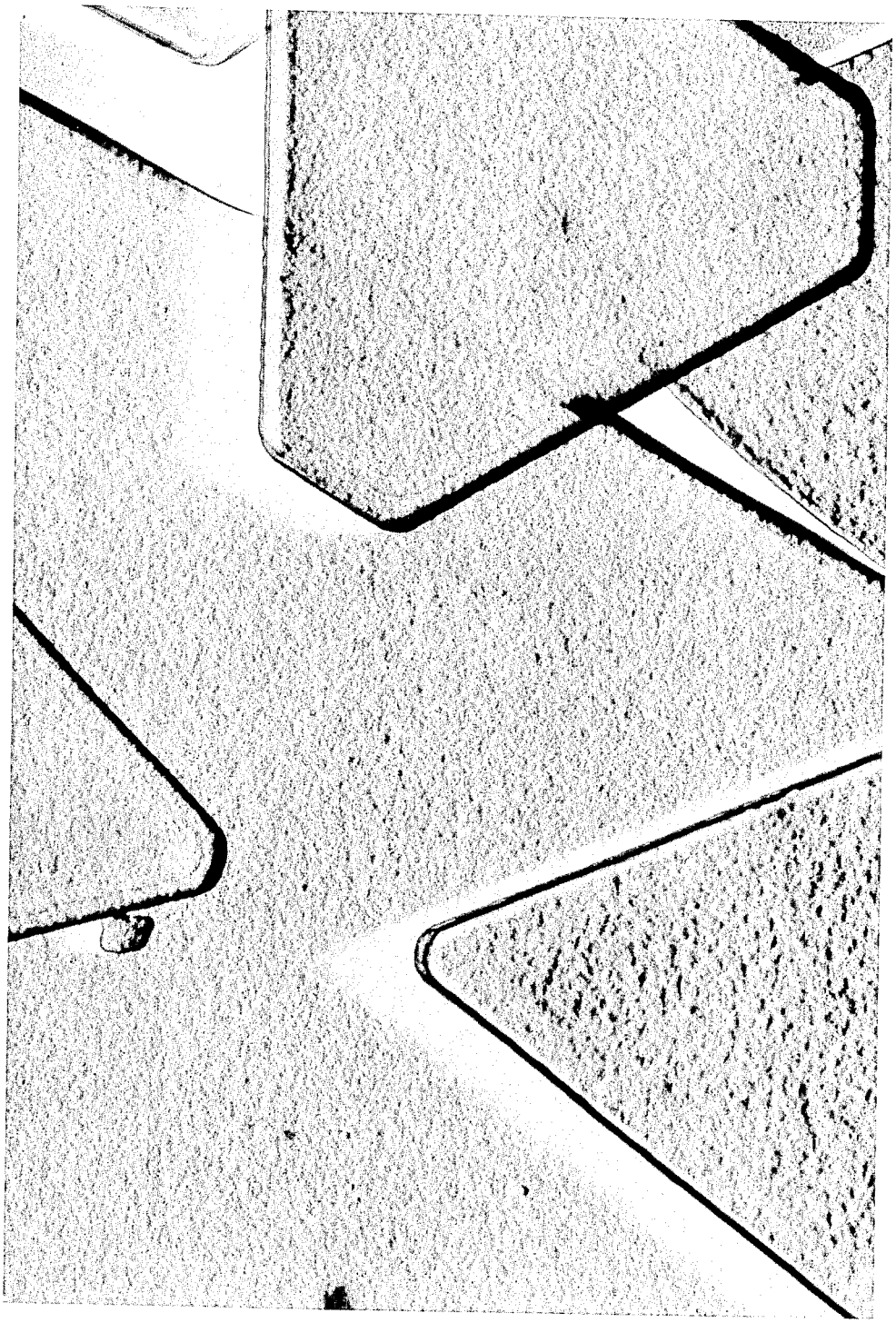

FIGS. 21A, B, C and D show electron micrographs of the resulting grains. Example 4A produced growths of large flat triangles. Example 4B produced a growth of some flat triangles and some pyramids smaller than in 4A. Example 4C produced fairly uniform pyramids. Example 4D produced uniform closely arranged, small pyramids. Examination indicated the growths to have {100} (cubic) crystal faces. Compound IV was determined to be a {100} growth modifier by depositing AgBr onto an regular octahedral grain host emulsion at pAg 7.6, 40° C. in the presence of this compound; AgBr cubes resulted.

EXAMPLE 5

Emulsion Example 5 illustrates the preparation of a ruffled tabular grain silver bromide emulsion using as a growth modifier Compound V, 5-(3-ethyl-2-benzothiazolinylidene)-3-β-sulfoethylrhodanine, which is known to be useful as a blue spectral sensitizing dye.

To a reaction vessel supplied with a stirrer was added 0.04 mole of Host Grain Emulsion 2. Water was added to make the total weight 40 g. To the emulsion at 40° C. was added 4 millimole/initial Ag mole of Compound V dissolved in 7 mL of N,N-dimethylformamide, 3 mL water, and 2 drops of triethylamine. The emulsion was then held for 15 min at 40° C. The pH was adjusted to 6.0 at 40° C. The temperature was raised to 60° C., and the pAg adjusted to 8.5 at 60° C. with KBr and maintained at that value during the precipitation. A 2.0M solution of $AgNO_3$ was introduced at a constant rate over a period of 20 min while a 2M solution of KBr was added as needed to hold the pAg constant. A total of 0.02 mole Ag was added.

Figure 22:
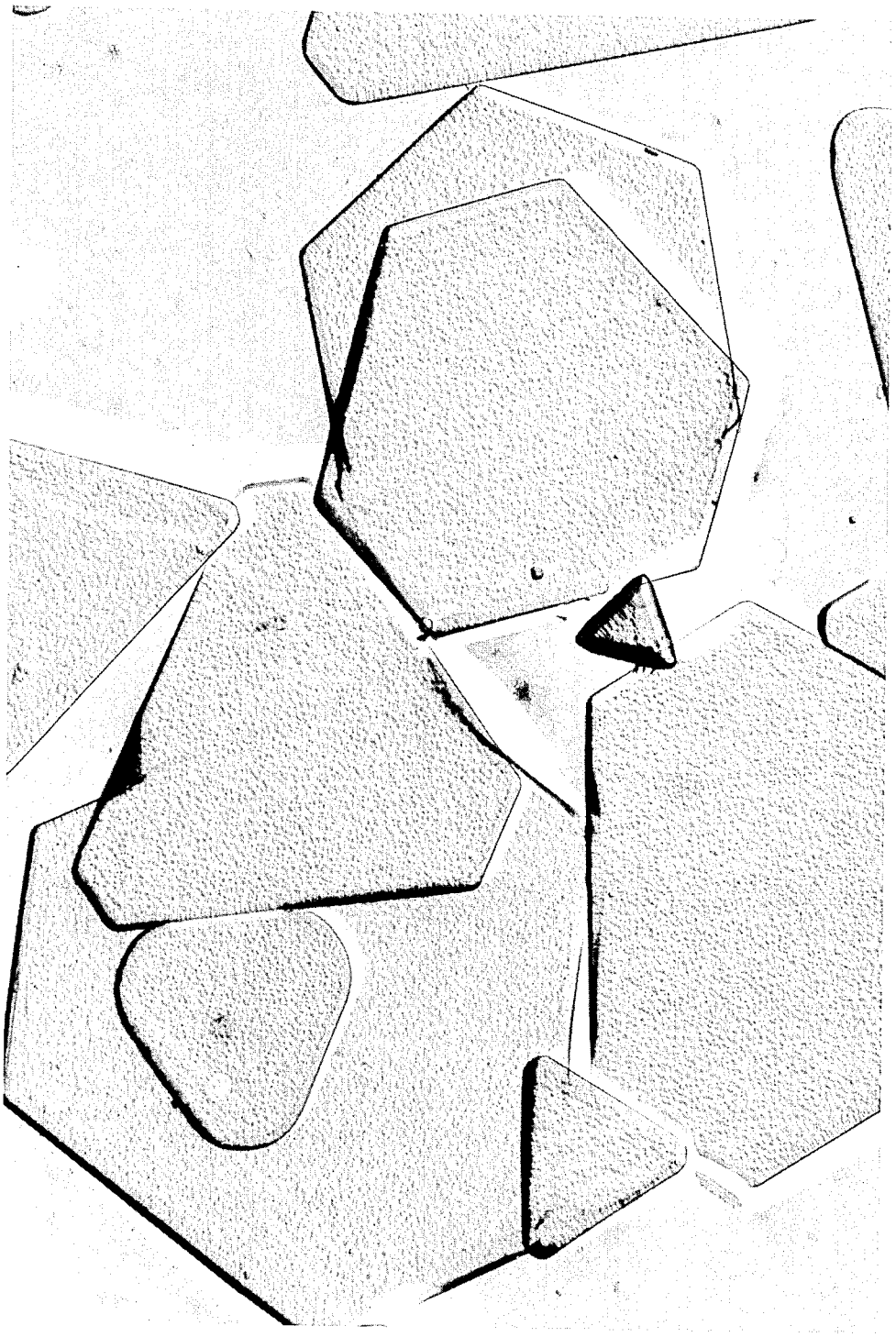

An electron micrograph of the resulting emulsion grains is shown in FIG. 22. The grain faces were uniformly covered with closely arranged, sharp, small pyramidal ruffles. This was consistent with the {211} icositetrahedral crystal faces expected from investigation of the same growth modifier employing a nontabular host grain emulsion.

EXAMPLE 6

Example 6 illustrates the preparation of ruffled tabular grain silver bromoiodide emulsions using Compound V (Example 5) as the growth modifier. Example 6A is a control showing that no ruffles are formed if the growth modifier is added following, rather than preceding, the silver halide precipitation on the host emulsion. The host emulsion (0.05 mole for each experiment) and precipitation conditions were as described in Example 1, except that the growth modifier was Compound V and the addition rate of the $AgNO_3$ solution was half that used in Example 1, (precipitation time about 74 min, 0.015 mole Ag added). The details of the three experiments are shown in Table III.

TABLE III

| Example 6 Precipitations | | | |
|---|---|---|---|
| Example | FIG. No | Cpd. V mmole/ Ag mole | Comments |
| 6A | 23A | 3.0 | Control - Cpd. V added after precipitation |
| 6B | 23B | 3.0 | Invention |
| 6C | 23C | 4.5 | Invention |

Figure 23A:
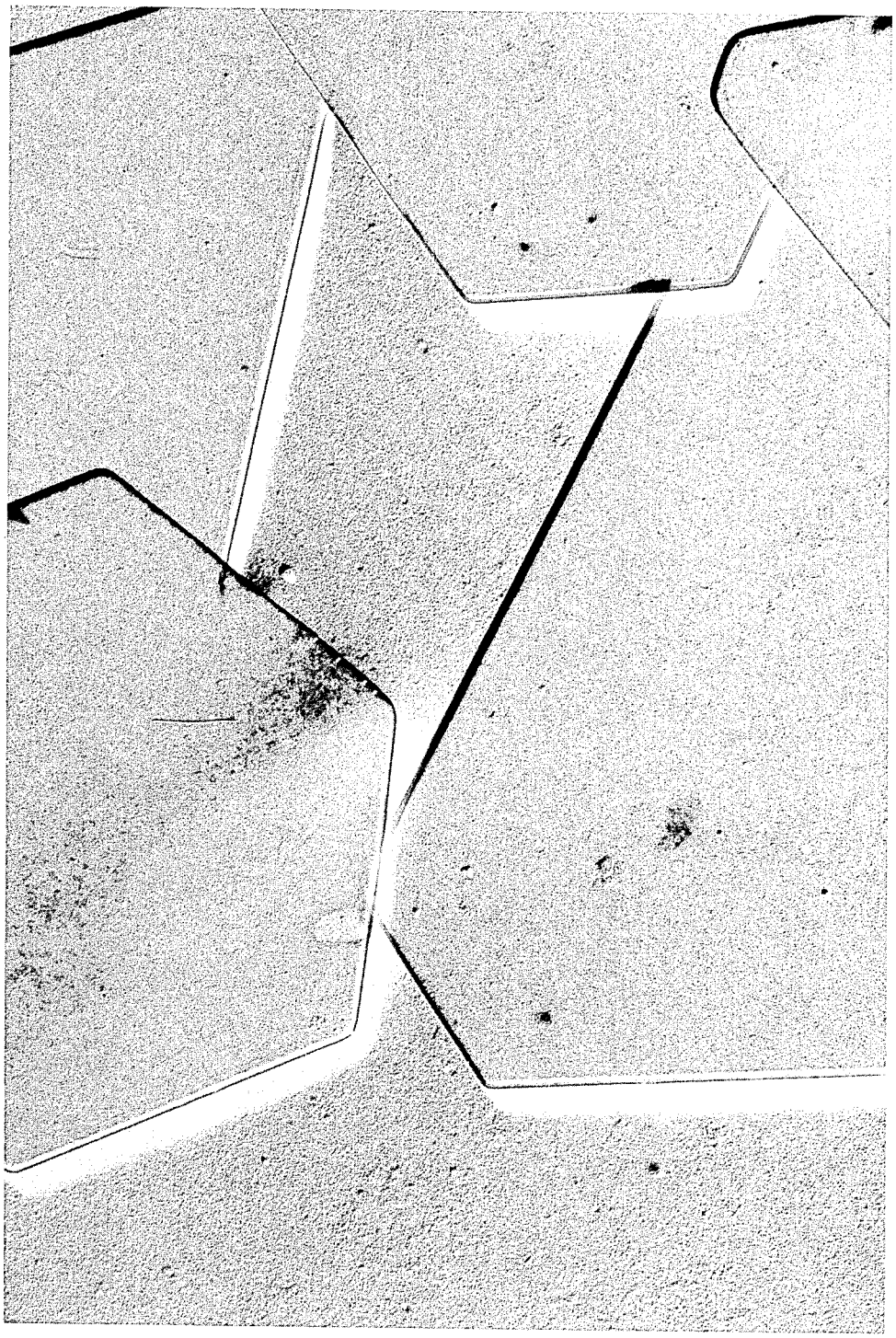
Figure 23B:
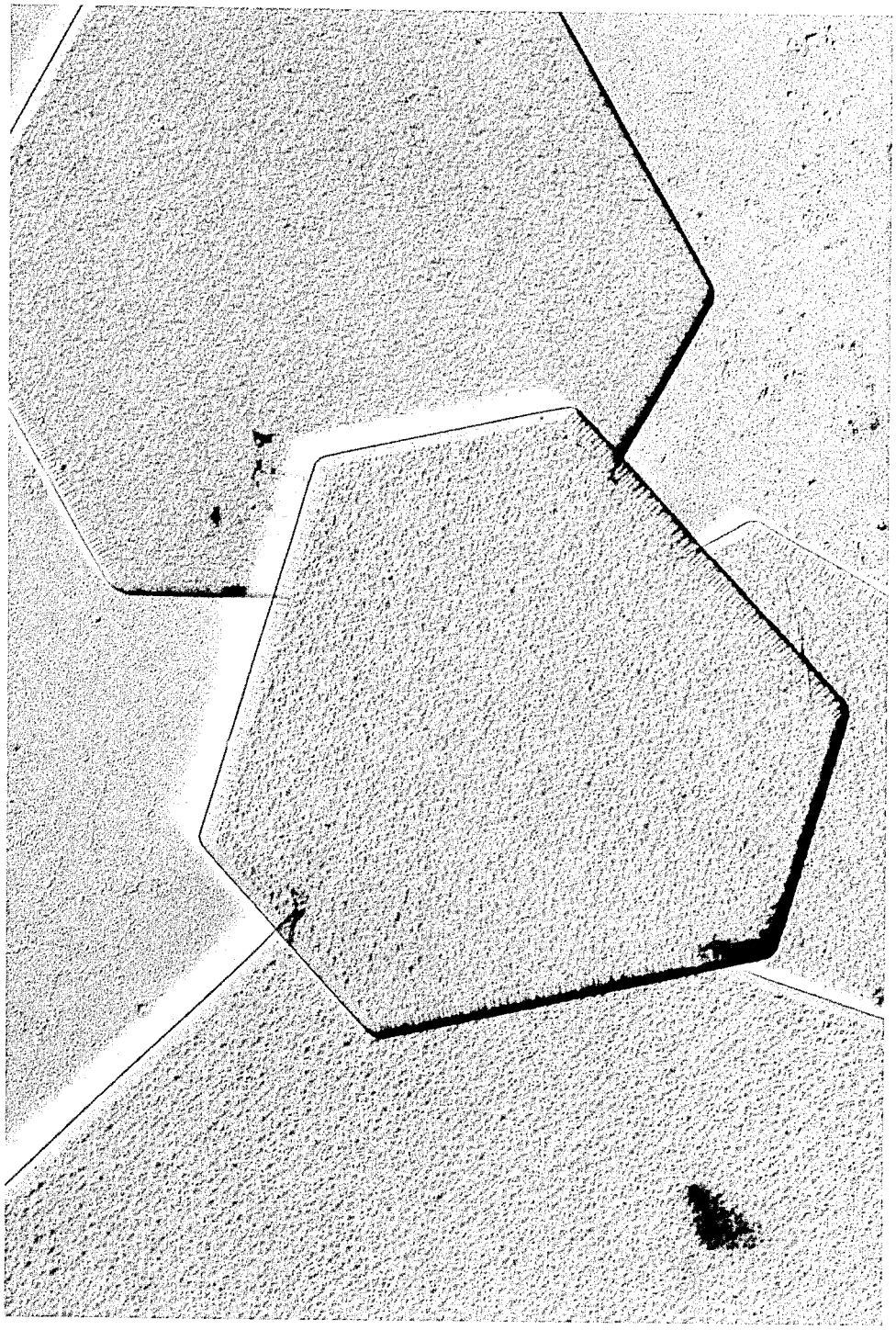
Figure 23C:
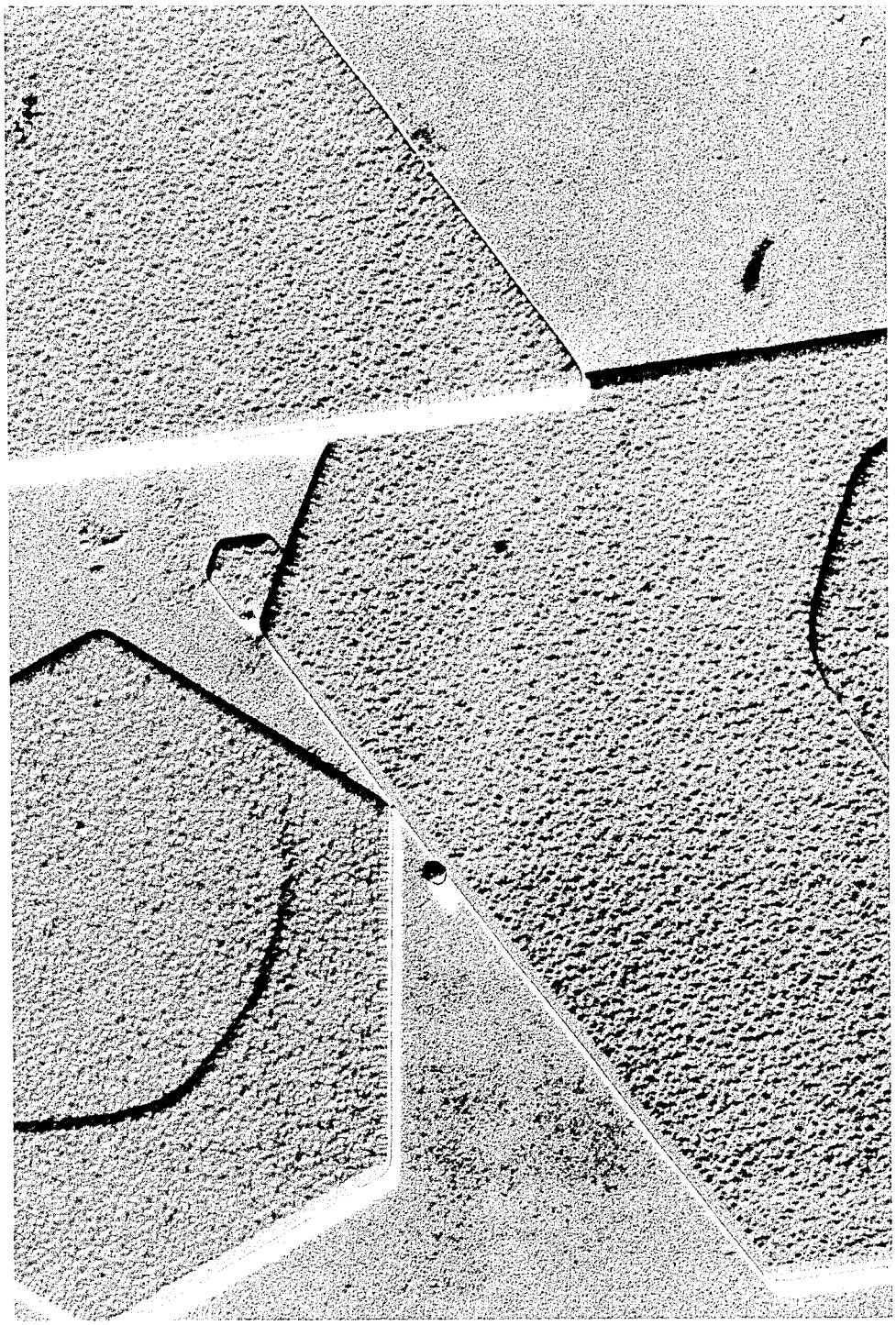

FIGS. 23A, B, and C show electron micrographs of the resulting grains. In Example 6A, addition of the growth modifier after the precipitation resulted in no growth of ruffles on the host emulsion grains. Example 6B, with the same amount of growth modifier added prior to the precipitation, produced uniform, closely arranged, small ruffles. Example 6C, with a higher level of growth modifier, produced a similar result, but with slightly better defined ruffles (pyramids).

Measurement was made of the interfacial angle of a ruffle on an electron micrograph of Example 6C in order to determine the crystallographic form. The angle between the face vectors was found to be 35°. The theoretical angle between {211} vectors is 33.6°. The form was therefore {211} icositetrahedral. This is consistent with other observations of {211} icositetrahedra being formed starting with nontabular host grains and employing Compound V as a growth modifier.

EXAMPLE 7

Example 7 again illustrates the preparation of ruffled tabular grain silver bromoiodide emulsions using Compound V (Example 5) as the growth modifier, but shows the dependence of the result on the level of growth modifier added.

The host emulsion (0.05 mole for each experiment) and the precipitation conditions were as described in Example 6. The details of the experiments are shown in Table IV.

TABLE IV

| Example 7 Precipitations | | |
|---|---|---|
| Example | FIG. No | Cpd. V mmole/ Ag mole |
| 7A | 24A | 0 |
| 7B | 24B | 0.75 |
| 7C | 24C | 1.5 |
| 7D | 24D | 3.0 |

Figure 24A:
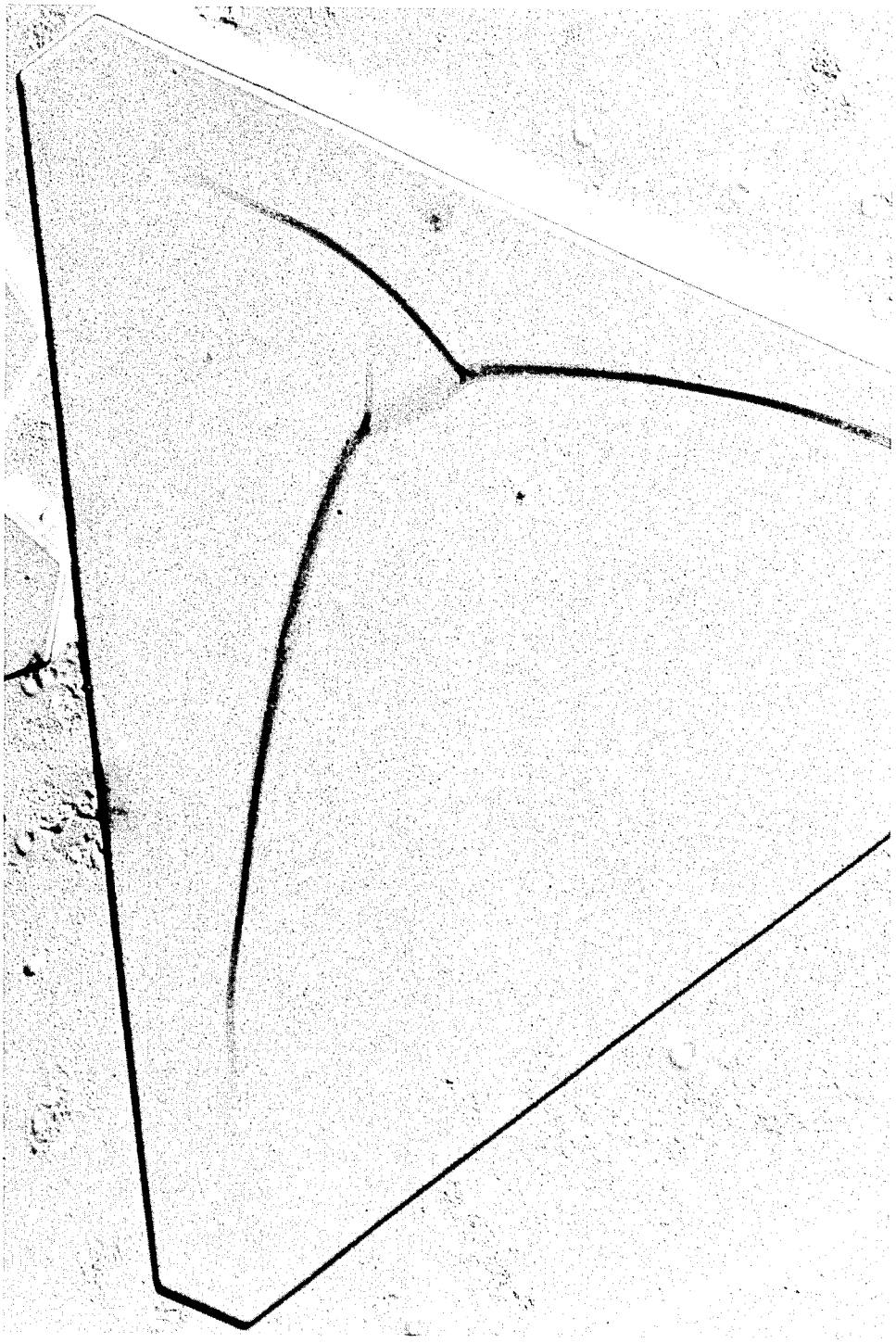
Figure 24B:
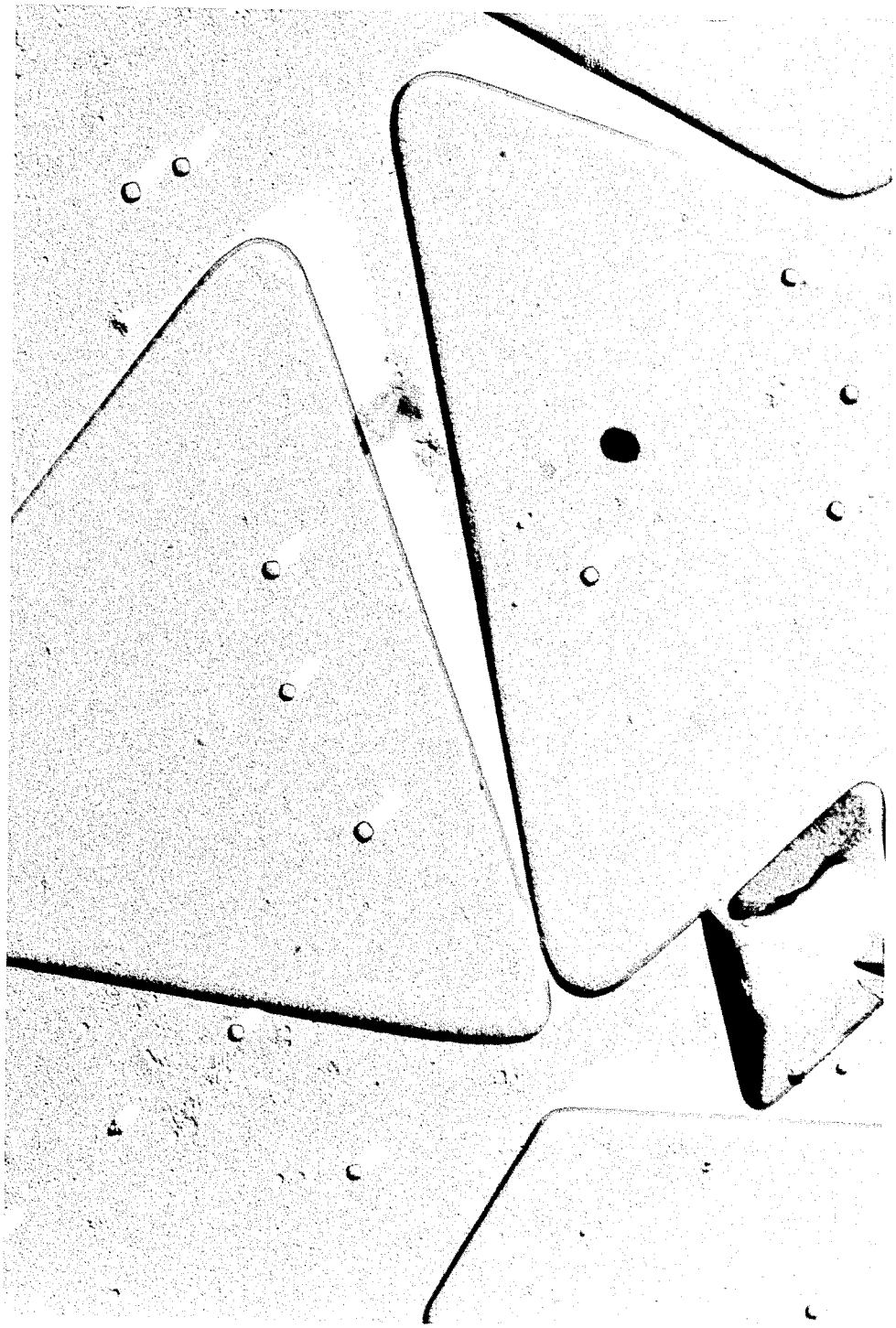
Figure 24C:
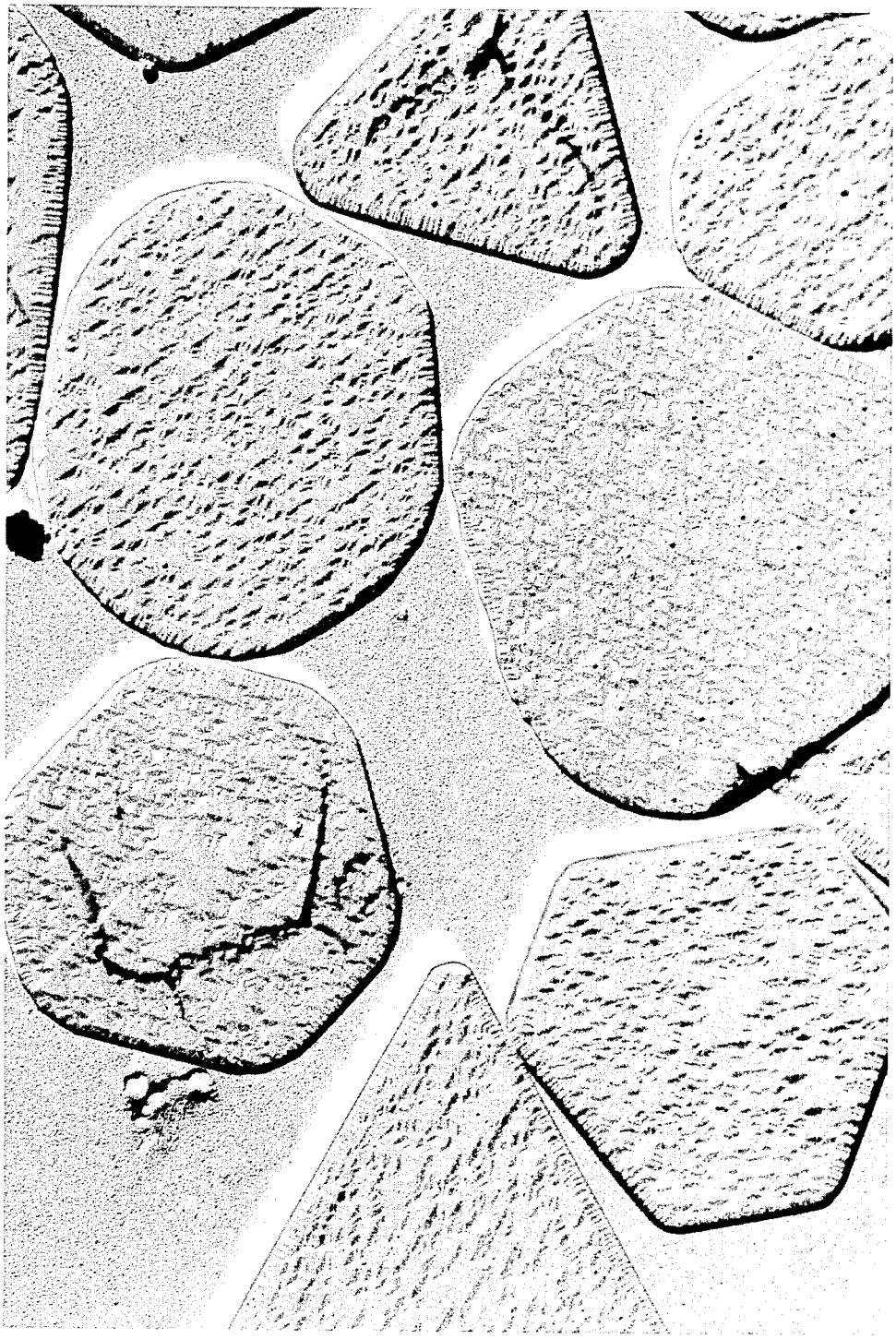
Figure 24D:
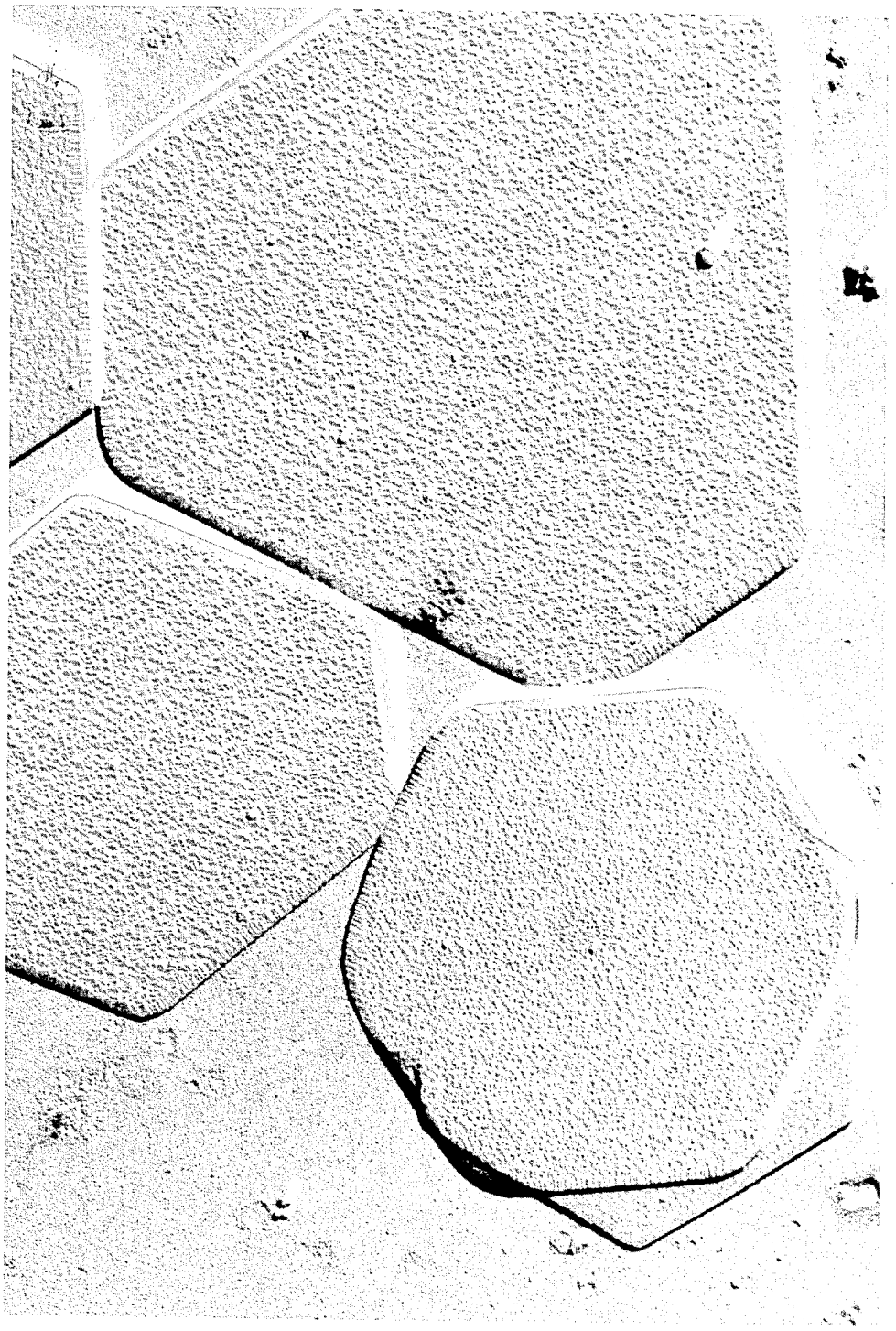

FIGS. 24A, B, C, and D are electron micrographs of the resulting emulsion grains. Example 7A, without growth modifier, and 7B, with 0.75 millimole/Ag mole, showed no ruffles. At 1.5 millimole, relatively large truncated pyramids appeared, as shown in FIG. 24C. At 3.0 millimoles Example 7D produced uniform, closely arranged, small ruffles. The pyramidal crystal faces were consistent with the {211} crystal faces expected from using Compound V as a growth modifier in the previous examples.

EXAMPLE 8

Emulsion Example 8 illustrates the preparation of a ruffled tabular grain silver bromide emulsion using as growth modifier Compound XIII, anhydro-3,9-diethyl-5,5',6'-trimethoxy-3'-(3-sulfopropyl)thiacarbocyanine hydroxide, which is a red spectral sensitizing dye.

To a reaction vessel supplied with a stirrer was added 0.05 mole of Host Grain Emulsion 2. Water was added to make the total volume 50 mL. To the emulsion at 40° C. was added 5 millimole/initial Ag mole of Compound XIII dissolved in 3 mL of N,N-dimethylformamide. The pH was adjusted to 6.0 at 40° C. The pAg was adjusted to 7.6 at 40° C. and maintained at that value during the precipitation. A 2.0M solution of $AgNO_3$ was introduced at a constant rate over a period of 10 min while a 2.0M solution of KBr was added as needed to hold the pAg constant. A total of 0.02 mole Ag was added.

Figure 25:
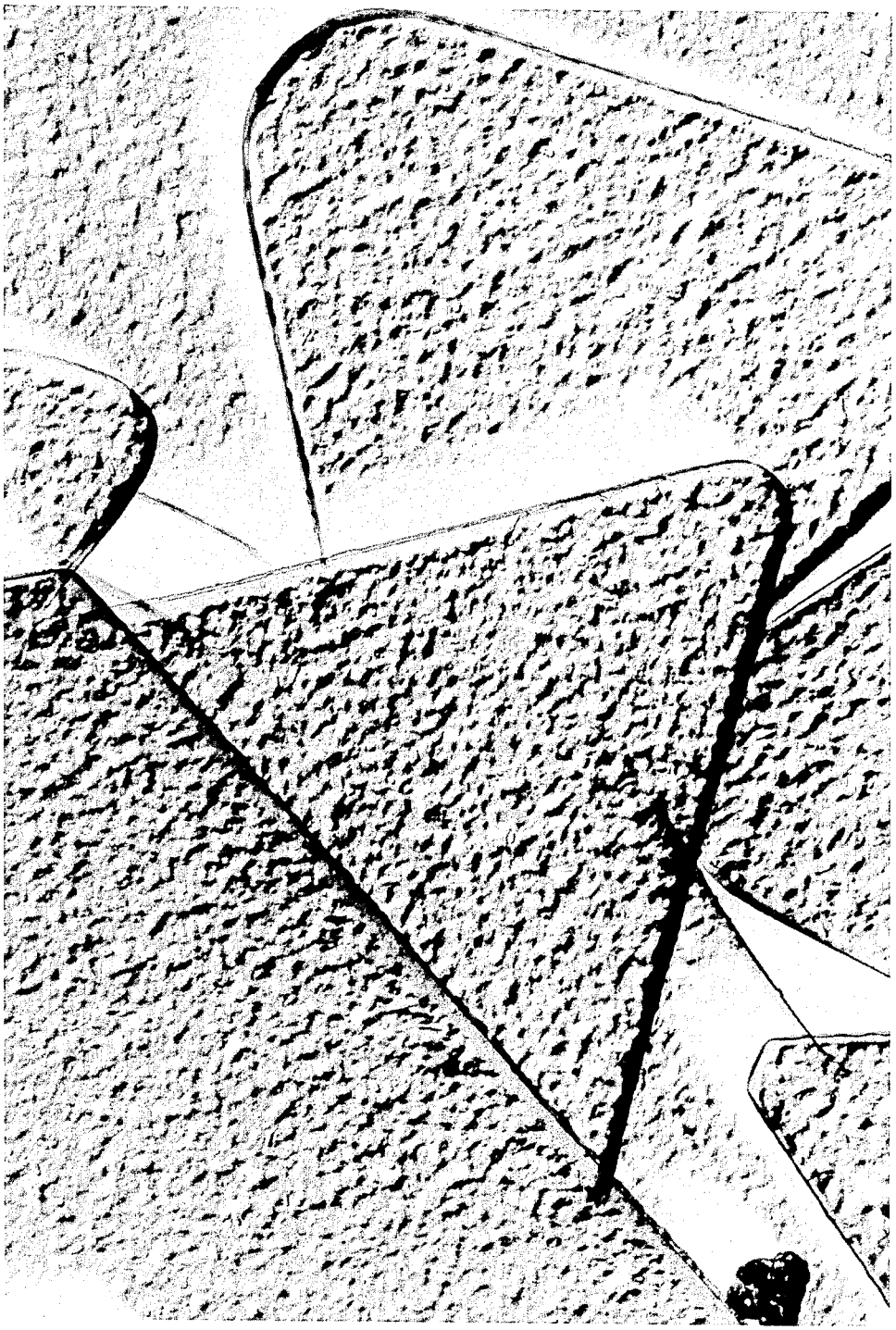

FIG. 25 is an electron micrograph of the resulting emulsion grains. Closely arranged ruffles are uniformly distributed over the faces of the tabular grains.

EXAMPLE 9

The emulsions of Example 9 illustrate the preparation of ruffled silver bromide tabular grains by physical ripening in the presence of a fine grain silver bromide emulsion and a growth modifier.

EXAMPLE 9A

To a reaction vessel supplied with a stirrer was added 0.015 mole of a freshly prepared fine grain silver bromide emulsion of mean grain size 0.02 μm, containing 167 g/Ag mole gelatin and having a weight of 65 g. To the emulsion at 40° C. was added 0.18 millimole (6 millimole/Ag mole of host emulsion) of Compound VII, 4-hydroxy-6-methyl-1,2,3a,7-tetraazaindene, a known antifoggant and stabilizer, dissolved in 2.5 mL water and 2 drops of triethylamine. Host Grain Emulsion 2 in the amount of 0.03 mole, made up to 25 g, was then added. The pH was adjusted to 6.0 at 40° C., and the pAg to 9.3 at 40° C. The mixture was then heated at 60° C. for 4 hr.

Figure 26A:
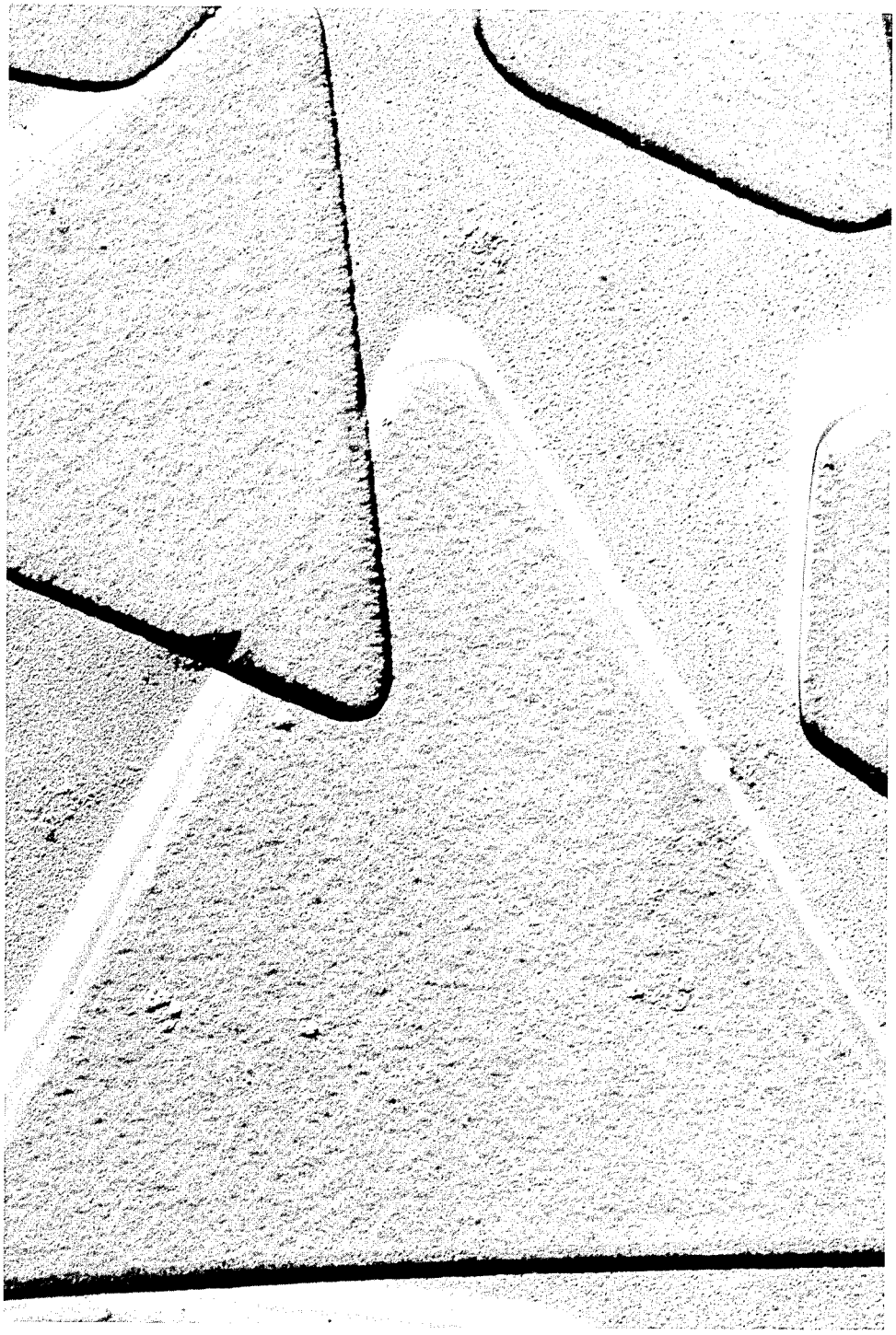

FIG. 26A is an electron micrograph showing the fairly uniform, closely arranged ruffles which resulted. The ruffles were made up of pyramidal crystal faces of the {110} (rhombic dodecahedral) crystallographic form.

EXAMPLE 9B

Emulsion Example 9B was prepared as described for Example 9A, but with growth modifier Compound VIII, 4-hydroxy-6-methyl-2-methylthio-1,3,3a,7-tetraazaindene, a known antifoggant and stabilizer, dissolved in 2 mL water and 2 drops of triethylamine.

Figure 26B:
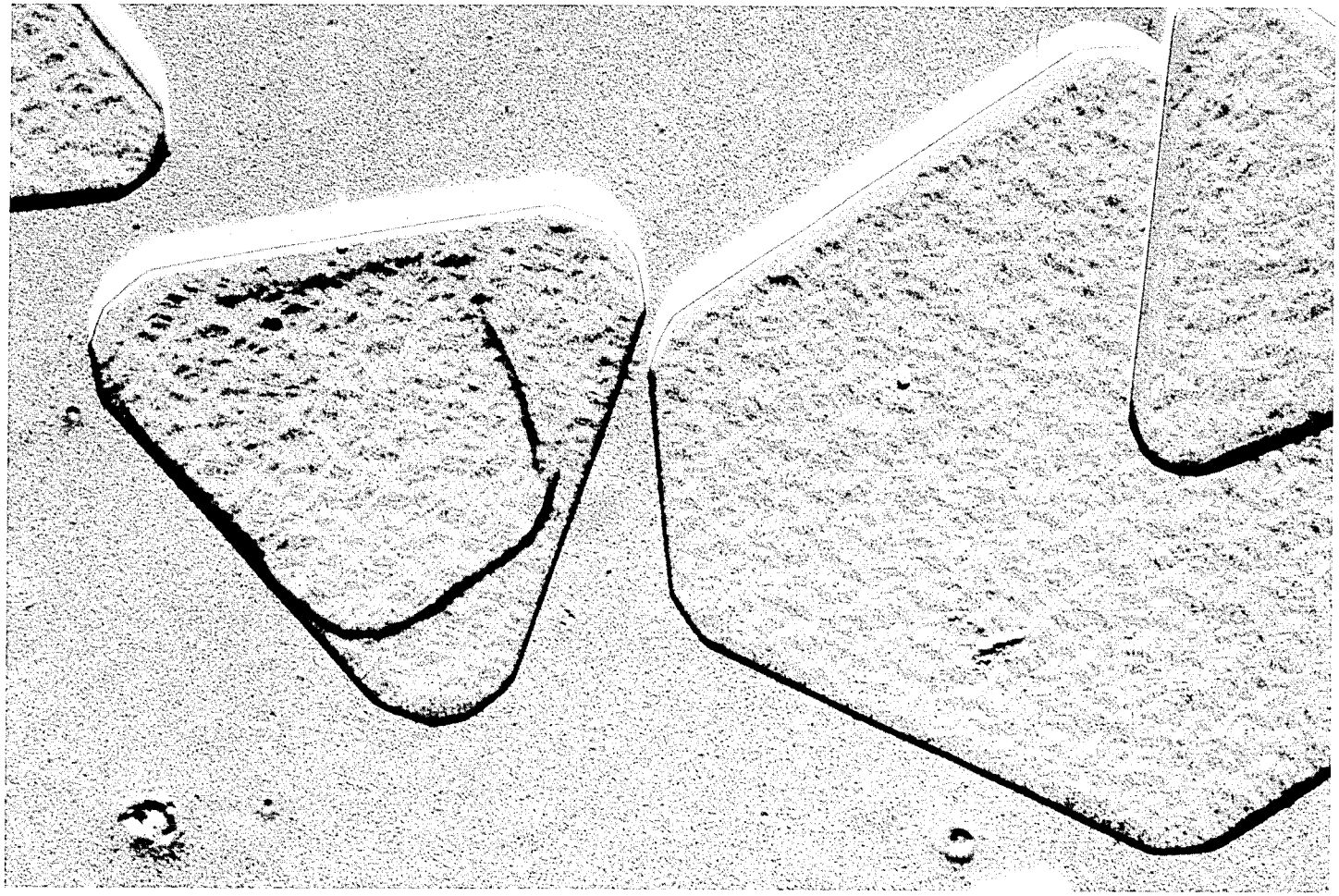

FIG. 26B is an electron micrograph showing the relatively large and closely arranged ruffles which resulted. The ruffles were made up of pyramidal crystal faces of the {211} icositetrahedral crystallographic form.

EXAMPLE 9C

Emulsion Example 9C was prepared as described for Example 9A, but with Compound V as growth modifier, dissolved in 6 mL N,N-dimethylformamide, 2 mL water, and 2 drops triethylamine.

Figure 26C:
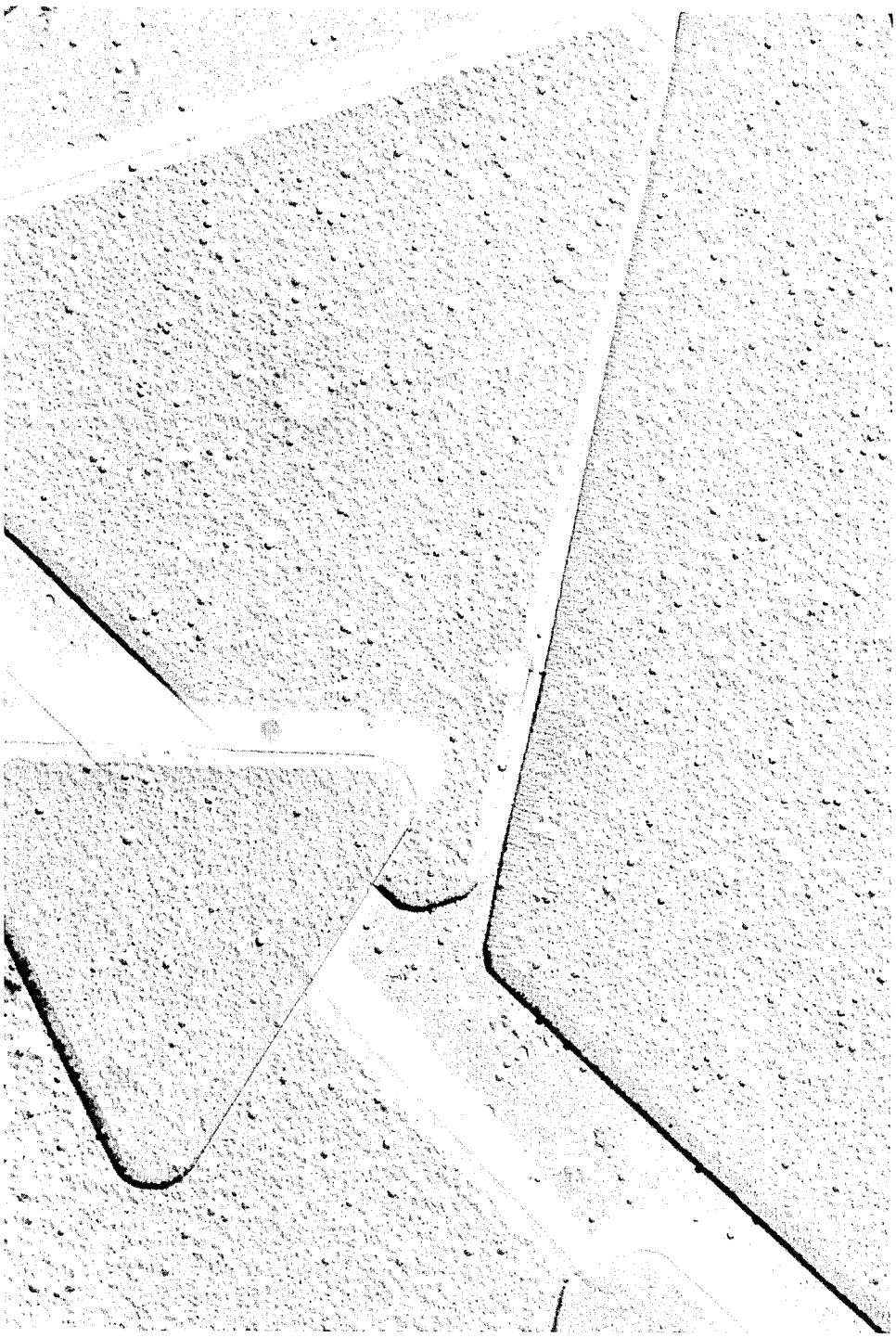

FIG. 26C is an electron micrograph showing the uniform closely arranged ruffles which resulted. The pyramidal crystal faces were consistent with the {211} crystal faces expected from using Compound V as a growth modifier in the previous examples.

EXAMPLE 9D

Emulsion Example 9D was prepared as described for Example 9A, using Compound IX, 5-imino-3-thiourazole, as a growth modifier, dissolved in 2 mL N,N-dimethylformamide.

Figure 26D:
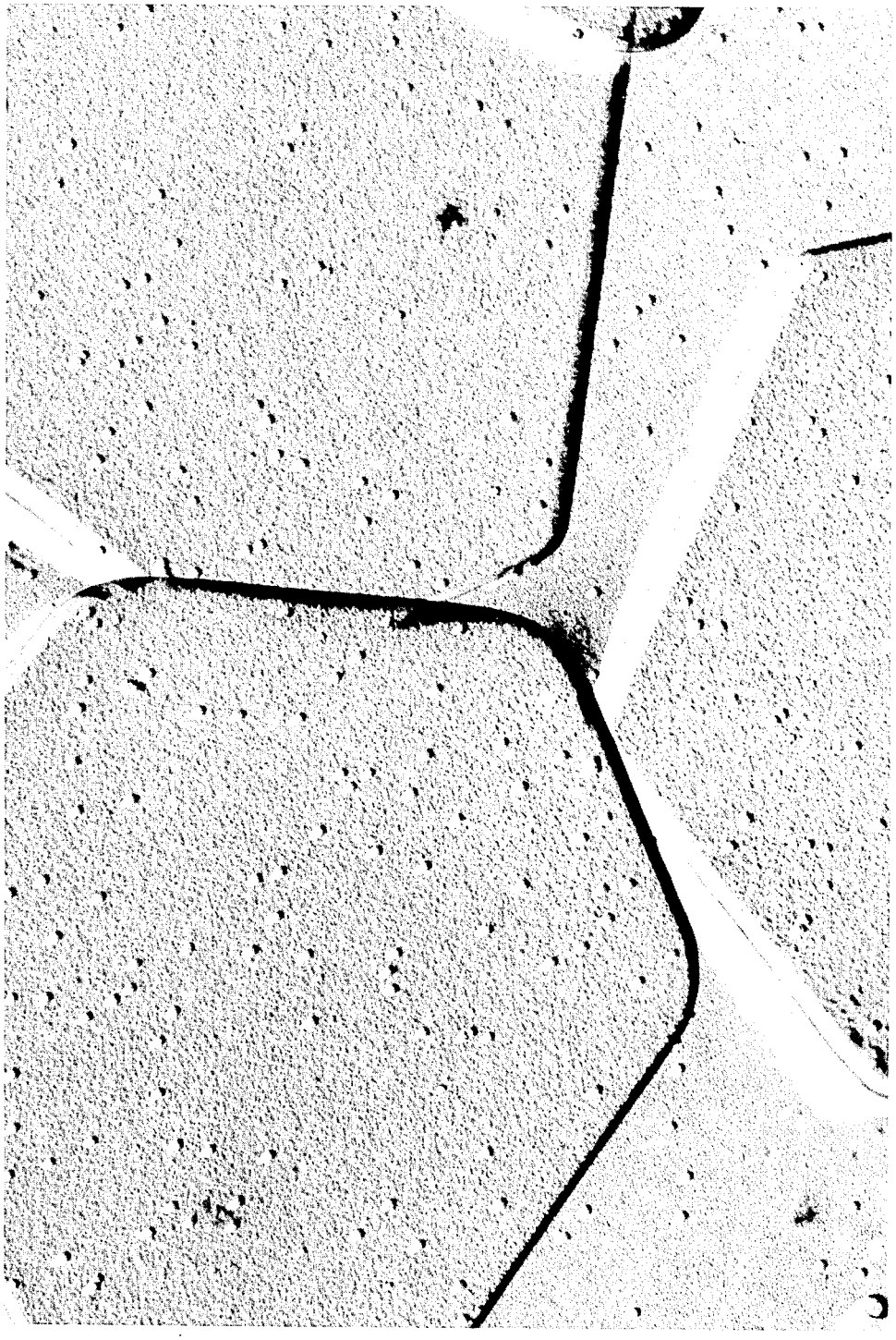

FIG. 26D is an electron micrograph showing the resulting uniform, closely arranged ruffles which resulted. The ruffles were made up of pyramidal crystal faces of the {110} (rhombic dodecahedral) crystallographic form.

EXAMPLE 9E

To a reaction vessel supplied with a stirrer was added 0.0667 mole of Host Grain Emulsion 2. This was mixed with 0.033 mole of a 0.05 μm silver bromide emulsion, containing 56 g/Ag mole gelatin and which had been precipitated in the presence of 10 millimole/Ag mole of Compound X, 4-hydroxy-6-methyl-1,3,3a,7-tetraazaindene, sodium salt, a known antifoggant and stabilizer. The emulsion mixture was made up to 100 g with water. The pH was adjusted to 6.2 at 40° C., and the pAg to 9.3 at 40° C. The mixture was then heated at 60° C. for 4 hr.

Figure 26E:
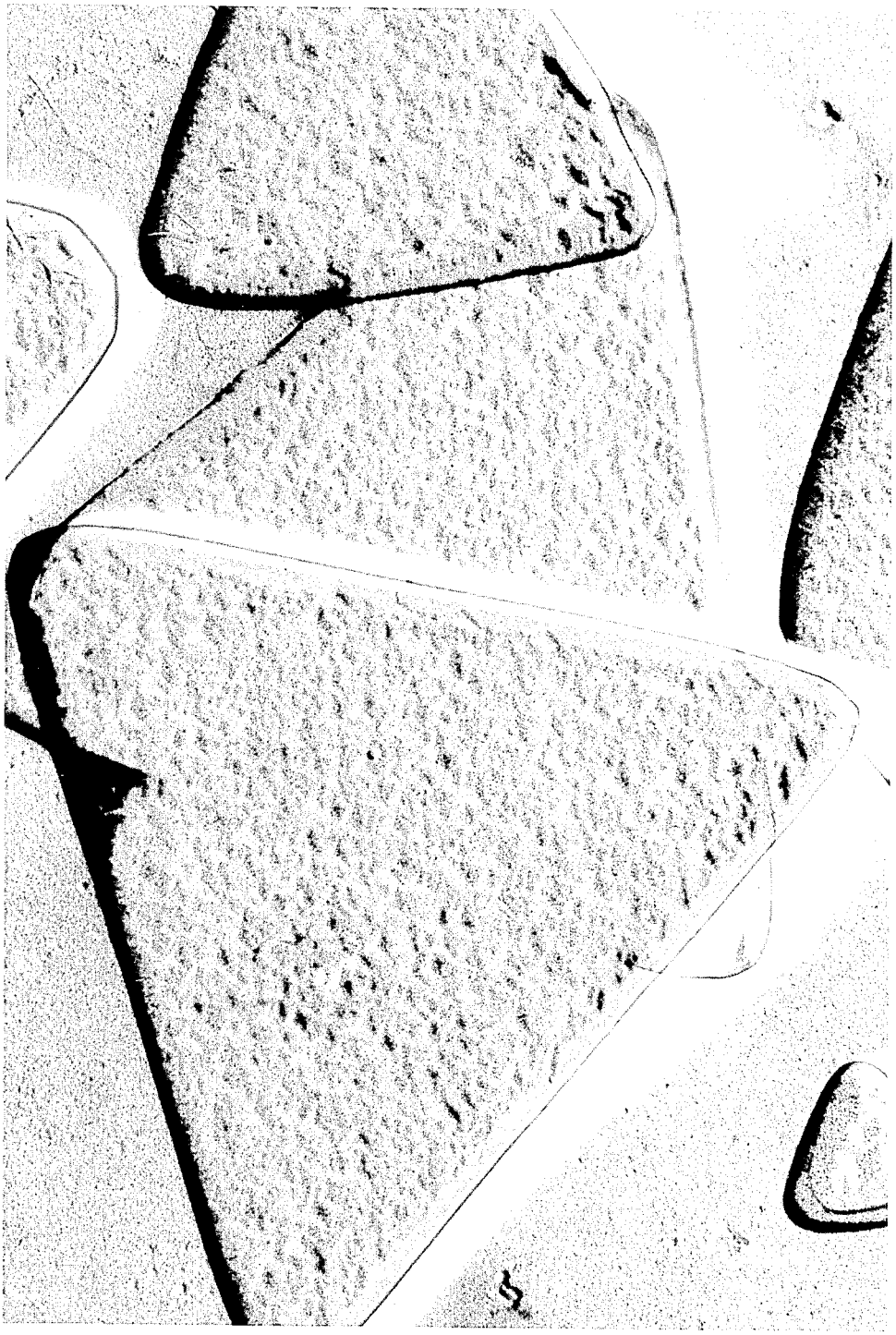

FIG. 26E is an electron micrograph showing the rather large ruffles which resulted. The ruffles were made up of pyramidal crystal faces of the {331} trisoctahedral crystallographic form.

EXAMPLE 10

Emulsion Example 10 illustrates the preparation of a ruffled octahedral silver bromide emulsion using Compound I as a growth modifier.

To a reaction vessel supplied with a stirrer was added 0.05 mole of an octahedral regular grain silver bromide emulsion of mean grain size 1.35 μm containing 40 g/Ag mole gelatin. Water was added to make the total weight 50 g. To the emulsion at 40° C. was added 6.0 millimole/initial Ag mole of Compound I dissolved in 2 mL of 1:1 1 water-methanol. The emulsion was then held for 15 min at 40° C. The pH was adjusted to 6.0 at 40° C. The temperature was raised to 60° C. and the pAg adjusted to 8.5 at 60° C. with KBr and maintained at that value during the precipitation. A 2.5M solution of $AgNO_3$ was introduced at a constant rate over a period of 40 min while a 2.5M solution of KBr was added as needed to hold the pAg constant. A total of 0.02 mole Ag was added.

Figure 27:
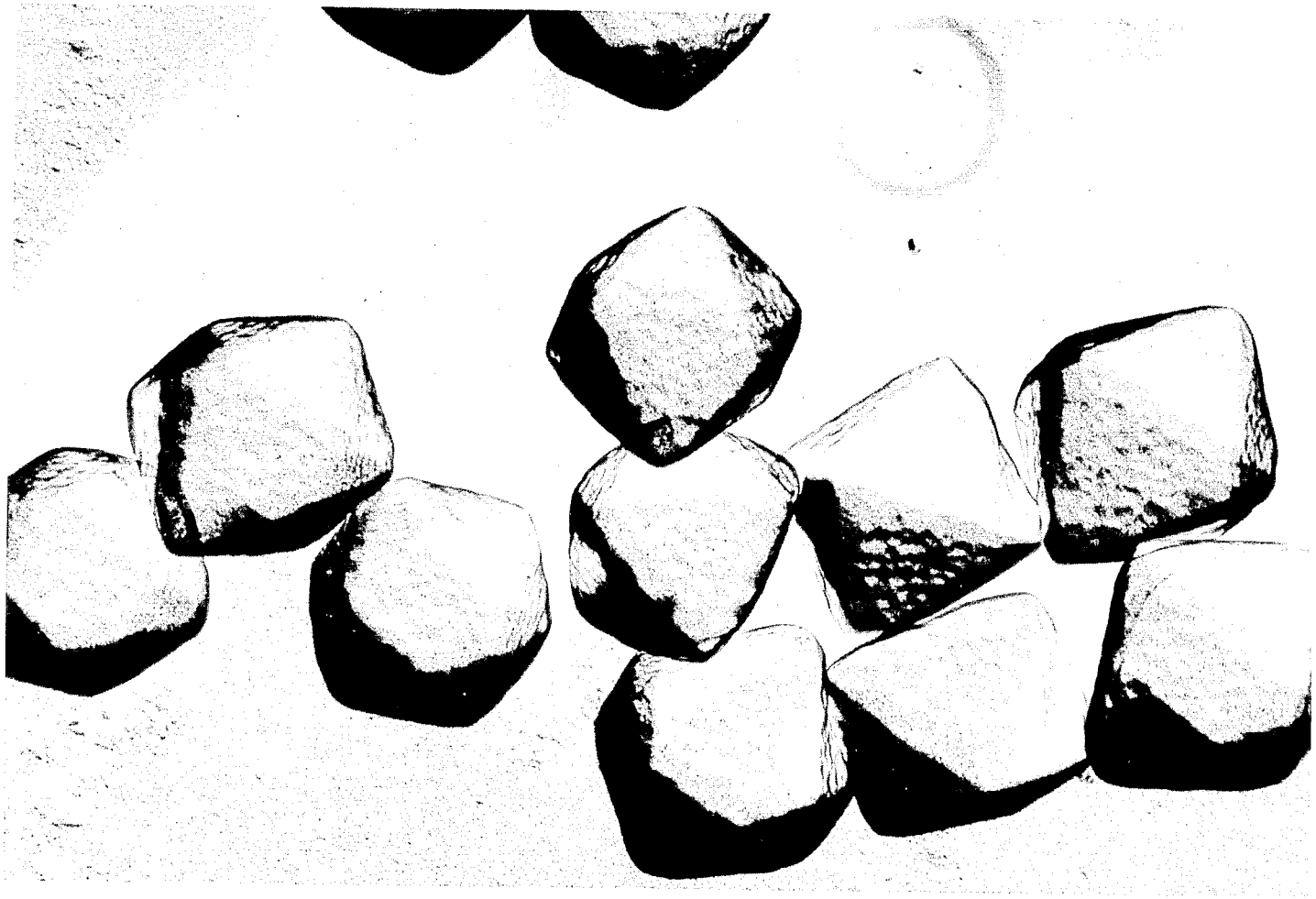

An electron micrograph of the ruffled grains of the resulting emulsion is shown in FIG. 27.

EXAMPLE 11

Emulsion Example 11 illustrates the preparation of a ruffled octahedral silver bromide emulsion using Compound VII as a growth modifier. New faces formed indicate that in addition to forming ruffles growth of the host grains into rhombic dodecahedral form has commenced.

To a reaction vessel supplied with a stirrer was added 0.05 mole of an octahedral regular grain silver bromide emulsion of mean grain size 0.8 μm and containing about 10 g/Ag mole gelatin. Water was added to make the total weight 50 g. To the emulsion at 40° C. was added 6.0 millimole/initial Ag mole of Compound VII dissolved in 3 mL methanol and 3 drops triethylamine. The emulsion was then held for 15 min at 40° C. The temperature was raised to 50° C. and the pH adjusted to 6.0 at 50° C. The pAg was adjusted to 8.8 at 50° C. with KBr and maintained at that value during the precipitation. A 2.0M solution of $AgNO_3$ was introduced at a constant rate over a period of 70 min while a 2.0M solution of KBr was added as needed to hold the pAg constant. A total of 0.014 mole Ag was added.

Figure 28:
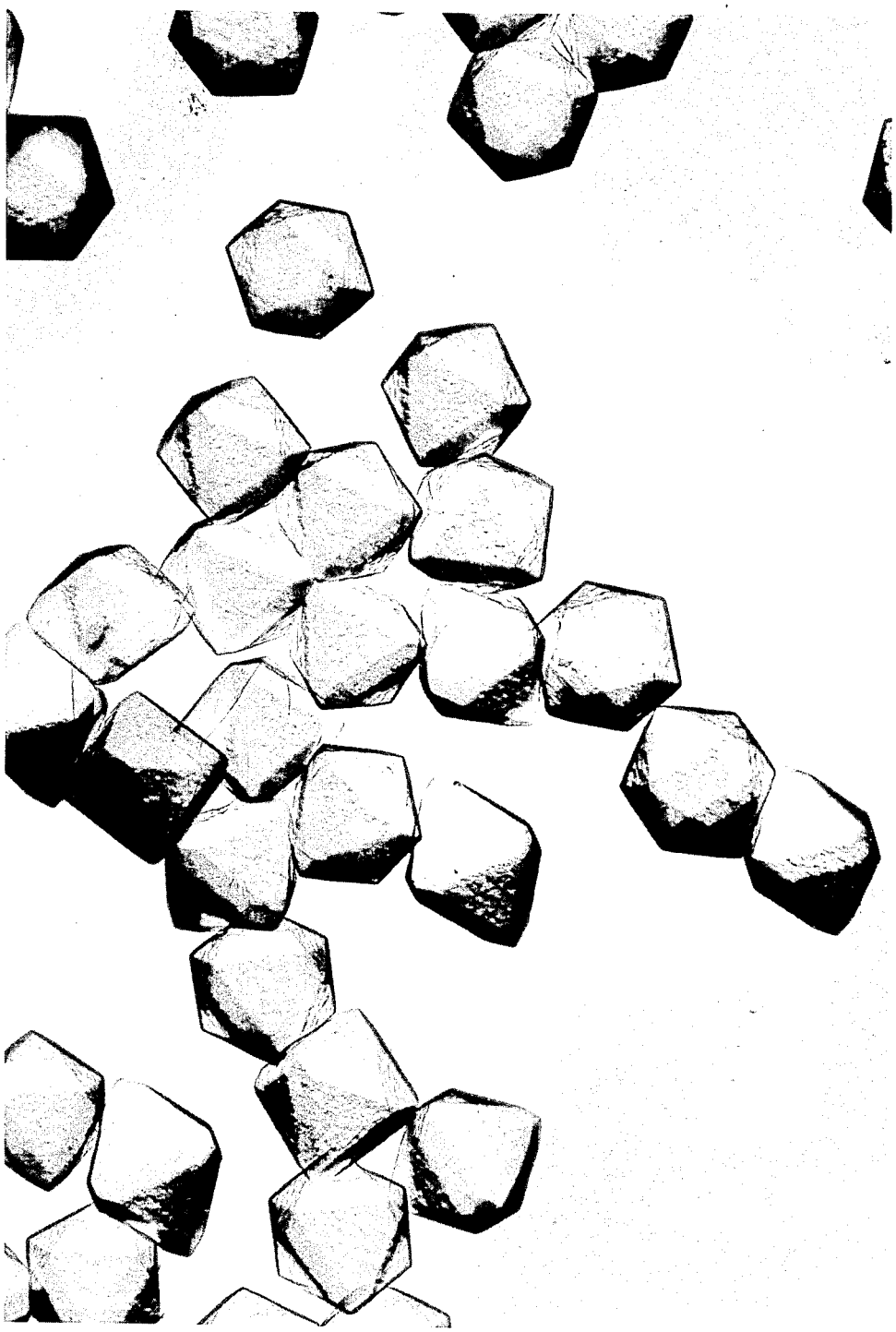

An electron micrograph of the resulting emulsion grains is shown in FIG. 28. The octahedral faces of the host grains appeared to be uniformly ruffled. In addition, new faces have begun to form along the edges between the octahedral faces, indicating that the crystals are growing into {110} rhombic dodecahedra.

EXAMPLE 12

Emulsion Example 12 illustrates the preparation of a ruffled octahedral silver bromide emulsion using Compound X as growth modifier. As the precipitation continued, the formation of trisoctahedra became evident.

The host emulsion and procedure was the same as in Example 10. The growth modifier was 6.0 millimole/Ag mole of Compound X dissolved in 3 mL of water. For Example 12A the precipitation time was 15 min, using 0.0075 mole Ag. For Example 12B the precipitation time was 30 min, using 0.015 mole Ag.

Figure 29A:
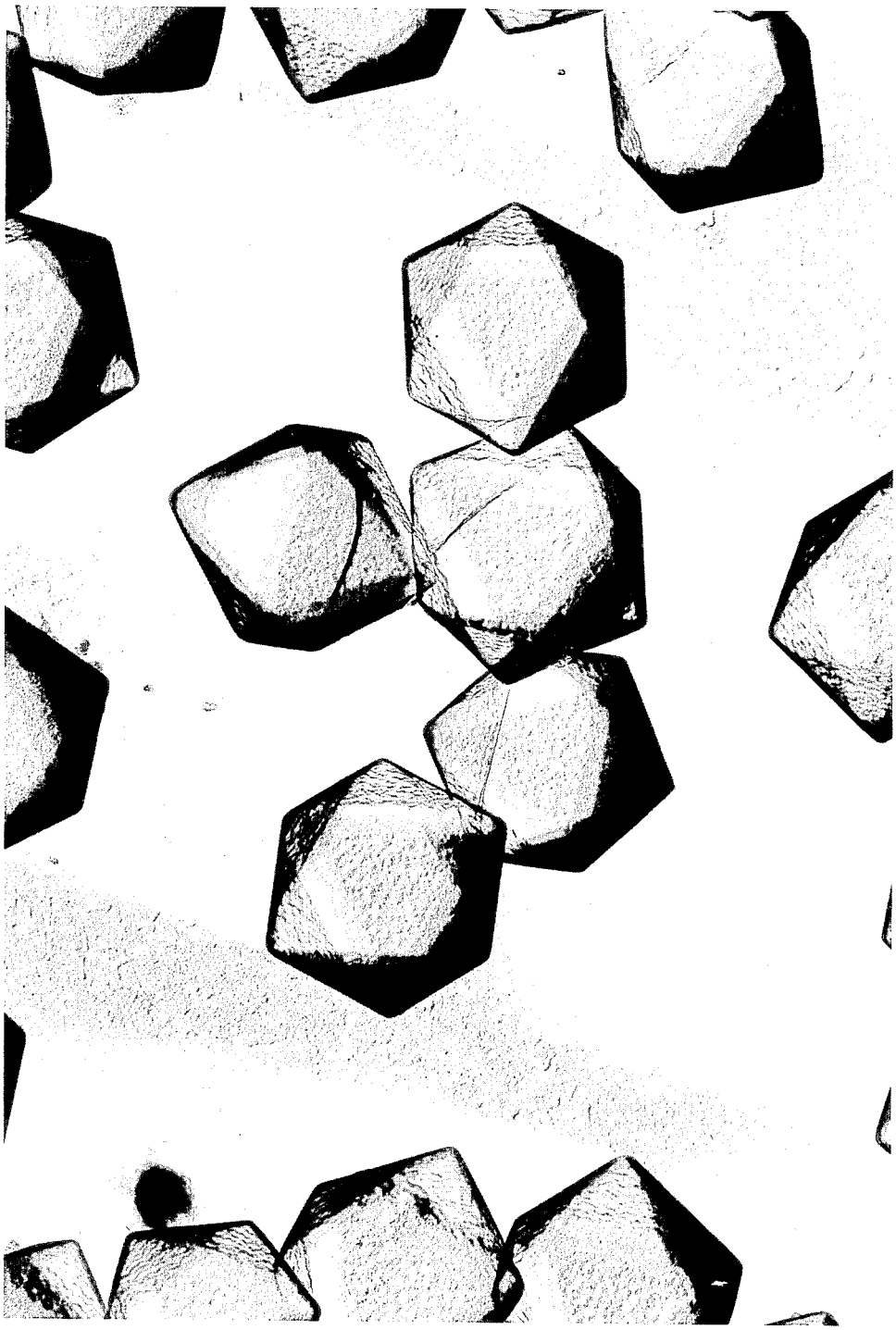
Figure 29B:
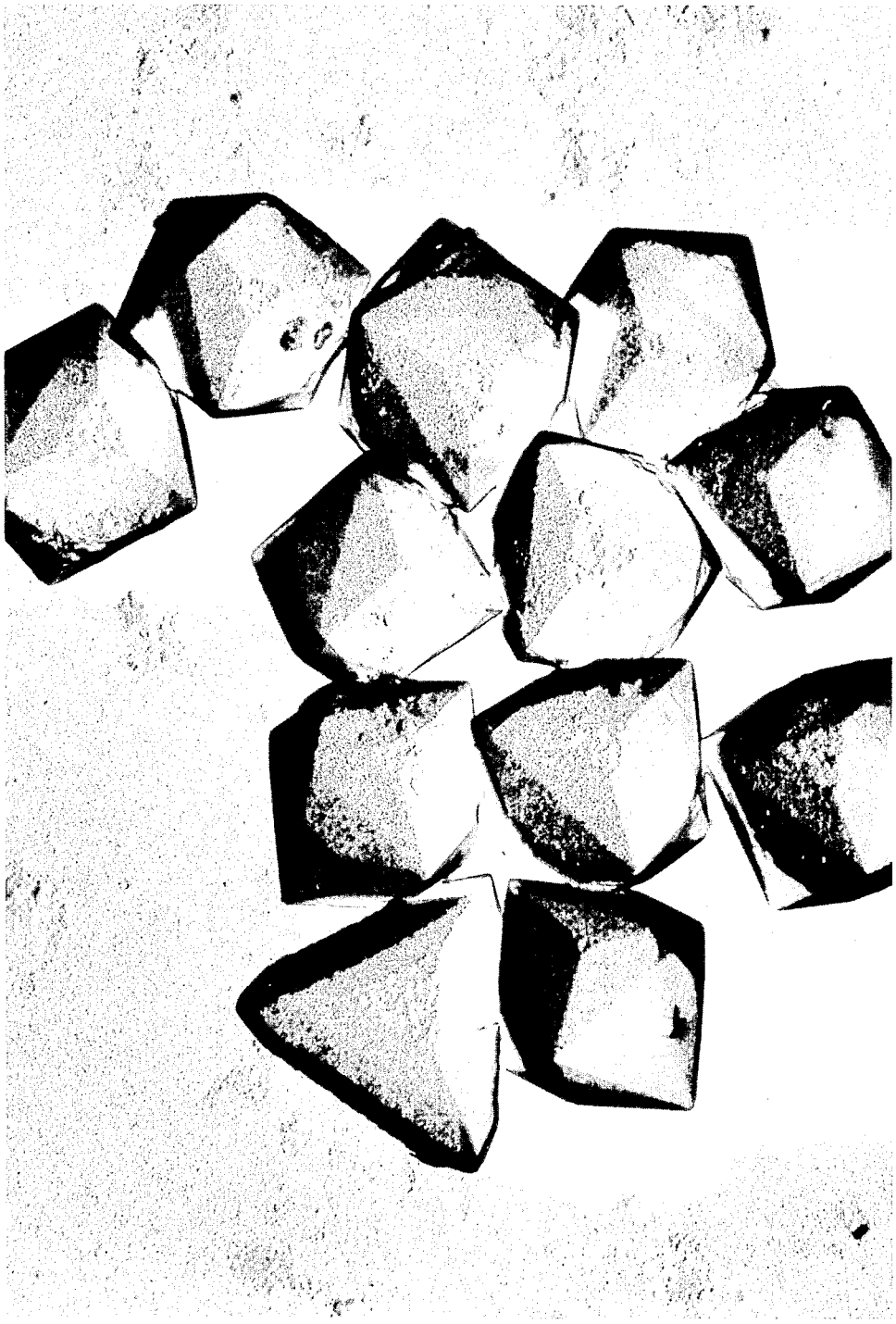

FIGS. 29A and 29 B are electron micrographs showing the resulting emulsion grains of Examples 12A and 12B, respectively. In Example 12A uniform ruffles formed over the octahedral faces, while new trisoctahedral faces formed along the edges between the original faces. In Example 12B the process of forming {331} trisoctahedra is almost complete.

EXAMPLE 13

Emulsion Example 13 illustrates the formation of octahedral silver bromide emulsions which have their surface area increased by ruffles in the form of uniform ridges.

The host emulsion and procedure was the same as in Example 10. The growth modifier was 2.0 millimole/initial Ag mole of Compound XI, a known green spectral sensitizing dye, dissolved in 3 mL methanol, 2 mL water and 3 drops of triethylamine. The precipitation solutions were 2.0M rather than 2.5M $AgNO_3$ and KBr.

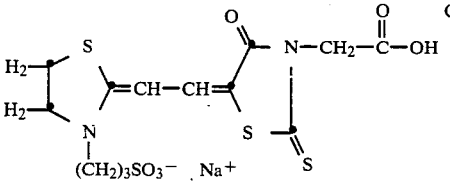

For Example 13A the precipitation time was 200 min, using 0.04 mole Ag. For Example 13B the time was 350 min, using 0.07 mole Ag.

Figure 30A:
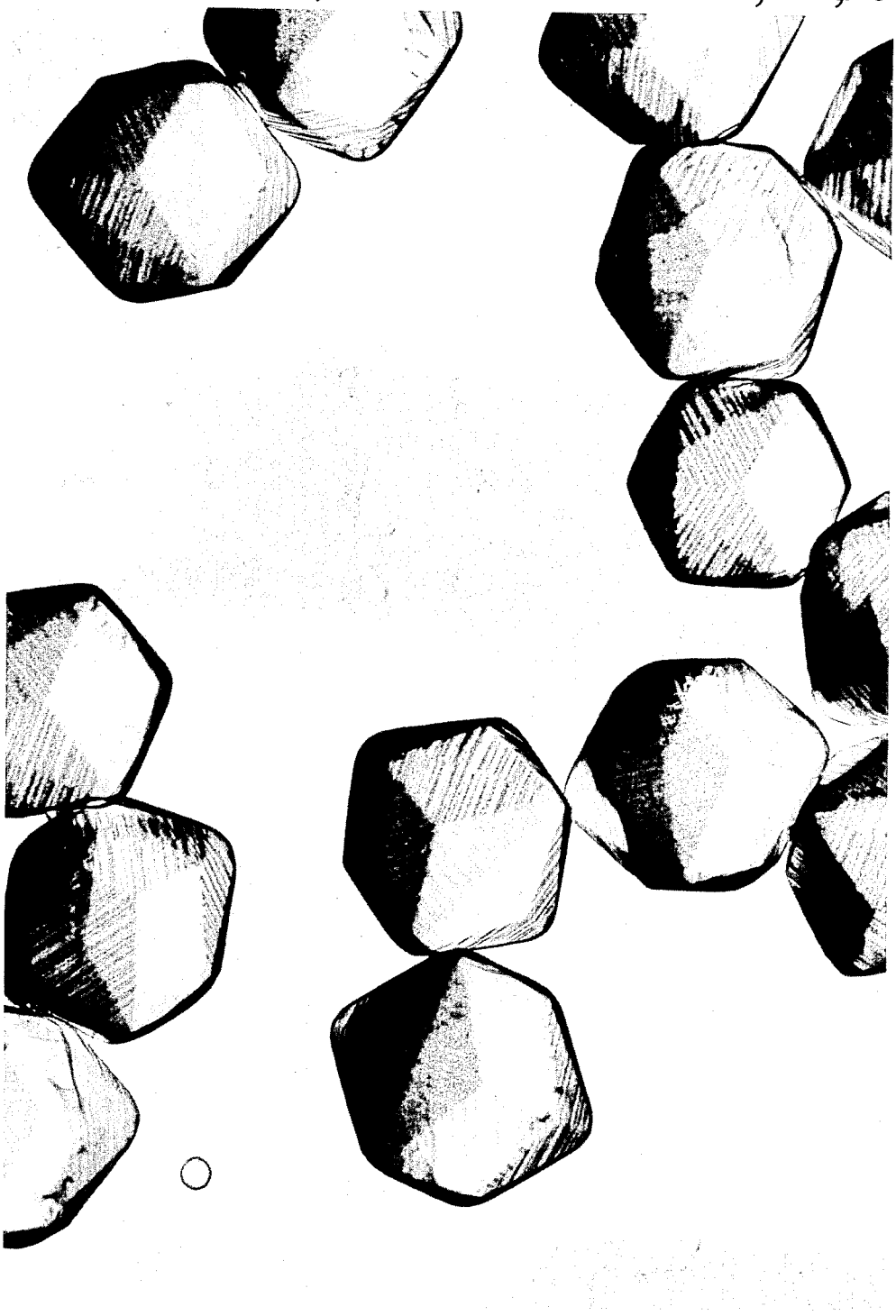
Figure 30B:
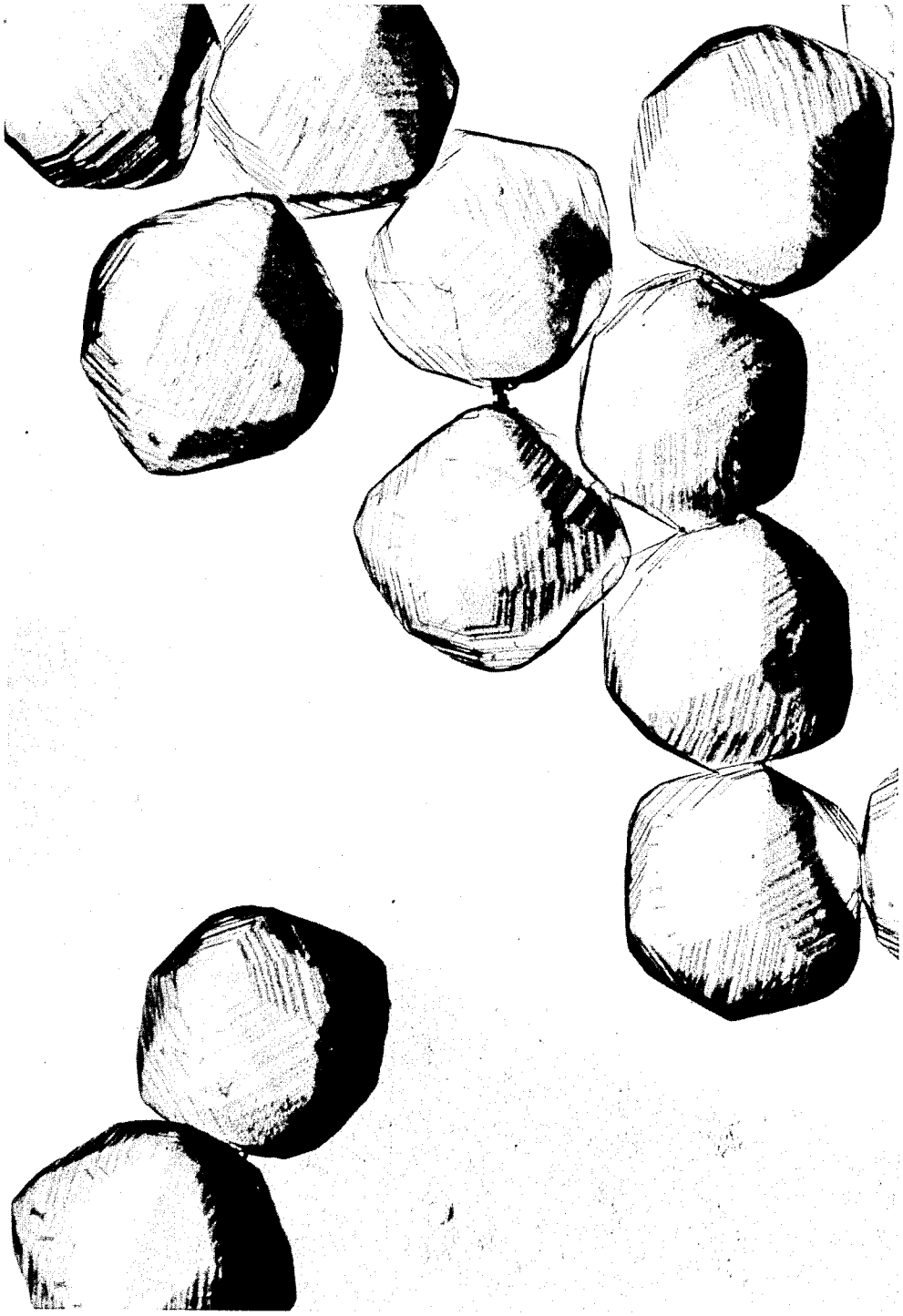

FIGS. 30A and 30 B are electron micrographs of the resulting emulsion grains produced by Examples 13A and 13B, respectively. The faces are uniformly covered with ridges running in a direction perpendicular to the (110) Ag rows of the lattice. Trisoctahedral faces have begun to form. In Example 13B the ridges remain evident, while the macro habit has become {331} trisoctahedral.

EXAMPLE 14

Example 14 illustrates the preparation of ruffled cubic silver bromide grains using Compound XII, 2-mercaptoimidazole as a growth modifier. Continued growth results in icositetrahedral grains.

To a reaction vessel supplied with a stirrer was added 0.05 mole of a cubic regular grain silver bromide emulsion of mean grain size 0.8 μm, containing about 10 g/Ag mole gelatin. Water was added to make the total weight 50 g. To the emulsion at 40° C. was added 3.0 millimole/Ag mole of Compound XII dissolved in 3 mL methanol. The emulsion was then held for 15 min at 40° C. The pH was adjusted to 6.0 at 40° C. The temperature was raised to 60° C., and the pAg adjusted to 8.5 at 60° C. with KBr and maintained at that value during the precipitation. A 2.5M solution of $AgNO_3$ was added at a constant rate over a period of 25 min while a 2.5M solution of KBr was added as needed to hold the pAg constant. A total of 0.0125 mole Ag was added to form Example 14A. For Example 14B the precipitation was continued for a total of 175 min, using a total of 0.0875 mole Ag. An additional 3 millimole/initial Ag mole of Compound XII was added after 100 min of precipitation time.

Figure 31A:
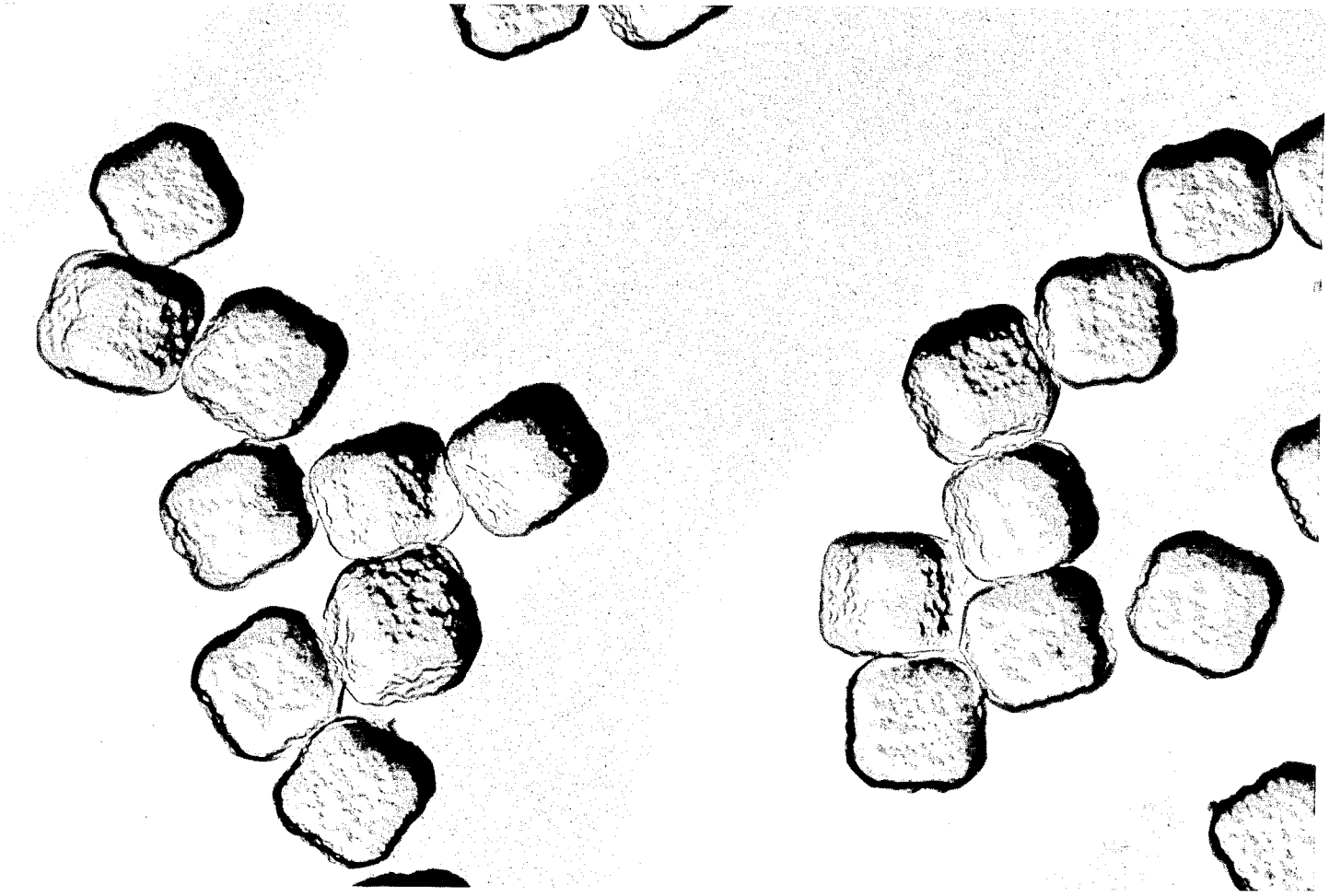
Figure 31B:
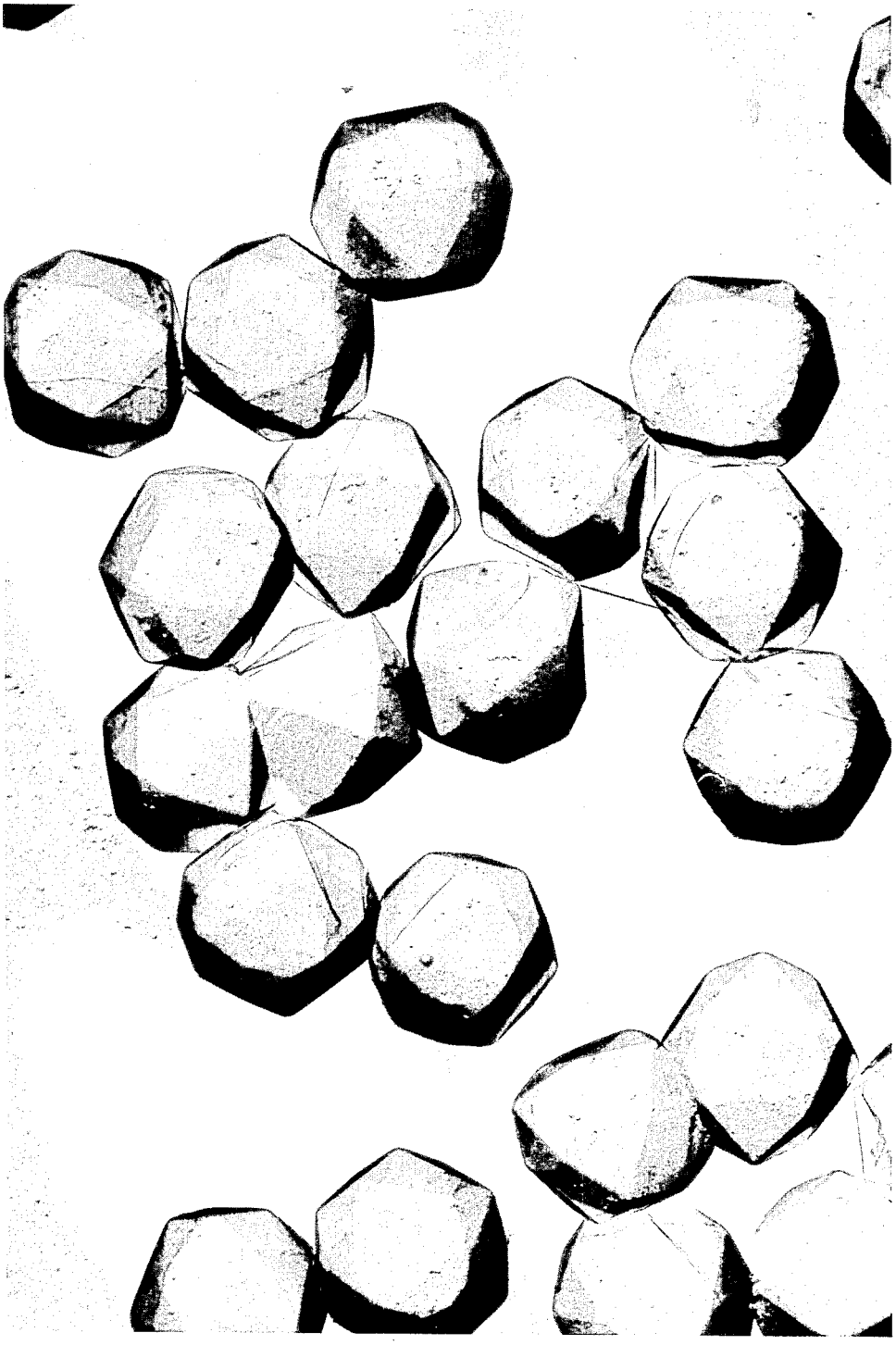

FIGS. 31A and 31B are electron micrographs of the resulting emulsion grains produced by Examples 14A and 14B, respectively. FIG. 31A shows a pattern of growths covering the crystal faces. FIG. 31B illustrates the formation of {533} icositetrahedral grains with continued precipitation.

EXAMPLE 15

Example 15 illustrates the preparation of a ruffled cubic silver bromide emulsion using Compound VIII under ammoniacal precipitation conditions.

To a reaction vessel supplied with a stirrer was added 0.05 mole of a cubic regular grain silver bromide emulsion of mean grain size 0.8 μm, containing about 10 g/Ag mole gelatin. An additional 10 g/Ag mole of deionized bone gelatin was added, and the whole made up to about 51 g with water. To the emulsion at 40° C. was added 6.0 millimole/initial Ag mole of Compound VIII dissolved in 3 mL of water and 3 drops of triethylamine. The emulsion was then held for 15 min at 40° C. Just before the start of precipitation, 1.0 mL of a 3.4M solution of $(NH_4)_2SO_4$, 1.75 mL of conc. $NH_4OH$ and 0.5 mL of a 0.50M solution of KBr were added. The pAg was found to be 9.1 at 40° C., and was maintained at that value during the precipitation. A 2.5M solution of $AgNO_3$ was introduced at a constant rate over a period of 100 min while a 2.5M solution of KBr was added as needed to hold the pAg constant. A total of 0.05 mole Ag was added.

Figure 32:
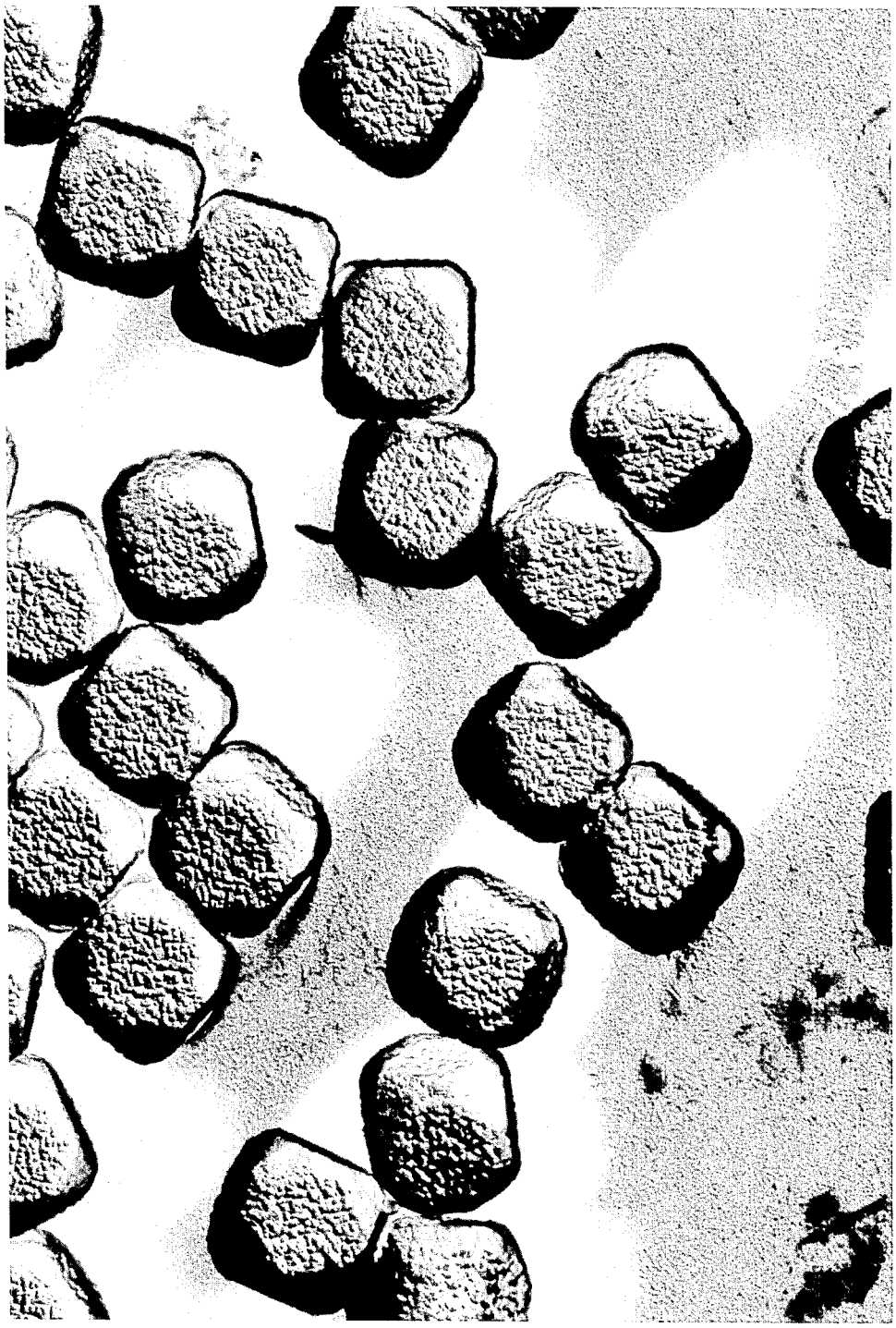

FIG. 32 is an electron micrograph of the resulting emulsion grains. The cubes are somewhat rounded with the cubic faces covered with uniform ruffles.

EXAMPLE 16

This example illustrates an increase in photographic speed which can be realized with ruffled grains according to the present invention.

EXAMPLE EMULSION 16A

A reaction vessel equipped with a stirrer was charged with 0.05 mole of an octahedral silver bromoiodide emulsion containing 6 mole % silver iodide, of mean grain size 0.3 μm and containing about 20 g/Ag mole gelatin. Water was added to make the total weight 50 g. The emulsion was heated to 40° C. A solution was prepared 0.625 millimole of growth modifier Compound V, a blue spectral sensitizing dye, in a solvent consisting of 12 mL water and 10 drops of triethylamine made up to 50 mL with N,N-dimethylformamide. A 15 mL portion of this solution containing 3.75 millimole/initial Ag mole of Compound V was added to the emulsion, which was then held for 15 minutes at 40° C. The pH was adjusted to 6.0 at 40° C. The temperature was raised to 60° C., and the pAg adjusted to 8.5 at 60° C. with KBr and maintained at that value during the precipitation. A 2.0M solution of $AgNO_3$ was introduced at a constant state over a period of 67 minutes, while a solution which was 1.88M in KBr and 0.12M in KI was added as needed to keep the pAg constant. A total of 0.013 mole Ag was added. The resulting emulsion was then centrifuged and resuspended in 40 mL of a 3% deionized bone gelatin solution.

Figure 33A:
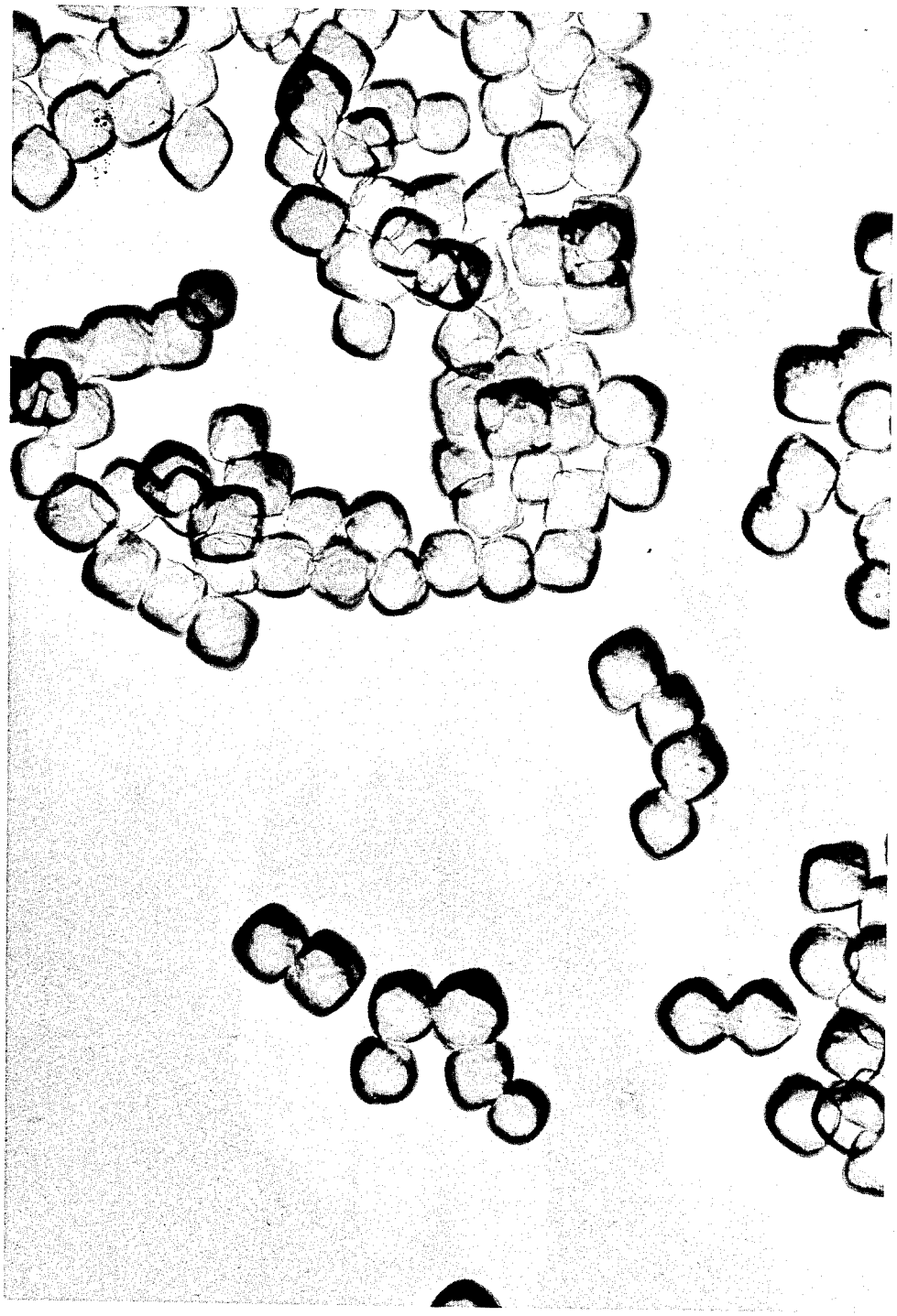

FIG. 33A is an electron micrograph of the resulting ruffled grain octahedral emulsion.

CONTROL EMULSION 16B

Control Emulsion 16B was prepared as described for Example Emulsion 16A, but without the growth modifier (Compound V) being present during the precipitation. Following precipitation 1.25 millimole of Compound V was added, a typical amount of sensitizing dye for an emulsion of this grain size.

Figure 33B:
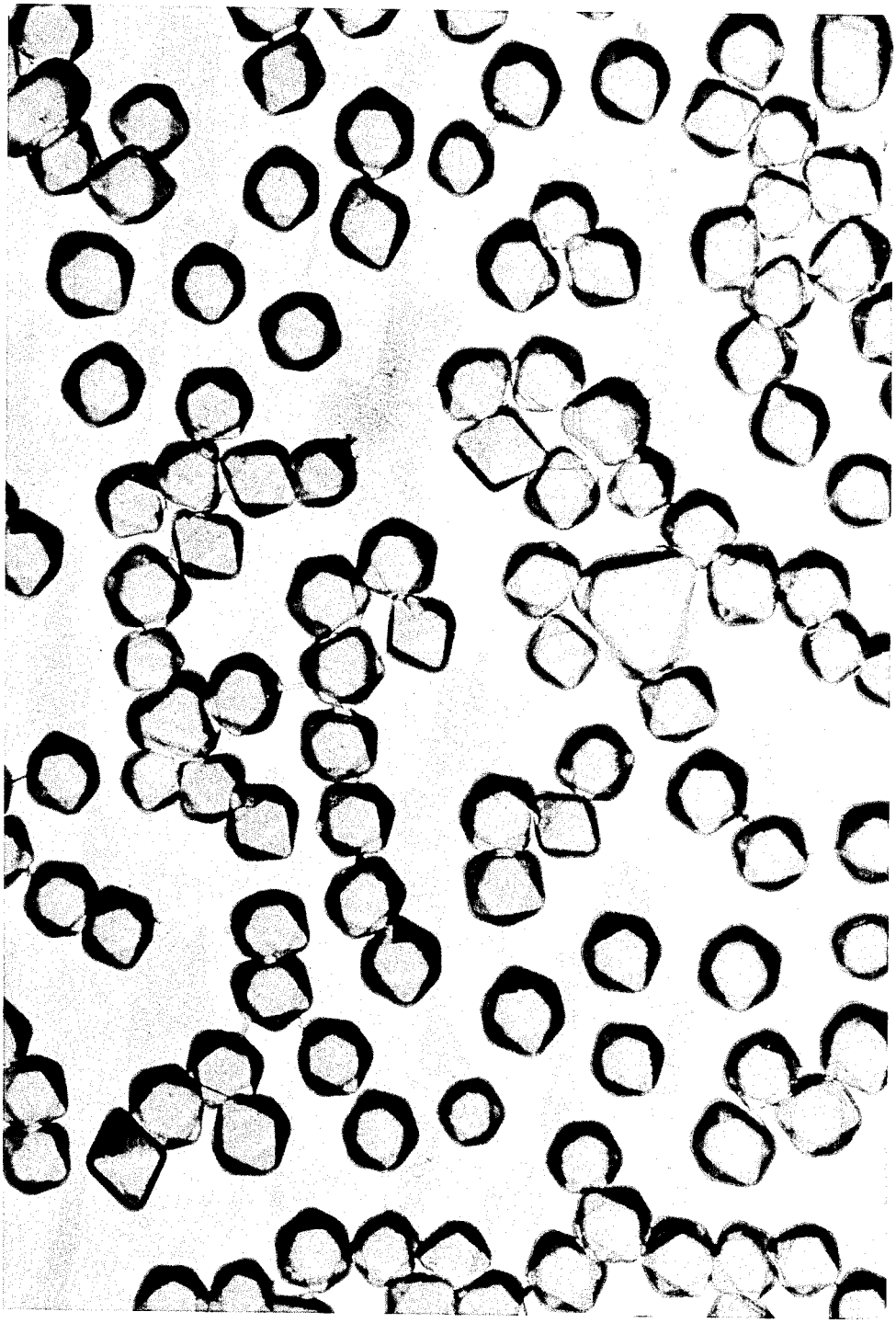

FIG. 33B is an electron micrograph showing the resulting regular octahedral grains. No ruffling of the grain surfaces is identifiable.

CONTROL EMULSION 16C

A portion of Control Emulsion 16B was modified after precipitation and before coating by increasing the total content of Compound V to 3.75 millimole/Ag mole, which equaled its concentration in Example Emulsion 16A.

Each of the emulsions was coated on a cellulose acetate support at 1.18 g/m$^2$ silver and 4.20 g/m$^2$ gelatin. Samples of the coatings were exposed for ½ second through a graduated tablet to a 365 nm filtered mercury light source to provide a measure of intrinsic speed, and to a Wratten 47 filtered tungsten light source to provide blue speed. Eastman 1B Sensitometers were used. The exposed samples were developed for 6 minutes at 20° C. in Kodak Rapid X-ray Developer. The difference between blue speed and 365 nm speed was taken as the measure of the relative degree of spectral sensitization for each of the three coatings and is tabulated in in Table V.

TABLE V

| | Example 16 Sensitometric Results Blue Speed - 365 nm Speed | |
|---|---|---|
| Emulsion | Δ Relative Speed | Comments |
| 16B | 0 | Control, 1.25 mmole Cpd. V/Ag mole |
| 16C | +25 | Control, 3.75 mmole Cpd. V/Ag mole |
| 16A | +58 | Example, 3.75 mmole Cpd. V/Ag mole |

The data show that Example Emulsion 16A had a significantly greater blue speed relative to its 365 nm speed than did the control unruffled Control Emulsions 16B and 16C with a normal spectral sensitization or with an equal amount of sensitizing dye equal to that of the ruffled grain Example Emulsion 16A, respectively.

COMPARATIVE EXAMPLE 17

The purpose of this comparative example is to report the result of adding 6-nitrobenzimidazole to a reaction vessel prior to the precipitation of silver bromide, as suggested by Wulff et al U.S. Pat. No. 1,696,830.

A reaction vessel equipped with a stirrer was charged with 0.75 g of deionized bone gelatin made up to 50 g with water. 6-Nitrobenzimidazole, 16.2 mg (0.3 weight % based on the Ag used), dissolved in 1 mL of methanol, was added, followed by 0.055 mole of KBr. At 70° C. 0.05 mole of a 2M solution of $AgNO_3$ was added at a uniform rate over a period of 25 min. The grains formed were relatively thick tablets showing {111} crystal faces. There was no indication of ruffled crystal faces of the invention.

COMPARATIVE EXAMPLE 18

The purpose of this comparative example is to report the result of employing 4-hydroxy-6-methyl-1,3,3a,7-tetraazaindene, sodium salt during grain precipitation, as suggested by Smith *Particle Growth and Suspension,* cited above.

To 100 mL of a 3% bone gelatin solution were added simultaneously 10 mL of 1.96M $AgNO_3$ and 10 mL of 1.96M KBr at 50° C. with stirring over a period of about 20 sec. The AgBr dispersion was aged for 1 min at 50° C., then diluted to 500 mL. The dispersion was adjusted to pBr 3 with KBr.

Samples 18a, 18b.

To 80 mL of $1X10^{-3}$M KBr containing 0.4 mmole/l of 4-hydroxy-6-methyl-1,3,3a,7-tetraazaindene, sodium salt and 0.6 mmole/l of 1-dodecylquinolinium bromide was added 20 mL of the above dispersion, which was then stirred at 23° C. Samples were removed after 15 min (Sample 18a) and 60 min (Sample 18b).

Samples 18c, 18d

Samples 18c and 18d were prepared similarly as Samples 18a and 18b, respectively, except that 0.8 mmole/l of 4-hydroxy-6-methyl-1,3,3a,7-tetraazaindene and 0.6 mmole/l of 1-dodecylquinolinium bromide were used.

Examination of the grains of each of the samples revealed rounded cubic grains. No ruffled crystal faces were observed.

The invention has been described in detail with particular reference to preferred embodiments thereof, it will be understood that variations and modifications can be effected within the spirit and scope of the invention.

What is claimed is:

1. A radiation sensitive emulsion comprised of silver halide grains of a cubic crystal lattice structure having faces ruffled by protrusions which are silver halide crystal lattice extensions from a base plane of a first crystallographic form, silver halide adjacent said base plane, beneath said base plane and in said protrusions, favoring the formation of surfaces of the first crystallographic form, and said protrusions presenting surfaces of a second crystallographic form.

2. A radiation sensitive emulsion according to claim 1 wherein said ruffles present a total surface area at least 50 percent greater than that presented by the base planes on which they are located.

3. A radiation sensitive emulsion according to claim 1 in which said first crystallographic form is a cubic crystallographic form.

4. A radiation sensitive emulsion according to claim 1 in which said first crystallographic form is an octahedral crystallographic form.

5. A radiation sensitive emulsion according to claim 1 in which silver halide adjacent said base plane, beneath said base plane and in said protrusions, consists essentially of silver bromide optionally additionally containing a minor proportion of iodide.

6. A radiation sensitive emulsion according to claim 1 in which tabular silver halide grains having at least one ruffled major crystal face and a thickness of less than 0.2 μm have an average aspect ratio of greater than 5:1 and account for at least 50 percent of the total projected area of all silver halide grains having at least one ruffled major crystal face.

7. A radiation sensitive emulsion according to claim 1 in which tabular silver halide grains having at least one ruffled major crystal face, a thickness of less than 0.5 μm, and a diameter of at least 0.6 μm have an average aspect ratio of greater than 8:1 and account for at least 50 percent of the total projected area of all silver halide grains having at least one ruffled major crystal face.

8. A radiation sensitive emulsion according to claim 1 in which said protrusions include those which are in the form of ridges or pyramids.

9. A radiation sensitive emulsion according to claim 1 in which a growth modifier is adsorbed to said ruffled faces of said silver halide grains.

10. A radiation sensitive emulsion according to claim 9 in which said growth modifier is chosen from the class consisting of 5-carbethoxy-4-hydroxy-1,3,3a,7-tetraazaindene; 3-carboxymethyl-5-(2-pyrrolino-1-cyclopenten-1-ylmethylene)rhodanine; anhydro-5-chloro-9-ethyl-5′-phenyl-3,3′-di-(3-sulfopropyl)oxacarbocyanine hydroxide, triethylamine salt; anhydro-9-ethyl-5,5′-diphenyl-3,3′-di-(3-sulfobutyl)oxacarbocyanine hydroxide, monosodium salt; 5-(3-ethyl-2-benzothiazolinylidene)-3-β-sulfoethylrhodanine; 4-hydroxy-6-methyl-1,2,3a,7-tetraazaindene; 4-hydroxy-6-methyl-2-methylthio-1,3,3a,7-tetraazaindene; 5-imino-3-thiourazole; 4-hydroxy-6-methyl-1,3,3a,7-tetraazaindene; 3-carboxymethyl-5-{[3-(3-sulfopropyl)-2-thiazolidinylidene]ethylidene}rhodanine, sodium salt; 2-mercaptoimidazole; and anhydro-3,9-diethyl-5,5′,6′-trimethoxy-3′-(3-sulfopropyl)thiacarbocyanine hydroxide.

11. A radiation sensitive emulsion comprised of silver halide grains of a cubic crystal lattice structure having ruffled faces characterized in that said faces are ruffled by pyramidal protrusions which are silver halide crystal lattice extensions from a base plane of a first crystallographic form, silver halide adjacent said base plane, beneath said base plane and in said protrusions, favoring the formation of surfaces of the first crystallographic form and consisting essentially of silver bromide optionally containing a minor proportion of iodide, and said pyramidal protrusions presenting surfaces of a second crystallographic form.

12. A radiation sensitive emulsion according to claim 11 in which said pyramidal protrusions exhibit a surface area which is at least 100 percent greater than their base area.

13. A radiation sensitive emulsion according to claim 11 in which said base plane is of a {111} crystallographic form.

14. A radiation sensitive emulsion according to claim 11 in which tabular silver halide grains having at least one ruffled major crystal face and a thickness of less than 0.2 μm have an average aspect ratio of greater than 5:1 and account for at least 50 percent of the total projected area of all silver halide grains having at least one ruffled major crystal face.

15. A radiation sensitive emulsion according to claim 14 in which tabular silver halide grains having at least one ruffled major crystal face, a thickness of less than 0.2 μm, and a diameter of at least 0.6 μm have an average aspect ratio of greater than 8:1 and account for at least 50 percent of the total projected area of all silver halide grains having at least one ruffled major crystal face.

16. A radiation sensitive emulsion according to claim 11 in which at least a portion of said protrusions have pyramidal crystal faces of the {hhl}, {hkO}, {hll}, or {hkl} crystallographic form, where h, k, and l are independently in each occurrence unlike integers greater than zero, h is 5 or less and greater than l and k, when present, is less than h and greater than l.

17. A radiation sensitive emulsion according to claim 16 in which at least a portion of said protrusions have pyramidal crystal faces of the icositetrahedral form.

18. A radiation sensitive emulsion according to claim 17 in which a growth modifier is adsorbed to said icositetrahedral pyramidal crystal faces chosen from the group consisting of 3-carboxymethyl-5-(2-pyrrolino-1-cyclopenten-1-ylmethylene)rhodanine; 5-(3-ethyl-2-benzothiazolinylidene)-3-β-sulfoethylrhodanine; 4-hydroxy-6-methyl-2-methylthio-1,3,3a,7-tetraazaindene; and 2-mercaptoimidazole.

19. A radiation sensitive emulsion according to claim 16 in which at least a portion of said protrusions have pyramidal crystal faces of the trisoctahedral form.

20. A radiation sensitive emulsion according to claim 19 in which a 4-hydroxy-6-methyl-1,3,3a,7-tetraazaindene growth modifier is adsorbed to said trisoctahedral pyramidal crystal faces.

21. A radiation sensitive emulsion according to claim 16 in which at least a portion of said protrusions have pyramidal crystal faces of the rhombic dodecahedral form.

22. A radiation sensitive emulsion according to claim 21 in which a growth modifier is adsorbed to said rhombic dodecahedral pyramidal crystal faces chosen from the group consisting of 4-hydroxy-6-methyl-1,2,3a,7-tetraazaindene and 5-imino-3-thiourazole.

23. A radiation sensitive emulsion according to claim 16 in which at least a portion of said protrusions have pyramidal crystal faces of the cubic form.

24. A radiation sensitive emulsion according to claim 23 in which a growth modifier is adsorbed to said cubic pyramidal crystal faces chosen from the group consisting of anhydro-5-chloro-9-ethyl-5′-phenyl-3,3′-di-(3-sulfopropyl)oxacarbocyanine hydroxide, triethylamine salt and anhydro-9-ethyl-5,5′-diphenyl-3,3′-di(3-sulfobutyl)oxacarbocyanine hydroxide, monosodium salt.

25. A photographic element containing an emulsion according to claim 1.

26. A photographic element containing an emulsion according to claim 11.

* * * * *